US007946563B2

(12) United States Patent
Fukasawa et al.

(10) Patent No.: US 7,946,563 B2
(45) Date of Patent: May 24, 2011

(54) SHEET POST-PROCESSING APPARATUS AND IMAGE FORMING SYSTEM COMPRISING THE SAME

(75) Inventors: Eiji Fukasawa, Yamanashi (JP); Ichitaro Kubota, Koufu (JP); Kenichi Matsuno, Koufu (JP)

(73) Assignee: Nisca Corporation, Minamikoma-Gun, Yamanashi-Ken (JP)

( * ) Notice: Subject to any disclaimer, the term of this patent is extended or adjusted under 35 U.S.C. 154(b) by 639 days.

(21) Appl. No.: 12/010,952

(22) Filed: Jan. 31, 2008

(65) Prior Publication Data

US 2008/0181701 A1 Jul. 31, 2008

(30) Foreign Application Priority Data

| | | |
|---|---|---|
| Jan. 31, 2007 | (JP) | 2007-022038 |
| Jan. 31, 2007 | (JP) | 2007-022040 |
| Jan. 31, 2007 | (JP) | 2007-022041 |
| May 30, 2007 | (JP) | 2007-144038 |
| Aug. 28, 2007 | (JP) | 2007-221653 |
| Aug. 28, 2007 | (JP) | 2007-221654 |

(51) Int. Cl.
*B65H 37/04* (2006.01)

(52) U.S. Cl. ..... 270/37; 270/32; 270/45; 270/58.07; 270/58.08; 270/58.09; 270/58.11; 270/58.1

(58) Field of Classification Search ..... 270/32, 270/37, 45, 51, 58.07, 58.08, 58.09, 58.11, 270/58.12, 58.13, 58.17, 58.28, 58.1
See application file for complete search history.

(56) References Cited

U.S. PATENT DOCUMENTS

| | | | | |
|---|---|---|---|---|
| 5,662,318 | A * | 9/1997 | Harada et al. | 270/58.05 |
| 6,997,449 | B2 * | 2/2006 | Obuchi et al. | 270/32 |
| 7,165,764 | B2 * | 1/2007 | Nakamura et al. | 270/58.11 |
| 7,281,707 | B2 * | 10/2007 | Moriyama et al. | 270/58.04 |
| 7,306,214 | B2 * | 12/2007 | Iida et al. | 270/58.11 |
| 7,726,648 | B2 * | 6/2010 | Tamura et al. | 271/176 |
| 2005/0067777 | A1 * | 3/2005 | Iida et al. | 271/303 |
| 2005/0206064 | A1 * | 9/2005 | Moriyama et al. | 270/58.08 |
| 2006/0261544 | A1 * | 11/2006 | Tamura et al. | 271/303 |
| 2007/0126167 | A1 * | 6/2007 | Kushida | 270/58.12 |
| 2008/0211158 | A1 * | 9/2008 | Fukasawa et al. | 270/1.01 |
| 2009/0152788 | A1 * | 6/2009 | Kawaguchi | 270/37 |

FOREIGN PATENT DOCUMENTS

| | | |
|---|---|---|
| JP | H08-295448 | 11/1996 |
| JP | 2000-063031 | 2/2000 |
| JP | 2000-169028 | 6/2000 |

(Continued)

*Primary Examiner* — Leslie A Nicholson, III

(74) *Attorney, Agent, or Firm* — Manabu Kanesaka

(57) ABSTRACT

A post-processing apparatus for transferring sheets from a sheet carry-in port to a first post-processing section and a second post-processing section to execute post-processing such as stapling and sheet folding on the sheets, includes a sheet carry-in path located in a substantially horizontal direction. The sheets fed to the carry-in port are sequentially transferred to a predetermined sheet discharging port. A first switchback conveying path branches off from the sheet carry-in path so as to reverse a sheet conveying direction. The first post-processing section connected to the first switchback conveying path executes the post-processing on the sheets. A second switchback conveying path branching off from between the carry-in port and sheet discharging port of the sheet carry-in path is upstream of the first switchback conveying path so as to reverse the sheet conveying direction. The second post-processing section is located downstream of the second switchback conveying path.

14 Claims, 41 Drawing Sheets

FOREIGN PATENT DOCUMENTS

| | | |
|---|---|---|
| JP | 2002-214973 | 7/2002 |
| JP | 2003-266405 | 9/2003 |
| JP | 2004-269158 | 9/2004 |
| JP | 2004-269249 | 9/2004 |
| JP | 2007-214973 | 8/2007 |

* cited by examiner

Image formation in stapling finish mode

Image formation in sheet bunch folding finisih mode

SHEET POST-PROCESSING APPARATUS AND IMAGE FORMING SYSTEM COMPRISING THE SAME

BACKGROUND OF THE INVENTION AND RELATED ART STATEMENT

The present invention relates to a post-processing apparatus for stapling sheets carried out from an image forming apparatus such as a copier or a printer or for folding the sheets at a predetermined fold position. More particularly, the present invention relates to improvements in apparatus configuration allowing the apparatus to efficiently post-process continuously carried-out sheets.

In general, post-processing apparatuses which staples sheets carried out from an image forming apparatus or which folds the sheets into a booklet are well known. Such a post-processing apparatus comprises a plurality of sheet collecting means in order to post-process the sheets. For example, a first sheet collecting means collects and staples the sheets into a bunch. A second sheet collecting means folds the collected sheets into a booklet.

For example, Patent Document 1 (Japanese Patent Laid-Open No. 2000-63031) discloses an apparatus that selectively conveys sheets from an image forming apparatus through a path branching off to upper first sheet collecting means and lower second sheet collecting means. According to Japanese Patent Laid-Open No. 2000-63031, two staple devices are arranged in the sheet path leading to the first and second sheet collecting means. The sheets are collected at the staple position. The first staple device performs out end surface stapling by stapling the sheets at an end thereof, and the second staple device performs saddle stitching by stapling the sheets at the center thereof. Thus, the staple position is provided on one of the branching paths to staple and carry the sheets out to a first tray and a second tray. Then, the second sheet collecting means, positioned below the first sheet collecting means, folds the stapled sheets into a booklet and then carries out the sheets for housing.

Likewise, Patent Document 2 (Japanese Patent Laid-Open No. 2000-169028) switches sheets carried out from the image forming apparatus, back from a carry-in path and collects the sheets in sheet collecting means. The sheets are then stapled at the end surface thereof by a staple device located on a tray and then accommodated in a housing stacker located behind the tray. On the other hand, the sheet bunch on the tray are stapled at the center thereof and then guided to the front of the tray. The sheet bunch is folded into a booklet on a folding path located in front of the tray and is collected in a housing stacker.

Both, Patent Document 1 and Patent Document 2, adopt the apparatus configuration in which sheets are set and collected on the path (or tray) with the staple device located thereon, stapled, and then carried out to the first and second tray. Furthermore, Patent Document 3 (Japanese Patent Laid-Open No. 2004-269158) proposes an apparatus configuration in which sheets from an image forming apparatus are guided to a first path and a second path which branch off from each other, and are set and stapled on each of the paths, with the sheets on one of the paths directly carried out to a sheet discharging stacker and the stapled sheets on the other path folded into a booklet and then carried out to the sheet discharging stacker.

Further, Patent Document 4 (Japanese Patent Laid-Open No. 8-295448) discloses a mechanism used in an apparatus configuration having a driver unit and a clinch unit which are separate from each other, to support the units so that the positions of the units are movable in a sheet width direction. In Japanese Patent Laid-Open No. 8-295448, FIG. 20 shows a guide shaft that supports the driver unit so that the position of the driver unit is movable in the sheet width direction and a lead screw that moves the position of the unit. Further, FIG. 23 shows a guide shaft that supports the clinch unit so that the position of the clinch unit is movable in the sheet width direction, and a traveling wire that moves the position of the unit. A drive motor is coupled to the lead screw and the traveling wire and controlled to control the position of each unit.

Further, Patent Document 5 (Japanese Patent Laid-Open No. 2002-214973), discloses an end stapler that is located on a first tray positioned above a sheet conveying path to staple sheets at an edge thereof. A saddle stitching stapler is located on a second tray positioned below the sheet conveying path to staple the sheets at the center thereof. The sheet bunch loaded on the first tray is stapled at the edge (trailing edge) and then discharged to a downstream stacker. The sheet bunch loaded on the second tray are stapled at the center thereof, folded together, and then discharged to the downstream stacker.

Further, Patent Document 6 (Japanese Patent Laid-Open No. 2003-266405) proposes a mechanism that varies a direction in which needle points are bent, depending on the thickness of a sheet bunch. Japanese Patent Laid-Open No. 2003-266405 proposes an anvil unit which has a plurality of folding grooves and the position of which is adjusted relative to a driver unit to vary the bending direction of the needle point. Japanese Patent Laid-Open No. 2003-266405 further proposes that for a bunch of a normal bunch thickness, U-shaped needle points be bent so as to face each other and that for a bunch of a smaller bunch thickness, the needle points be folded in the same direction.

Further, Patent Document 7 (Japanese Patent Laid-Open No. 2004-269249) proposes an apparatus configuration which guides sheets from an image forming apparatus to a first path and a second path which branch off from each other and on each of which the sheets are set and stapled, with the sheets on one of the paths directly carried out to a sheet discharging stacker and the stapled sheet bunch on the other path folded together and then carried out to the sheet discharging stacker.

Patent Document 8 (Japanese Patent Laid-Open No. 2007-214973) discloses a post-processing apparatus having first trays arranged above and below a sheet carry-in path and a second tray located below the first trays so that sheets from the sheet carry-in path are housed on the first trays and housed on the second tray via a switchback path. A saddle stitching stapler is located on the second tray to staple the collected sheets at the center thereof.

When both stapling mechanism and sheet folding mechanism are incorporated into an apparatus, which sets and staples sheets carried out from an image forming apparatus or the like, folds the sheets into a booklet, and executes post-processing such as punching on the booklet, as described above, the conventional apparatus configurations pose the following problems.

The consecutively carried-out sheets are not efficiently processed by the apparatus configuration in which the sheets are guided to the common path so that the sheet bunch collected on the path is stapled and carried out to the first and second stackers and in which the sheet folding mechanism is located in one of the paths to the stackers as in the case of Patent Document 1 (Japanese Patent Laid-Open No. 2000-63031) and Patent Document 2 (Japanese Patent Laid-Open No. 2000-169028). For example, during the operation time when the staple device executes a stapling process on the collected sheet bunch, the carrying-out operation of the succeeding sheet must be stopped. Also, when a preceding sheet bunch is stapled at the end surface thereof by the staple device and then carried out to the first stacker and the succeeding sheet is stapled at the center thereof by the staple device and then carried out to the second stacker via the folding mechanism, the succeeding sheet cannot be processed until the preceding sheet bunch has been completed. Furthermore, when a trouble such as a sheet jam occurs in the staple device or the like, the succeeding sheet may be jammed requiring the whole apparatus to be shut down.

On the other hand, the paths are bent in the apparatus configuration in which sheets from the image forming apparatus are sorted, at a carry-in port, into the first and second paths and in which the end stapling process and the sheet folding process are executed on the respective paths as in the case of Patent Document 3 (Japanese Patent Laid-Open No. 2004-269158). With this configuration, cardboards for color printing or the like are difficult to handle. With a compact configuration, the paths must be bent in order to distribute the sheets to the first and second paths via the carry-in port. It is difficult for such a bent apparatus configuration to smoothly convey color printed sheets or the like which are relatively thick and which have a small coefficient of friction. This disadvantageously results in the increased size of the apparatus, frequent sheet jams, or the like.

It is therefore necessary that the sheets from an image forming apparatus should be stably conveyed, which is performed by carrying the sheets into the apparatus through a linear carry-in path and a switchback path. Further, the above-described problems can be obviated by constructing a first switchback conveying path and a second switchback conveying path which are arranged away from the carry-in path and installing a staple mechanism and a sheet folding mechanism in the respective switchback conveying paths.

It is therefore an object of the present invention to provide a post-processing apparatus performing a stapling finish and a sheet folding finish on sheets carried out from an image forming apparatus, wherein the apparatus is small and compact and is capable of stably executing processing.

Another object of the present invention is to provide a post-processing apparatus that, when a stapling finish and a sheet folding finish is to be placed on consecutively carried-out sheets, allows the succeeding sheet to be carried into the apparatus during one of the post-processing operations so as to allow the other post-processing operation to be performed on the succeeding sheet thereby allowing the consecutive post-processing operations to be efficiently performed.

Further objects and advantages of the invention will become apparent from the following description of the invention.

SUMMARY OF THE INVENTION

To accomplish the above objects, the present invention adopts the following configuration.

A post-processing apparatus according to the present invention transfers sheets from a sheet carry-in port to a first post-processing section and a second post-processing section which are different from each other and which execute post-processing such as stapling and sheet folding on the sheets, and includes a sheet carry-in path located in a substantially horizontal direction. The sheets that are fed to the carry-in port are sequentially transferred to a predetermined sheet discharging port, a first switchback conveying path branching off from the sheet carry-in path so as to reverse a sheet conveying direction, the first post-processing section connected to the first switchback conveying path to execute the post-processing on the sheets, a second switchback conveying path branching off from between the carry-in port and sheet discharging port of the sheet carry-in path upstream of the first switchback conveying path so as to reverse the sheet conveying direction to transfer the sheets to a position different from that of the sheet carry-in path. The second post-processing section is located downstream of the second switchback conveying path to execute the post-processing on the sheets.

The first post-processing section has first sheet collecting means, on which the sheets from the first switchback conveying path are set and collected into a bunch and staple means for stapling the sheets collected on the first sheet collecting means, at an edge thereof. The second post-processing section has at least one of second sheet collecting means on which the sheets from the second switchback conveying path are set and collected into a bunch. A folding roll means is provided for folding together the sheets collected on the second sheet collecting means. Further, a saddle stitching staple means is provided for stapling the sheets at a center thereof.

The sheet carry-in path is located in a substantially horizontal direction, and the second switchback conveying path is located in a substantially vertical direction.

A sheet discharging tray is located on the sheet carry-in path downstream of the first and second switchback conveying paths so that the sheets are loaded and supported on the sheet discharging tray. The sheet discharging tray supports a leading end of the sheets guided through the first switchback conveying path and the second switchback conveying path.

The sheet discharging tray on which the sheets and/or sheet bunch is loaded and housed is connected to the first sheet collecting means. The sheet discharging tray supports the sheet-conveying-direction for leading end of the sheets from the sheet carry-in path and is connected to the first sheet collecting means so that a sheet-conveying-direction for trailing end of the sheets is supported by the first sheet collecting means.

Further, a forward reversible sheet conveying roller means is located on the second switchback conveying path for temporarily holding, on the switchback conveying path, the sheet traveling to the first sheet collecting means positioned downstream of the sheet carry-in path.

The post-processing apparatus further includes sheet discharging roller means located at a sheet discharging port of the sheet carry-in path, a sheet conveying roller means located at a path inlet of the second switchback conveying path, and a conveyance control means for controlling the sheet discharging roller means. The sheet conveying roller means, and the conveyance control means controls the sheet discharging roller means and the sheet conveying roller means so that the succeeding sheet fed to the carry-in port stands by temporarily on the second switchback conveying path while the first post-processing section is performing a post-processing operation. Therefore, after the post-processing operation of the first post-processing section is finished, the succeeding sheet standing by on the second switchback conveying path is transferred to the first post-processing section.

Further, to allow a plurality of sheets on the second switchback conveying path so that the sheets overlap one another, the conveyance control means intermittently and rotationally drives the sheet conveying roller means to offset the overlapping sheets forward and backward in a conveying direction by a predetermined amount.

The sheet collecting means located in the first post-processing means gets loaded with the sheets from the sheet discharging port and the sheets are housed on the sheet collecting means. The sheet collecting means has a sheet end regulating means against which the sheet end abuts for regulation and aligning conveying means thereby transferring the sheet to the regulating means. The conveyance control means sets an offset amount by which a plurality of sheets are offset from each other on the switchback conveying path, longer than a distance between the sheet end regulating means and the aligning conveying means.

Further, the sheet discharging roller means and the sheet conveying roller means are configured so that a distance between the sheet discharging roller means and the sheet conveying roller means is shorter than at least a conveying-direction distance of a maximum sized sheet. The roller means includes a pair of rollers that are able to freely come into pressure contact with each other and leave each other. The conveyance control means separates the sheet discharging rollers from each other to lay the standby sheet standing by on the second switchback conveying path, on top of the succeeding sheet fed to the carry-in port and then uses the sheet discharging rollers to transfer the sheets to the first post-processing section.

A sheet locking member is located on the sheet carry-in path upstream of the second switchback conveying path and temporarily holds the sheet traveling to the second switchback conveying path.

In addition to the first and second switchback conveying paths, a path is constructed on the sheet carry-in path so that the sheets fed to the carry-in port are discharged to an exterior of the apparatus via the path.

The end surface staple means and the saddle stitching staple means are arranged in a vertical direction in a space surrounded by the sheet carry-in path and the first and second switchback conveying paths.

A single drive motor constitutes both the end surface staple means and the saddle stitching staple means. A moving stroke of the saddle stitching staple means is set shorter than that of the end surface staple means.

The post-processing apparatus further includes a first guide means and a second guide means for supporting the end surface staple means and the saddle stitching staple means so that the end surface staple means and the saddle stitching staple means are movable along an edge of the collected sheets. A position sensor is located on only one of the first guide means and the second guide means to detect positions of the first processing unit and the second processing unit.

Further, the saddle stitching staple means includes a sheet loading table on which the sheet bunch is held at a predetermined staple position, a driver unit sticking a staple needle into the sheet bunch supported on the sheet loading table, a clinch unit folding a tip of the staple needle stuck into the sheet bunch, a moving unit including the driver unit and which is movable in a sheet width direction, the second guide means for supporting the moving unit so that the moving unit is movable in the width direction relative to the sheet bunch on the sheet loading table, a driving means for moving the moving unit is movably supported by the guide means, and a control means for controlling the driving means. An abutting stopper member is located in the guide means to position the moving unit at a preset predetermined position. The driving means includes a drive motor and a position holding means allowing the moving unit to abut against the abutting stopper member and holding the position of the moving unit. The position holding means holds the position of the moving unit abutting against the abutting stopper member using one of (1) a sliding transmission means located between the drive motor and the moving unit, (2) a spring means for biasing the moving unit toward the abutting stopper member, and (3) a magnetic torque induced by magnetic imbalance occurring between a rotor and a stator of the drive motor.

The saddle stitching staple means includes sheet bunch holding means for holding the series of sheets set into a bunch, in a predetermined posture, staple means for stapling the sheet bunch held by the sheet bunch holding means, and staple control means for controlling a staple operation of the staple means. The staple means includes a head unit and an anvil unit which are separate from each other, the head unit having a driver member sticking the staple needle into the sheet bunch held by the sheet bunch holding means. The anvil unit has a folding groove in which the tip of the staple needle is stuck into the sheet bunch is folded. The head unit is configured to be movable in a predetermined width direction of the sheet bunch held on the sheet bunch holding means. Further, the anvil unit has a plurality of the folding grooves arranged at different positions in the width direction and which have different tip folding depths. The staple control means moves the head unit to a position located opposite the folding groove with a folding shape selected in accordance with a sheet bunch thickness and/or a sheet material to staple the sheet bunch at one position or a plurality of positions.

The sheet carry-in path includes a first sheet discharging tray downstream of the first and second switchback conveying paths and on which the sheets are loaded and supported, a second sheet discharging tray on which the sheet bunch processed by the saddle stitching staple means is loaded and supported, and a tray elevating and lowering means for supporting the first sheet discharging tray so that the first sheet discharging tray is able to elevate and lower. The first sheet discharging tray and the second sheet discharging tray are arranged in a vertical direction, ,and an outer cover between the first sheet discharging tray and the second sheet discharging tray has an opening and closing cover through which the saddle stitching staple means is maintained.

An image forming system including a post-processing apparatus according to an embodiment of the present invention, has an image forming apparatus sequentially forming images on sheets and the post-processing apparatus executing post-processing such as a stapling process, a stamping process, and a punching process on the sheets from the image forming apparatus. The post-processing apparatus transfers sheets conveyed from a sheet carry-in port to a first post-processing section and a second post-processing section which are different from each other and which execute post-processing such as stapling and sheet folding on the sheets, and includes a sheet carry-in path located in a substantially horizontal direction and along which the sheets fed to the carry-in port are sequentially transferred to a predetermined sheet discharging port. A first switchback conveying path branching off from the sheet carry-in path so as to reverse a sheet conveying direction, a first post-processing section connected to the first switchback conveying path to execute post-processing on the sheets, a second switchback conveying path branching off from between the carry-in port and sheet discharging port of the sheet carry-in path upstream of the first switchback conveying path so as to reverse the sheet conveying direction to transfer the sheets to a position different from that of the sheet carry-in path, and a second post-processing section located downstream of the second switchback conveying path to execute the post-processing on the sheets are provided.

BRIEF DESCRIPTION OF THE DRAWINGS

FIG. 6(*b*) is a plan view illustrating the folding roll means in FIG. 4 as viewed in a sheet width direction;

FIG. 7(*b*) is a diagram illustrating a driving mechanism for a folding blade in FIG. 4;

FIG. 7(*c*) is a diagram illustrating the structure of a one-way clutch in FIG. 4;

FIG. 8(*b*) is a state diagram showing an initial state of the sheet bunch folding operation performed by the apparatus in FIG. 2;

FIG. 8(*c*) is a state diagram showing the sheet bunch inserted into a nip position of the folding roll means during the sheet bunch folding operation performed by the apparatus in FIG. 2;

FIG. 8(*d*) is a state diagram showing a carry-out state in which the sheet bunch is folded by the folding roll means during the sheet bunch folding operation performed by the apparatus in FIG. 2;

FIG. 12(*b*) is a diagram illustrating the first and second sheets housed on a processing tray;

FIG. 13(*b*) is a diagram illustrating that the first and second sheets being loaded on a stacking guide;

FIG. 14(*b*) is a front view schematically showing the configuration of the saddle stitching staple means of the apparatus;

FIG. 16(*b*) is a diagram illustrating a driving mechanism using a torque limiter as position holding means for the moving unit of the saddle stitching staple means;

FIG. 17(*b*) is a diagram illustrating a driving mechanism using a bias spring (position holding means), as a different form of the shift mechanism for the moving unit of the saddle stitching staple means;

FIG. 19(*b*) is a diagram illustrating a saddle stitching operation of the saddle stitching staple means;

FIG. 23(*b*) is a diagram showing a moving mechanism moving the end surface staple means in FIG. 2, in a sheet width direction;

FIG. 24(*b*) is a diagram showing a moving mechanism moving the saddle stitching staple means in FIG. 2, in the sheet width direction;

FIG. 25(*b*) is a diagram illustrating the transmission mechanism for the end surface staple means and the saddle stitching staple means.

DETAILED DESCRIPTION OF PREFERRED EMBODIMENTS

Figure 1:
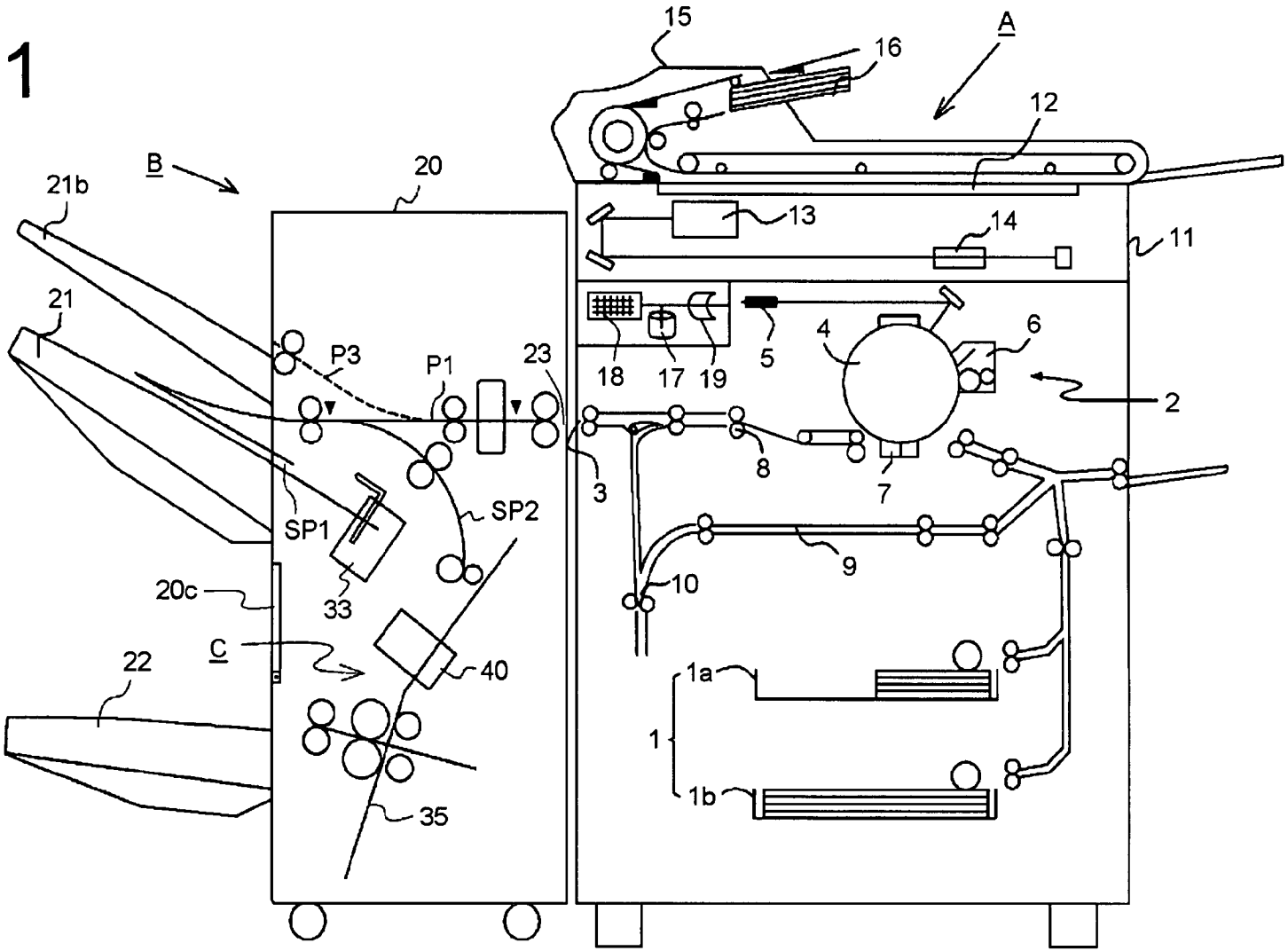
FIG. 1 is a diagram illustrating an entire image forming system according to the present invention.
Figure 2:
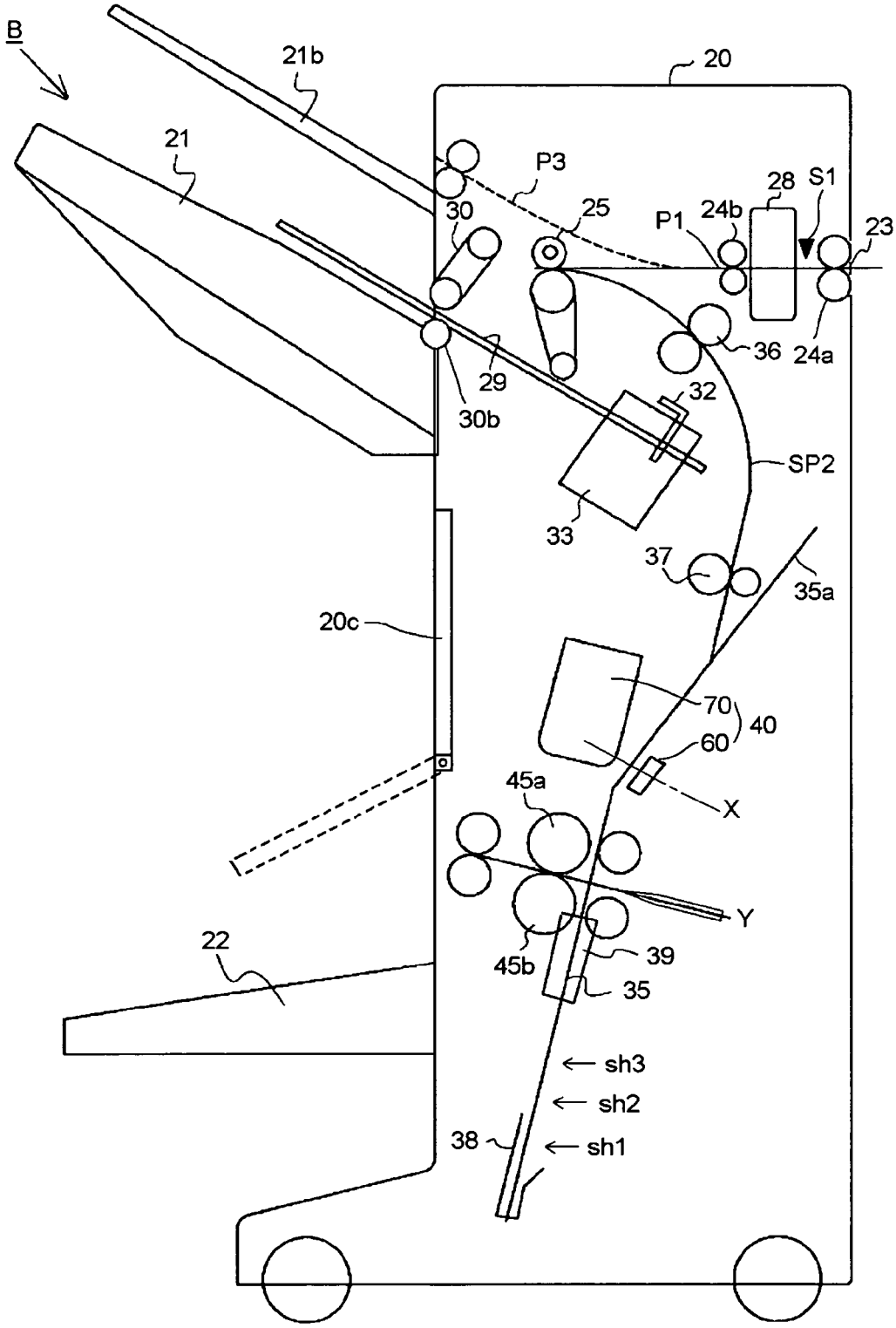
FIG. 2 is a diagram illustrating a post-processing apparatus comprising a sheet folding device according to the present invention.
Figure 3:
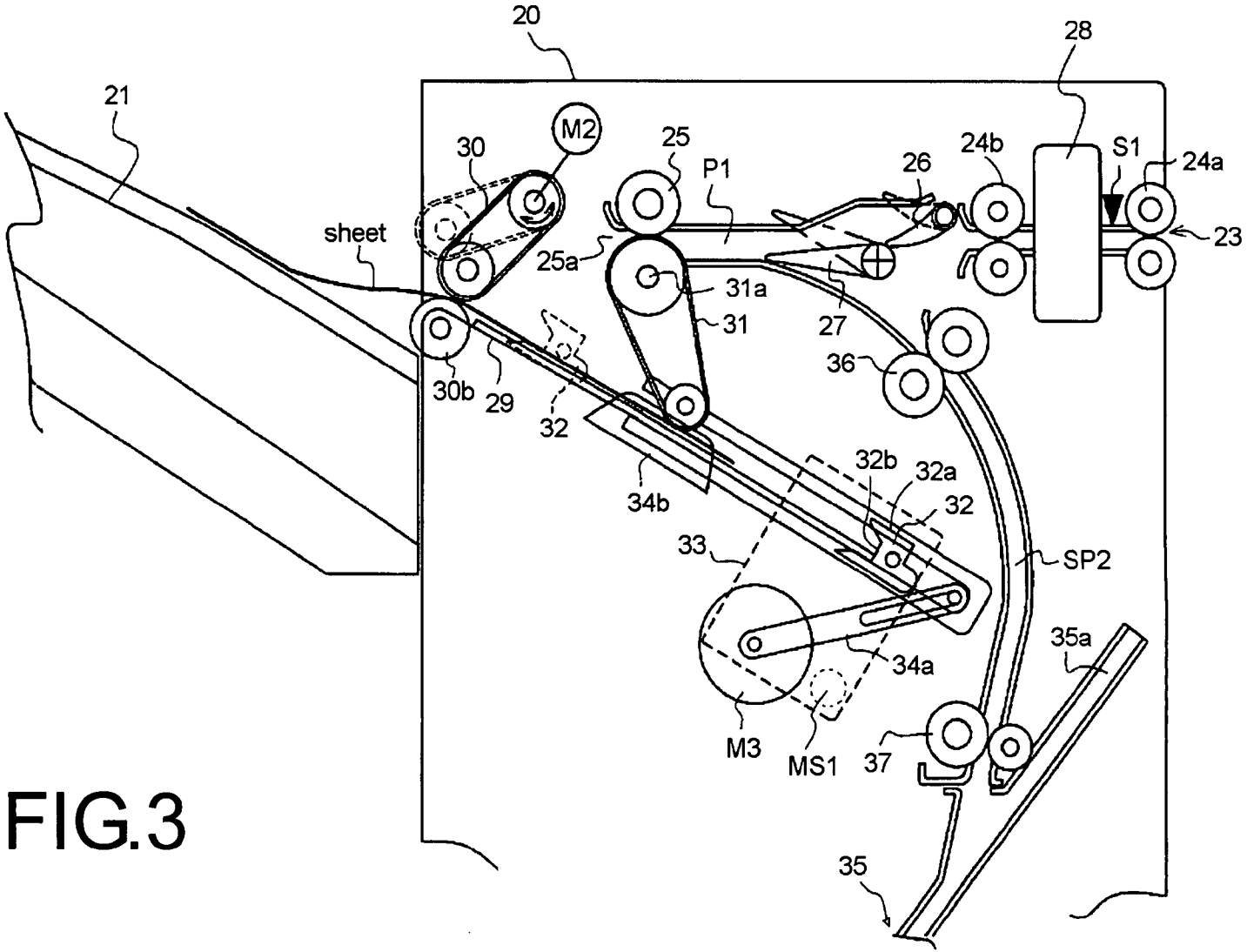
FIG. 3 is a detailed diagram illustrating a part of the post-processing apparatus in FIG. 2.

Now, preferred embodiments will be described below in detail. FIG. 1 shows the general configuration of an image forming system according to the present invention. FIG. 2 is a diagram illustrating the general configuration of a post-processing apparatus. FIG. 3 is a diagram illustrating the detailed configuration of a sheet folding device. The image forming system shown in FIG. 1 is composed of an image forming apparatus A and a post-processing apparatus B. A sheet folding device C is incorporated into the post-processing apparatus B as a unit.

In the image forming apparatus A, as shown in FIG. 1, a sheet feeding section 1 feeds a sheet to an image forming section 2. The image forming section 2 prints the sheet, which is then carried out through a body sheet discharging port 3. The sheet feeding section 1 has sheets of plural sizes housed in sheet feeding cassettes 1*a* and 1*b* and separately feeds specified sheets one by one to the image forming section 2. The image forming section 2 has, for example, an electrostatic drum 4, as well as a print head (laser light emitter) 5, a developing unit 6, a transfer charger 7, and a fixer 8 which are arranged around the periphery of the static drum 4. The laser light emitter 5 forms an electrostatic latent image on the electrostatic drum 4, and the developing unit 6 sticks toner to the latent image. The transfer charger 7 transfers the image to the sheet and the fixer 8 heats and fixes the image to the sheet. Sheets with images thus formed thereon are sequentially carried out through the body sheet discharging port 3. Reference numeral 9 in the figure denotes a circulating path for double side printing along which a sheet from the fixer 8 having an image formed on a front surface thereof is turned upside down via a body switchback path 10 and then fed to the image forming section 2 again, which prints a back surface of the sheet. The sheet with images printed on the opposite surfaces thereof is turned upside down on the body switchback path 10 and carried out through the body sheet discharging port 3.

Further, image reading device 11 has a scan unit 13 that scans a document sheet set on a platen 12 and a photoelectric converting element (not shown) that electrically reads an image from the sheet. An image data is subjected to a digital process by the image processing section. The resultant image data is transferred to a data storage section 14 and sends an image signal to the laser light emitter 5. A document feeding device 15 feeds document sheets accommodated in a stacker 16 to the platen 12.

Figure 9:
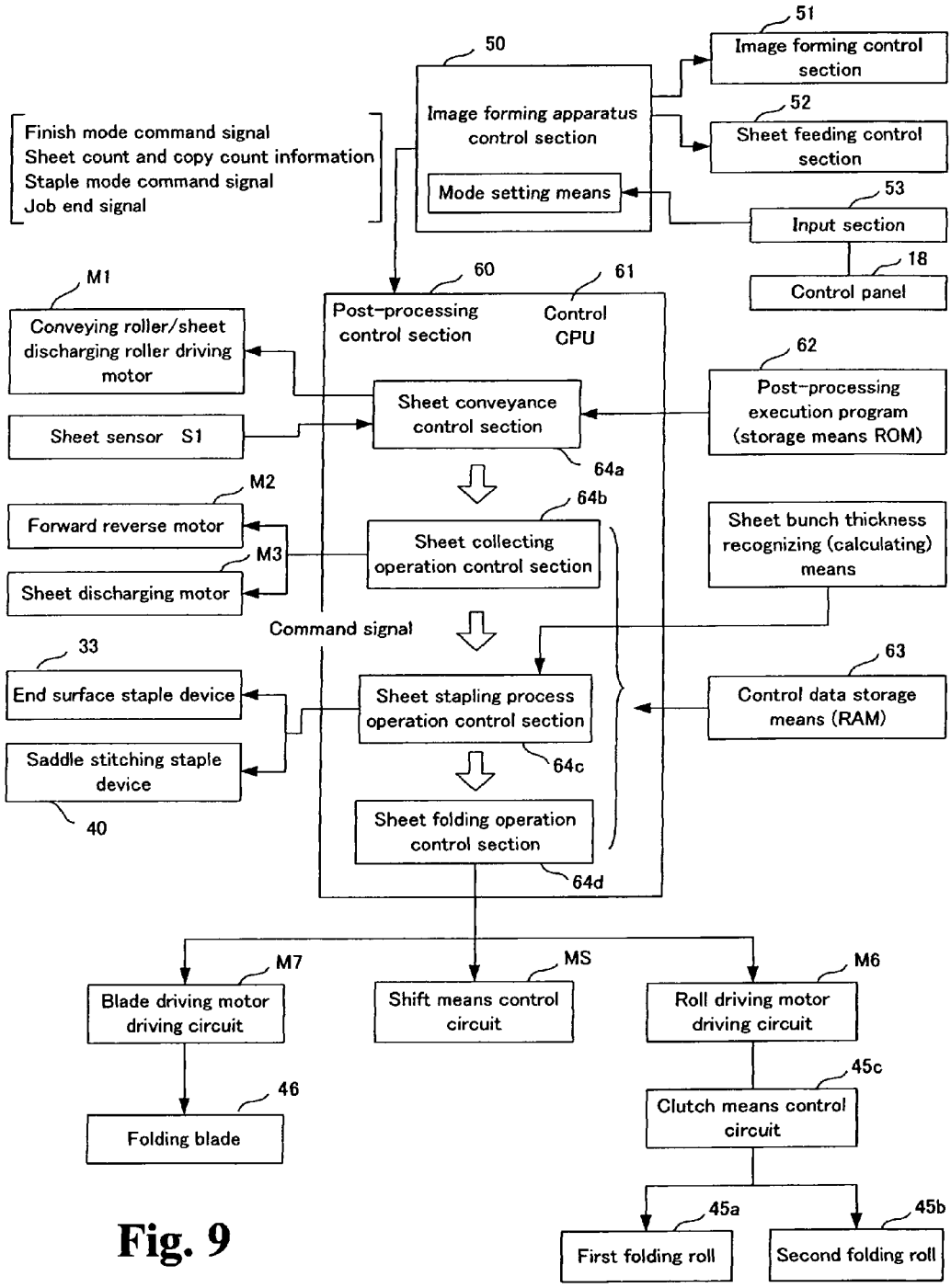
FIG. 9 is a diagram illustrating a control configuration in the system in FIG. 1.

The image forming apparatus A configured as described above has a control section (controller) shown in FIG. 9. Image formation conditions are set via a control panel 18, for example, printout conditions such as a sheet size specification, a color or black-and-white printing specification, a print copy count specification, single- or double-side printing specification, and enlarged or reduced printing specification. On the other hand, in the image forming apparatus A, image data read by the scan unit 13 or transferred through an external network is stored in a data storage section 17. The image data from the data storage section is transferred to a buffer memory 19, which sequentially transfers data signals to the laser light emitter 5.

Further, simultaneously with the image formation conditions, post-processing conditions are input and specified via the control panel 18. For example, a "printout mode", a "stapling mode", and a "sheet bunch folding mode" are specified as the post-processing conditions. The image forming apparatus A forms an image on the sheet in accordance with the image formation conditions and the post-processing conditions. This image forming aspect will be described with reference to FIG. 5. When the "single-side printing" is set as an image formation condition and the "printout mode" or the "stapling mode" is set as a post-processing condition, the image forming section 2 forms a predetermined on a specified sheet. The sheet is turned upside down on the body switchback path 10 and then carried out through the body sheet discharging port 3.

Thus, the image forming apparatus A sequentially forms images on a series of sheets from the first to nth pages. The post-processing apparatus B receives the sheets carried out in a face down posture, starting with the first page. In the "printout mode", the sheets are sequentially loaded and housed on a first sheet discharging tray 21 located in the post-processing apparatus B. In the "stapling mode", the sheets are loaded and housed on a first collecting section (first sheet collecting means; this also applies to the description below) located in the post-processing apparatus B. The sheets collected on the tray are stapled by end surface staple means 33 in response to a job end signal and then housed in the first sheet discharging tray 21.

Figure 5:
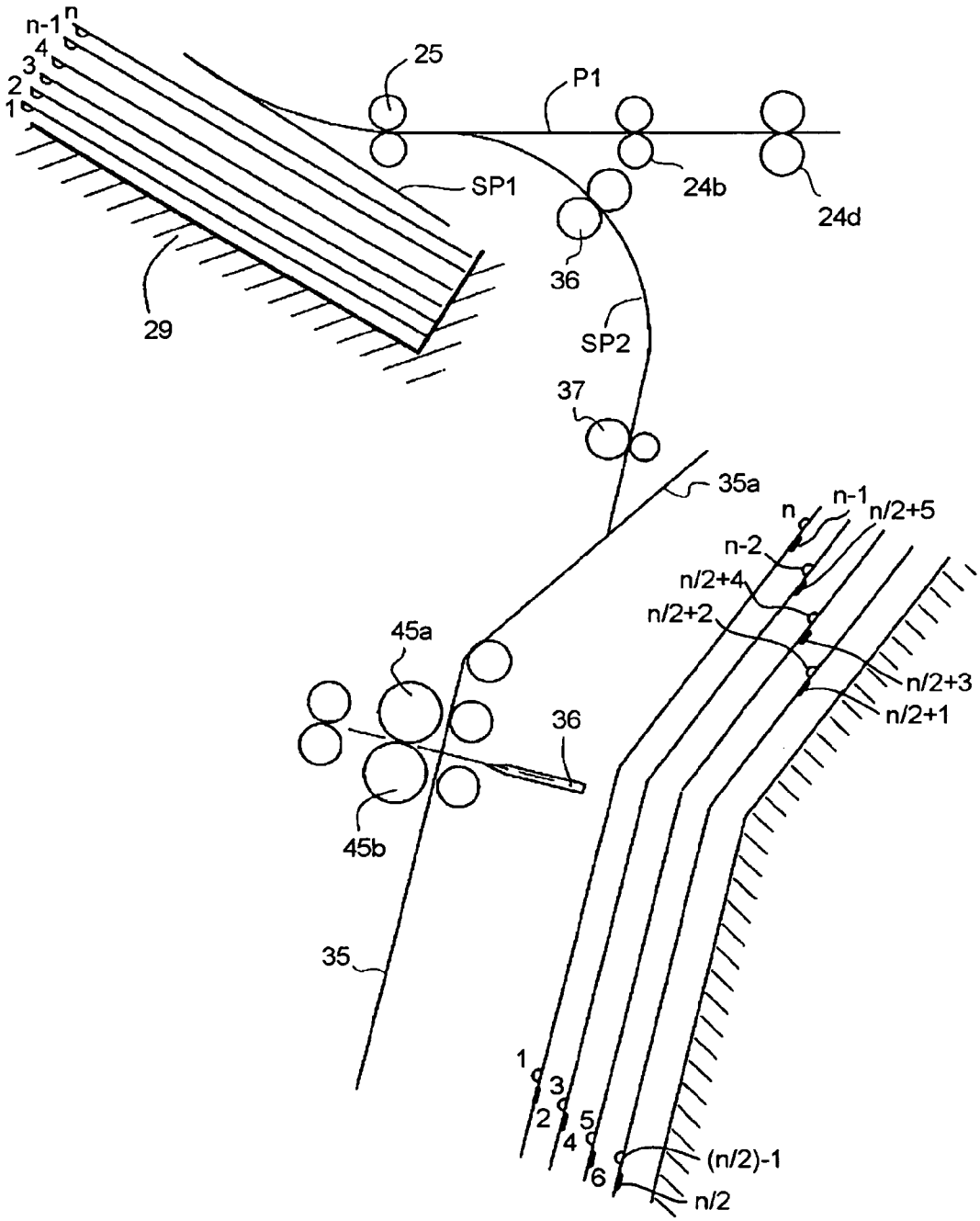
FIG. 5 is a diagram illustrating the order in which an image is formed by the apparatus in FIG. 1.

When the double-side printing and 2in1 printing are specified as image formation conditions and the "sheet folding mode" is set for post-processing, if the final page is the nth page, the image forming apparatus A forms an image for the $(n/2)^{th}$ page and an image for the $(n/2+1)^{th}$ page on a front surface of the first sheet and forms an image for the $(n/2-1)^{th}$ page and an image for the $(n/2+2)^{th}$ page on a back surface of the sheet, as shown in FIG. 5. The image forming apparatus A then carries out the sheet through the sheet discharging port 3. Then, the post-processing apparatus B houses the sheet on a second collecting section (second sheet collecting means; this also applies to the description below) 35 via a sheet carry-in path P1. Further, the image forming apparatus A forms an image for the $(n/2-2)^{th}$ page and an image for the $(n/2+3)^{th}$ page on a front surface of the next sheet and forms an image for the $(n/2-3)^{th}$ page and an image for the $(n/2+4)^{th}$ page on a back surface of the sheet. The image forming apparatus A then carries out the sheet through the sheet discharging port 3. The post-processing apparatus B then stacks the sheet on the first sheet for collection. Thus, the image forming apparatus A forms images in the order suitable for the structure of the collecting tray. For the page order, when image data is transferred from the data storage section 17 to the buffer memory 19, a printing order is calculated and used to control the print head (laser light emitter) 5.

The post-processing apparatus B, coupled to the image forming apparatus A, described above, receives the sheet with an image formed thereon from the body sheet discharging port 3 in the image forming apparatus A, through a carry-in port 23. The post-processing apparatus B then (1) accommodates the sheet on the first sheet discharging tray 21 (the above-described "printout mode"), (2) sets the sheets from the body sheet discharging port 3 into a bunch and staples and houses the sheets on the first sheet discharging tray 21 (the above-described "stapling mode"), or (3) sets the sheets from the body sheet discharging port 3 into a bunch, folds the sheet bunch into a booklet, and houses the sheet bunch on a second sheet discharging tray 22 (the above-described "sheet bunch folding mode").

Thus, as shown in FIG. 2, the post-processing apparatus B has a casing 20 comprising the first sheet discharging tray 21 and the second sheet discharging tray 22, and the sheet carry-in path P1 having the carry-in port 23, connected to the body sheet discharging port 3. The sheet carry-in path P1 is composed of a linear path formed in the casing 20 so as to extend in a substantially horizontal direction. Thus, a first switchback conveying path SP1 and a second switchback conveying path SP2 branch off from the sheet carry-in path P1 so that sheets are transferred in a reverse direction along the first switchback conveying path SP1 and the second switchback conveying path SP2. The first switchback conveying path SP1 and the second switchback conveying path SP2 branch off from the sheet carry-in path P1 so that the first switchback conveying path SP1 is located downstream, whereas the second switchback conveying path SP2 is located upstream. The two conveying paths are located away from and opposite each other.

Figure 21:
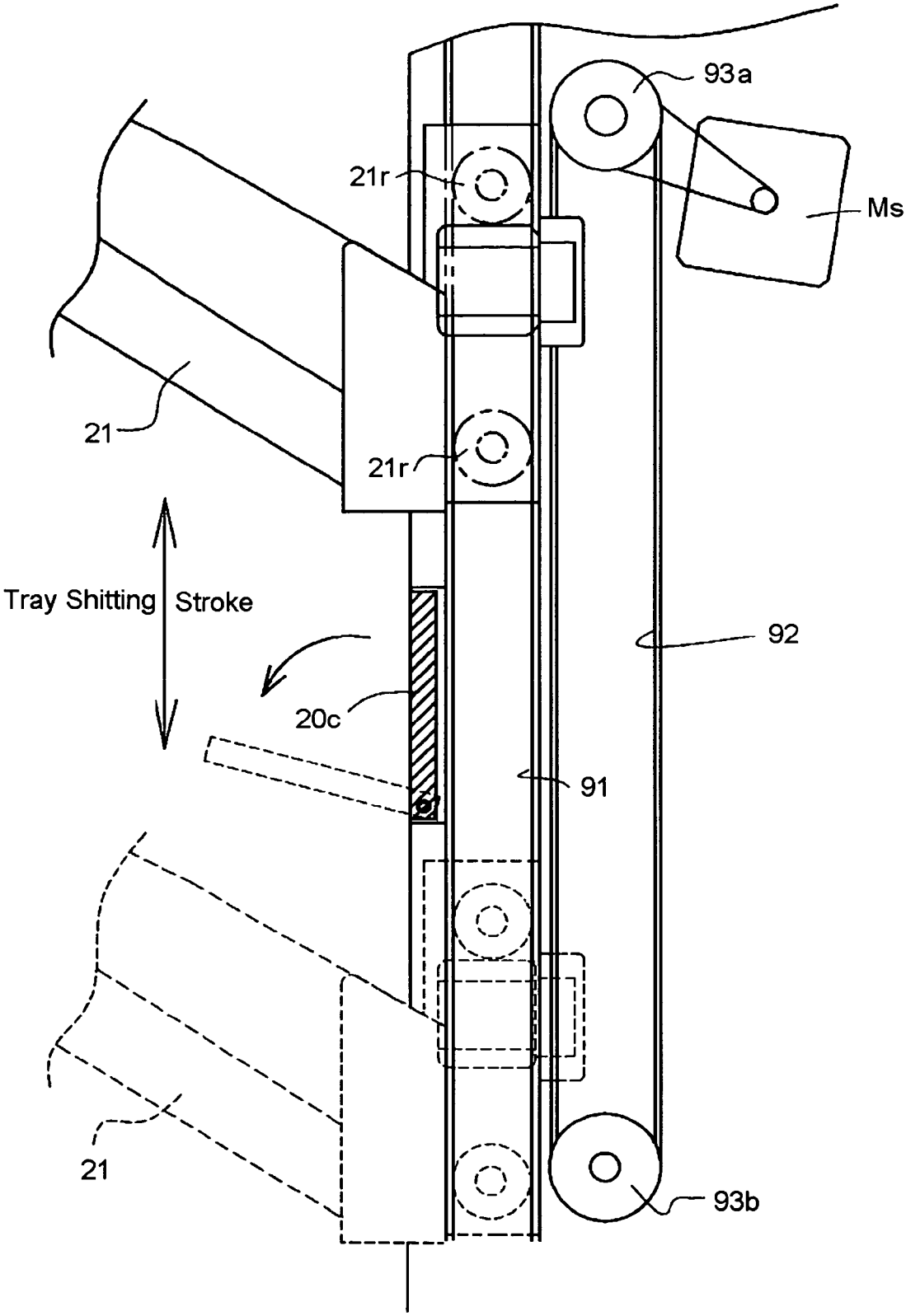
FIG. 21 is an enlarged diagram of an essential part of the apparatus in FIG. 2, showing elevating and lowering means for elevating and lowering a first stack tray and an opening and closing cover.

Further, as shown in FIG. 2, the outer cover (casing) 20 has an opening and closing cover 20*c* shown in FIG. 21 and forming an opening for maintenance of saddle stitching staple means 40 described below. The end surface staple means 33 is located on a first collecting section 29, and the saddle stitching staple means 40 is located on the collecting guide 35. In the staple means, the end surface staple means 33 is located above and the saddle stitching staple means 40 is located below so that the staple means 33 and 40 are positioned adjacent to each other in a vertical direction.

As described above, the opening and closing cover is located at the intermediate position between the first sheet discharging tray 21 and the second sheet discharging tray 22, which are arranged in the vertical direction, so that the saddle stitching staple means 40, stapling the sheet traveling to the lower second sheet discharging tray 22, can be maintained through the opening and closing cover. This allows the saddle stitching staple means 40 to be easily maintained through the opening and closing cover 20*c*. In this case, a work area is provided by removing the sheets loaded on the lower second sheet discharging tray 22. Thus, the relevant structure is simple and a maintenance operation can be easily performed.

Furthermore, the upper one of the two vertically arranged sheet discharging trays, the first sheet discharging tray 21, is configured to be able to elevate and lower in the vertical direction, and the opening and closing cover is located within an elevating and lowering trajectory of the first stack tray so that the saddle stitching staple means 40 for the sheet traveling to the second sheet discharging tray 22 can be maintained through the opening and closing tray. Thus, during the maintenance operation, the work area can be provided by moving the first stack tray above or below the opening and closing cover. The maintenance operation can then be safely and easily performed. This allows a small-sized, compact apparatus to be constructed.

The opening and closing cover 20*c* can be easily opened and closed by using a needle empty signal or an inappropriate operation signal from the saddle stitching staple means 40 to retract the first sheet discharging tray 21 above or below the opening and closing cover 20*c*.

In this path configuration, a carry-in roller 24 and a sheet discharging roller 25 are arranged on the sheet carry-in path P1. The rollers are coupled to a forward reversible drive motor M1 (not shown). The sheet carry-in path P1 has a path switching piece 27 located on the switchback conveying path SP2 to guide sheets and coupled to actuating means such as a solenoid. The sheet carry-in path P1 also has a post-processing unit 28 which is located between a carry-in roller 24(*a*) succeeding the carry-in port 23 and a carry-in roller 24(*b*) lying behind the post-processing unit 28 to execute post-processing by using a sheet sensor S1 to detect the trailing end of a sheet from the carry-in port 23; the post-processing unit 28 is, for example, stamp means for executing a stamping process using a detection signal from the sheet sensor S1 or a punch means for executing a punching process using the detection signal from the sheet sensor S1. The illustrated post-processing unit 28 is located at the carry-in port 23 upstream of the paired front and back carry-in rollers 24 (24*a* and 24*b*) so as to be able to be removed from and installed back in the casing 20 depending on the apparatus specifications.

The sheet carry-in path P1 has a sheet locking member (buffer guide) 26, located upstream of a branching path (at the position of the path switching piece 27) from the second switchback conveying path SP2, to temporarily hold the sheet traveling to the second switchback conveying path SP2, as shown in detail in FIG. 10 described below. The configuration and operation of the sheet locking member 26 will be described below.

The first switchback conveying path SP1, located downstream of the sheet carry-in path P1 (closer to a trailing end of the apparatus) as described above, is configured as follows. As shown in FIG. 3, the sheet carry-in path P1 has the sheet discharging roller 25 and a sheet discharging port 25*a* at an outlet end thereof, as well as the first collecting section 29 located below the sheet discharging port 25*a* via a step. The first collecting section 29 is composed of a tray (hereinafter referred to as the "collecting tray 29") on which sheets from the sheet discharging port 25*a* are loaded and supported. A forward reverse roller 30 is located above the collecting tray 29 so as to be able to elevate and lower between a position where the forward reverse roller 30 comes into contact with the sheets on the roller and a standby position (shown by a chain line in FIG. 3) where the forward reverse roller 30 is separated from the sheets. A forward reverse motor M2 is coupled to the forward reverse roller 30 and controlled so as to rotate clockwise in the figure when the sheet reaches the collecting tray 29 and to rotate counterclockwise after the trailing end of the sheet reaches the tray. Accordingly, the first switchback conveying path SP1 is constructed on the collecting tray 29. A caterpillar belt 31 is supported by shafts so as to be able to roll freely so that a one end pulley side of the caterpillar belt 31 is in pressure contact with the sheet discharging roller 25, while a leading end pulley side of the caterpillar belt 31, hanging from a pulley shaft 31*a*, reaches the collecting tray 29. A driven roller 30*b*, which engages the forward reverse roller 30, is provided on the collecting tray 29.

Further, the first sheet discharging tray 21 is located downstream of the switchback conveying path SP1 to support the leading end of sheets guided to the first switchback conveying path SP1 and the second switchback conveying path SP2.

With the above-described configuration, the sheet from the sheet discharging port 25*a* reaches the collecting tray 29 and is transferred toward the first sheet discharging tray 21 by the forward reverse roller 30. Once the trailing end of the sheet from the sheet discharging port 25*a* reaches the collecting tray 29, the forward reverse roller 30 is reversely rotated (counterclockwise in the figure) to transfer the sheet on the collecting tray 29 in a direction opposite to a sheet discharging direction. At this time, the caterpillar belt 31 cooperates with the forward reverse roller 30 in switching back and transferring the trailing end of the sheet along the collecting tray 29.

A trailing end regulating member 32 and the end surface staple means 33 is located at a trailing end of the collecting tray 29; the trailing end regulating member 32 regulates the position of the sheet trailing end. The illustrated staple means 33 is composed of an end surface stapler and staples the sheet bunch collected on the tray at one or more positions. The trailing end regulating member 32 is also used to provide a function of carrying out the stapled sheet bunch to the first sheet discharging tray 21, located downstream of the collecting tray 29. The trailing end regulating member 32 is configured to be able to reciprocate in the sheet discharging direction along the collecting tray 29. A carry-out mechanism of the illustrated trailing end regulating member 32 comprises a grip pawl 32*a* that grips the sheet bunch and a trailing end regulating surface 32*b* against which the sheet trailing end abuts for regulation. The carry-out mechanism is configured to be movable in the lateral direction of the figure along a guide rail provided on an apparatus frame. A driving arm 34*a* reciprocating the trailing end regulating member 32 and coupled to a sheet discharging motor M3 is provided.

The collecting tray 29 has a side aligning plate 34*b* with which the sheets collected on the tray align in the width direction. The side aligning plate 34*b* is composed of a lateral (the front to back of the device in FIG. 3) pair of aligning plates configured to approach and leave the sheet center. The side aligning plate 34*b* is coupled to an aligning motor (not shown).

In the "stapling mode", along the first switchback conveying path SP1 configured as described above, the sheets from the sheet discharging port 25*a* are set on the collecting tray 29. The sheet bunch is then stapled at one or more positions at the trailing edge thereof by the end surface staple means 33. In the "printout mode", a sheet from the sheet discharging port 25*a*, the sheet fed along the collecting tray 29 is passed between the forward reverse roller 30 and the driven roller 30*b* and carried out to the first sheet discharging tray 21. Thus, the illustrated apparatus is characterized in that the sheet to be stapled is bridged between the collecting tray 29 and the first sheet discharging tray 21 to allow the apparatus to be compactly configured.

Figure 4:
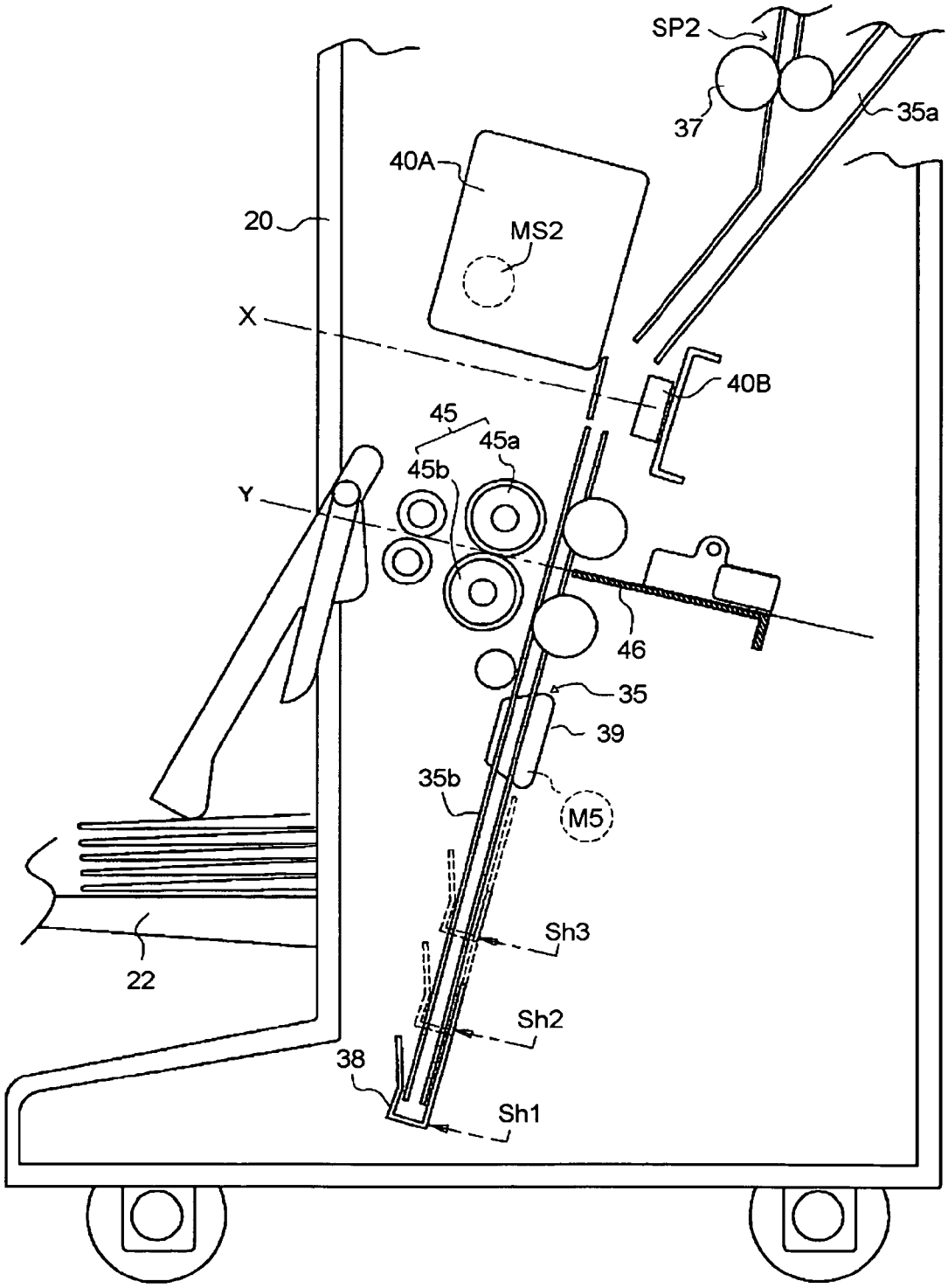
FIG. 4 is a detailed diagram illustrating the sheet folding device incorporated into the post-processing apparatus in FIG. 2.

Now, description will be given of the configuration of the second switchback conveying path SP2, branching off from the sheet carry-in path P1, as shown in FIGS. 3 and 4. As shown in FIGS. 3 and 4, the second switchback conveying path SP2 is located in a substantially vertical direction with respect to the apparatus casing 20. A conveying roller 36 is located at an inlet of the second switchback conveying path SP2. A conveying roller 37 is located at an outlet of the second switchback conveying path SP2. The second collecting section 35, which sets the sheets fed along the conveying path SP2, is provided downstream of the second switchback conveying path SP2. As shown in FIG. 4, the second collecting section 35 is composed of a conveying guide (collecting guide) that transfers the sheets (the second collecting section 35 is hereinafter referred to as the "collecting guide 35"). The saddle stitching staple means 40 (40*a* and 40*b*) and folding roll means 45 are arranged on the collecting guide 35. The configuration of these components will be sequentially described below.

As shown in FIG. 3, the conveying roller 36, located at the inlet of the second switchback conveying path SP2, is configured to be forward reversible. A sheet carried into the first switchback conveying path SP1, located downstream, is temporarily held (temporarily reside) on the second switchback conveying path SP2. The reason for the temporary holding is as follows. The preceding sheets are collected on the collecting tray 29 and are then stapled in response to the job end signal. The sheet fed to the sheet carry-in path P1 while the sheet bunch is being carried out to the first sheet discharging tray 21 is temporarily held on the second switchback conveying path SP2. Then, after the processing of the preceding sheets is finished, the standing-by sheet is conveyed from the first switchback conveying path SP1 onto the collecting tray 29. The effects of this operation will be described below.

As shown in FIG. 4, the collecting guide 35 is formed of a guide member that guides the sheet being conveyed. The collecting guide 35 is configured so that the sheets are loaded and housed thereon. The illustrated collecting guide 35 is connected to the second switchback conveying path SP2 and located in a central part of the apparatus casing 20 in the substantially vertical direction. This allows the apparatus to be compactly configured. The collecting guide 35 is shaped to have an appropriate size to house maximum sized sheets. In particular, the illustrated collecting guide 35 is curved or bent so as to project toward the area in which the saddle stitching staple means 40 and folding roll means 45, described below, are arranged.

A switchback approaching path 35*a* is connected to a conveying direction trailing end of the collecting guide 35; the switchback approaching path 35*a* overlaps the outlet end of the second switchback conveying path SP2. This is to allow the trailing end of the carried-in (succeeding) sheet fed from the conveying roller 37 on the second switchback conveying path SP2 to overlap the trailing end of the loaded (preceding) sheets supported on the collecting guide 35 to ensure the page order of the collected sheets. A leading end regulating member 38 regulating the sheet leading end is located downstream of the collecting guide 35. The leading end regulating member 38 is supported by a guide rail so as to be movable along the collecting guide 35. The leading end regulating member 38 is moved between positions Sh1 and Sh2 and Sh3, shown in the figure, by shift means MS (not show).

When the leading end regulating member 38 is placed at the illustrated position Sh3, the trailing end of the sheet (sheet bunch) supported on the collecting guide 35 enters the switchback approaching path 35*a*. In this condition, the succeeding sheet fed through the second switchback conveying path SP2 is reliably stacked on the collected sheets. When the leading end regulating member 38 is placed at the illustrated position Sh2, the center of the sheets (sheet bunch) supported on the collecting guide 35 is placed at a staple position X on the saddle stitching staple means 40, described below. Likewise, when the leading end regulating member 38 is placed at the illustrated position Sh1, the sheet bunch is stapled and the center of the sheet bunch supported on the collecting guide 35 is placed at a fold position Y on the folding roll means 45. Thus, the illustrated positions Sh1, Sh2, and Sh3 are set at the optimum positions depending on the sheet size (conveying-direction length).

A sheet side edge aligning member 39 is located on a downstream side of the collecting guide 35 in the sheet conveying direction. The sheet side edge aligning member 39 aligns, with a reference, the width-direction position of the sheets carried into the collecting guide 35 and supported on the leading end regulated member 38. That is, with the leading end regulating member 38 placed at the position Sh3 and the whole sheets supported on the collecting guide 35, side edges of the sheets are aligned with the sheet side edge aligning member 39. Since the illustrated apparatus aligns the sheets using the sheet center as a reference, the sheet side edge aligning member 39 is composed of a lateral pair of aligning plates, the aligning plates are arranged at an equal distance from the sheet center as a reference to align the sheet bunch supported on the collecting guide 35. Thus, an aligning motor M5 is coupled to the sheet side edge aligning member 39.

The staple position X and the fold position Y are set on an upstream side and a downstream side, respectively, along the collecting guide 35. The saddle stitching staple means 40 is located at the staple position X. The saddle stitching staple means 40 is composed of a driver unit 40A and an anvil unit 40B which are separately arranged opposite to each other and across the collecting guide 35. A needle cartridge is installed on the driver unit 40A and contains needles coupled together like a band. A driver member moves upward and downward between a top dead center and a bottom dead center to allow a former member to fold the needle at the leading end into a U shape. The needle is then stuck into the sheet bunch. The driver unit 40A thus comprises a drive motor MS2, a driving arm that moves the driver member upward and downward, and a driving cam that drives the arm.

A folding groove is formed in the anvil unit 40B such that the tip of the staple needle stuck into the sheet bunch is folded in the folding groove. In the saddle stitching staple means 40 configured as described above, the driver unit 40A and the anvil unit 40B are separately arranged opposite to each other so that the sheet bunch can pass between the units 40A and 40B. This enables the sheet bunch to be stapled at the center or any other desired position.

Figure 6A:
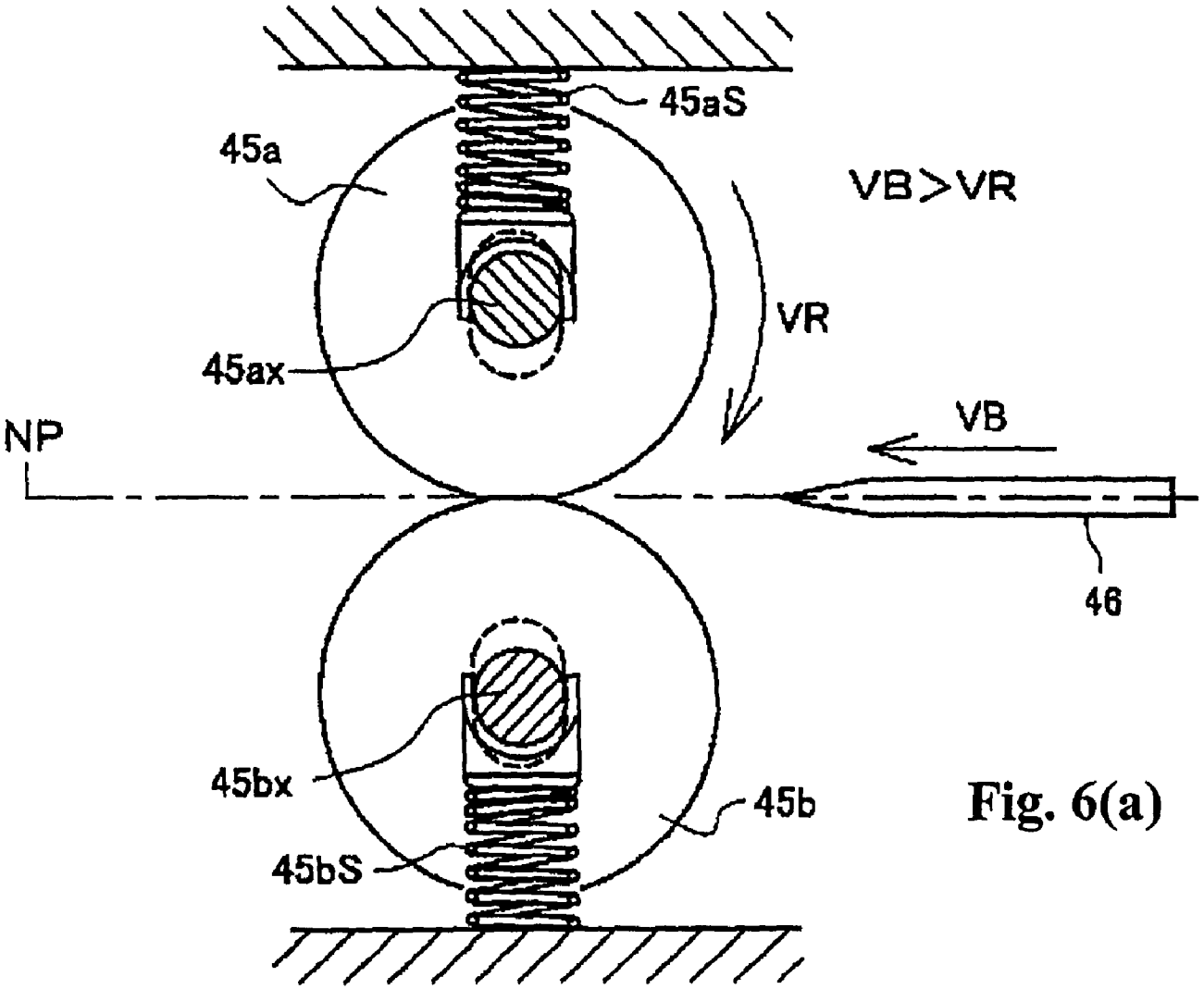
FIG. 6(*a*) is a diagram illustrating the sectional structure of folding roll means in FIG. 4.
Figure 6B:
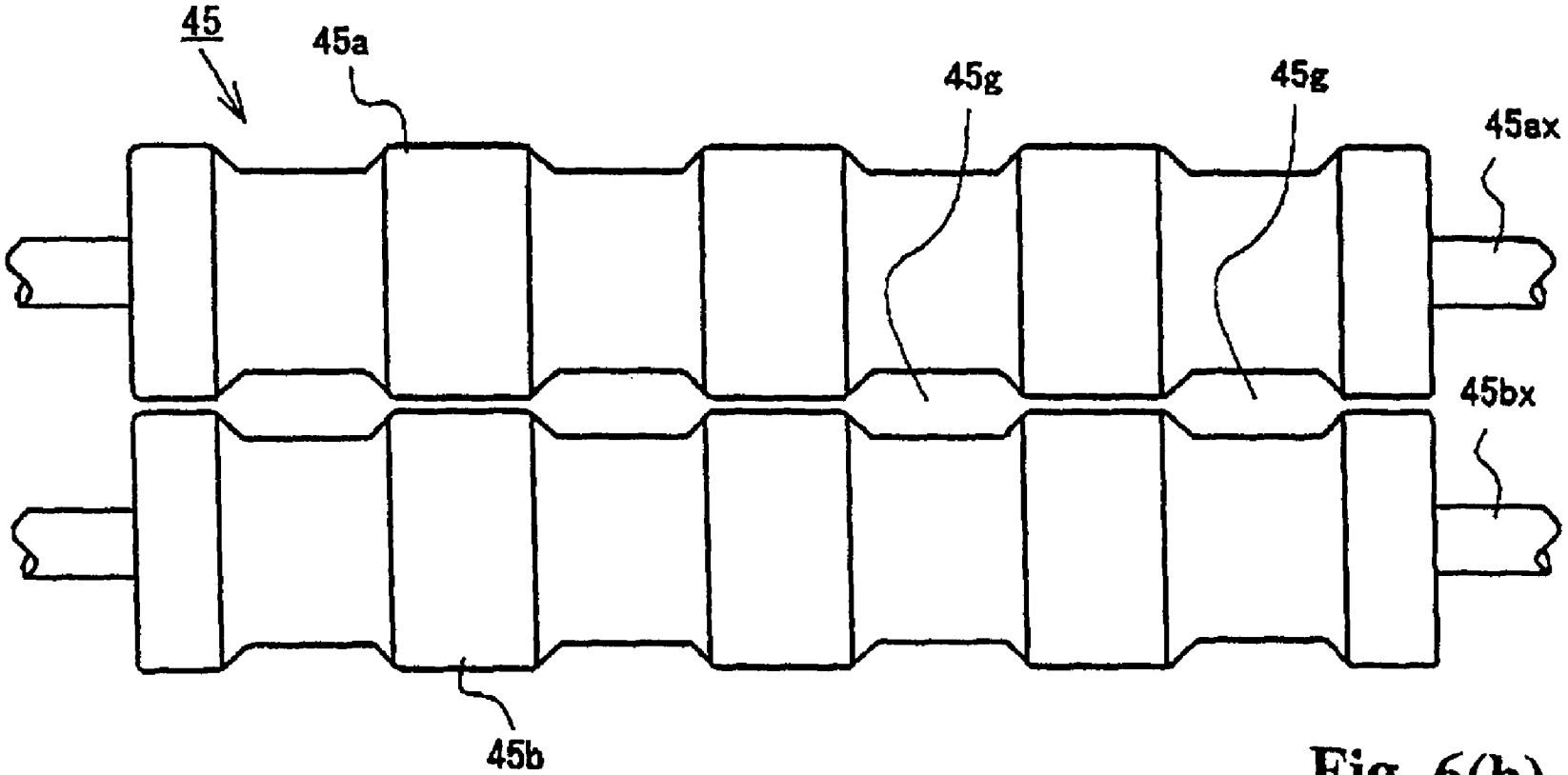

The folding roll means 45 and a folding blade 46 are provided at the fold position X, located on the downstream side of the staple means 40; the folding roll means folds the sheet bunch and the folding blade 46 inserts the sheet bunch into a nip position NP on the folding roll means 45. As shown in FIGS. 6(*a*) and 6(*b*), the folding roll means 45 is composed of rolls 45*a* and 45*b* that are in pressure contact with each other and each of which is formed to have a width substantially equal to that of the maximum sized sheet. The paired rolls 45*a* and 45*b* have respective rotating shafts 45*ax* and 45*bx* fitted in long grooves in the apparatus frame so as to be in pressure contact with each other. The rolls 45*a* and 45*b* are biased in a pressure contact direction by compression springs 45*a*S and 45*b*S, respectively. Alternatively, the rolls may be supported via shafts so that at least one of the rolls 45*a* or 45*b* is movable in the pressure contact direction, with a bias spring engaged with this roll.

The pair of rolls 45*a* and 45*b* is preferably formed of a material such as rubber, which has a relatively large coefficient of friction, to fold the sheet being transferred in a rotating direction. The rolls 45*a* and 45*b* may be formed by lining a rubber like material. The folding roll means 45 is shaped to have recesses and protrusions and thus gaps 45*g* in the sheet width direction as shown in FIG. 6(*b*). The gaps 45*g* are arranged so as to coincide with recesses and protrusions on the folding blade 46, described below. A leading end of the folding blade thus advances easily between roll nips. The gaps 45*g* are also arranged at width-wise positions corresponding to staple positions at which the sheet bunch is stapled. That is, the pair of rolls 45*a* and 45*b*, which are in pressure contact with each other, is shaped to have the recesses and protrusions and thus the gaps 45*g* in the sheet width direction. The gaps coincide with the sheet staple positions and knife edges of the folding blade 46, which is similarly shaped to have recesses and protrusions, enter the gaps.

Figure 7A:
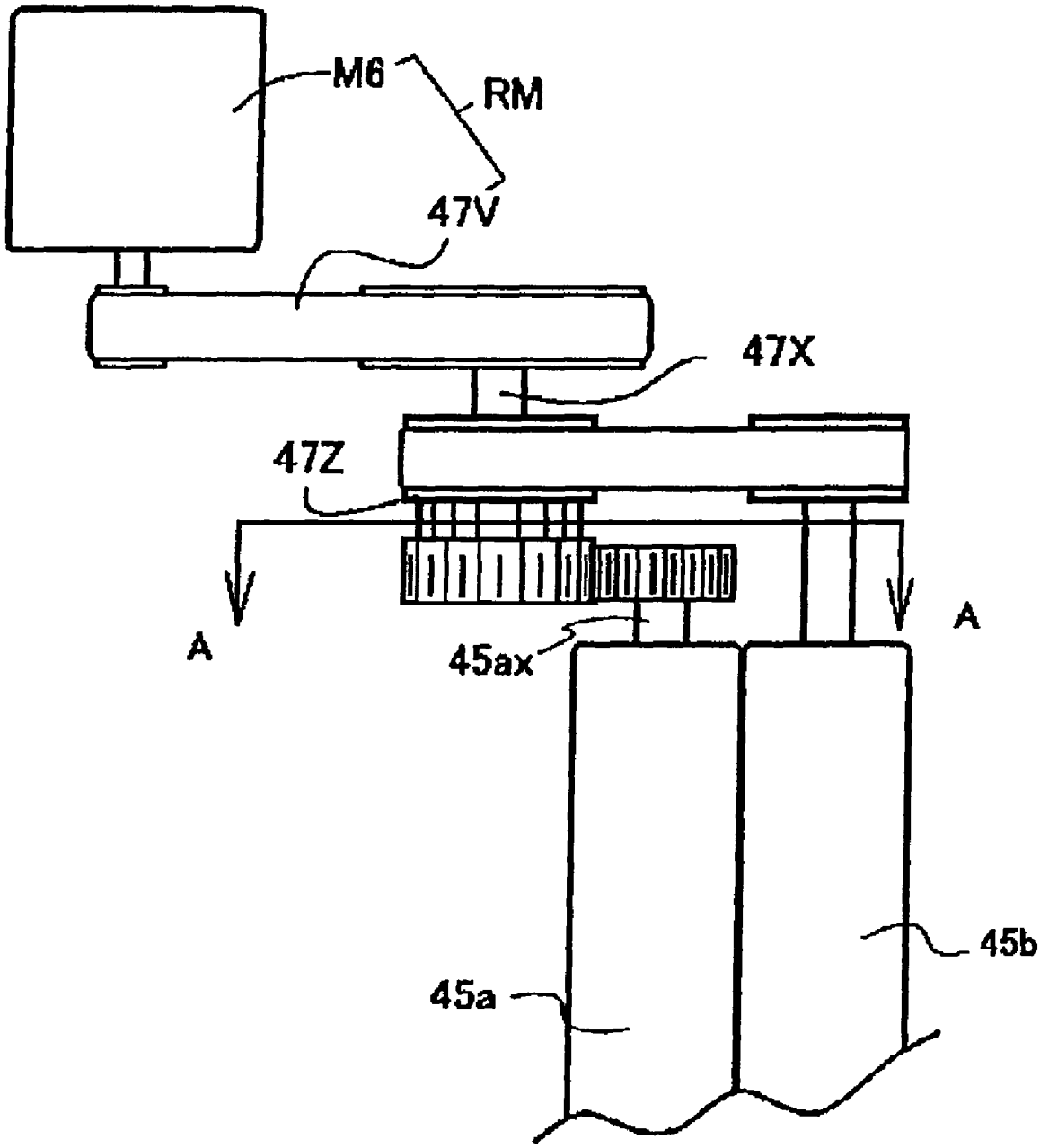
FIG. 7(*a*) is a diagram illustrating a driving mechanism for the folding roll means in FIG. 4.
Figure 7B:
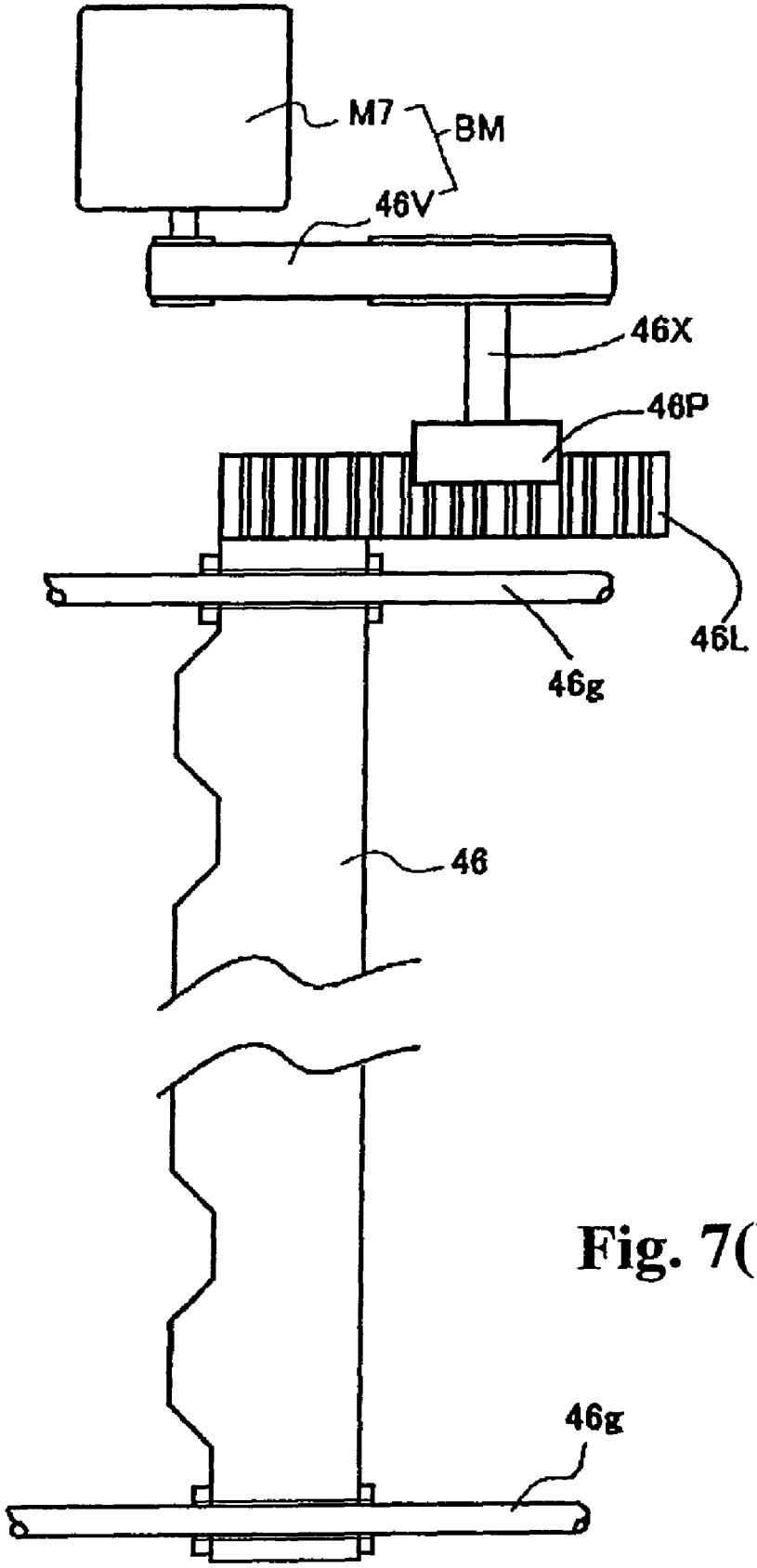
Figure 7C:
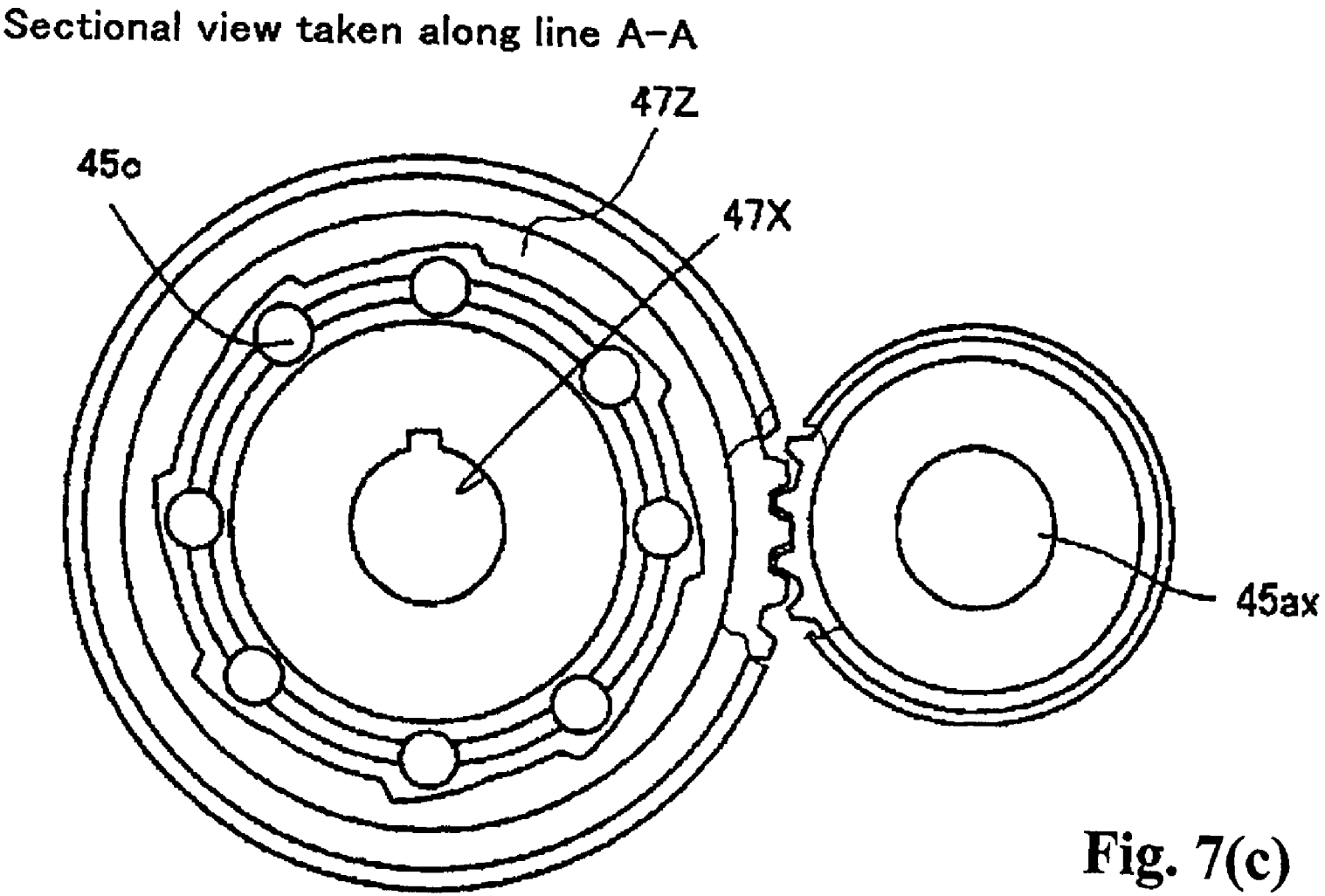
Figure 8A:
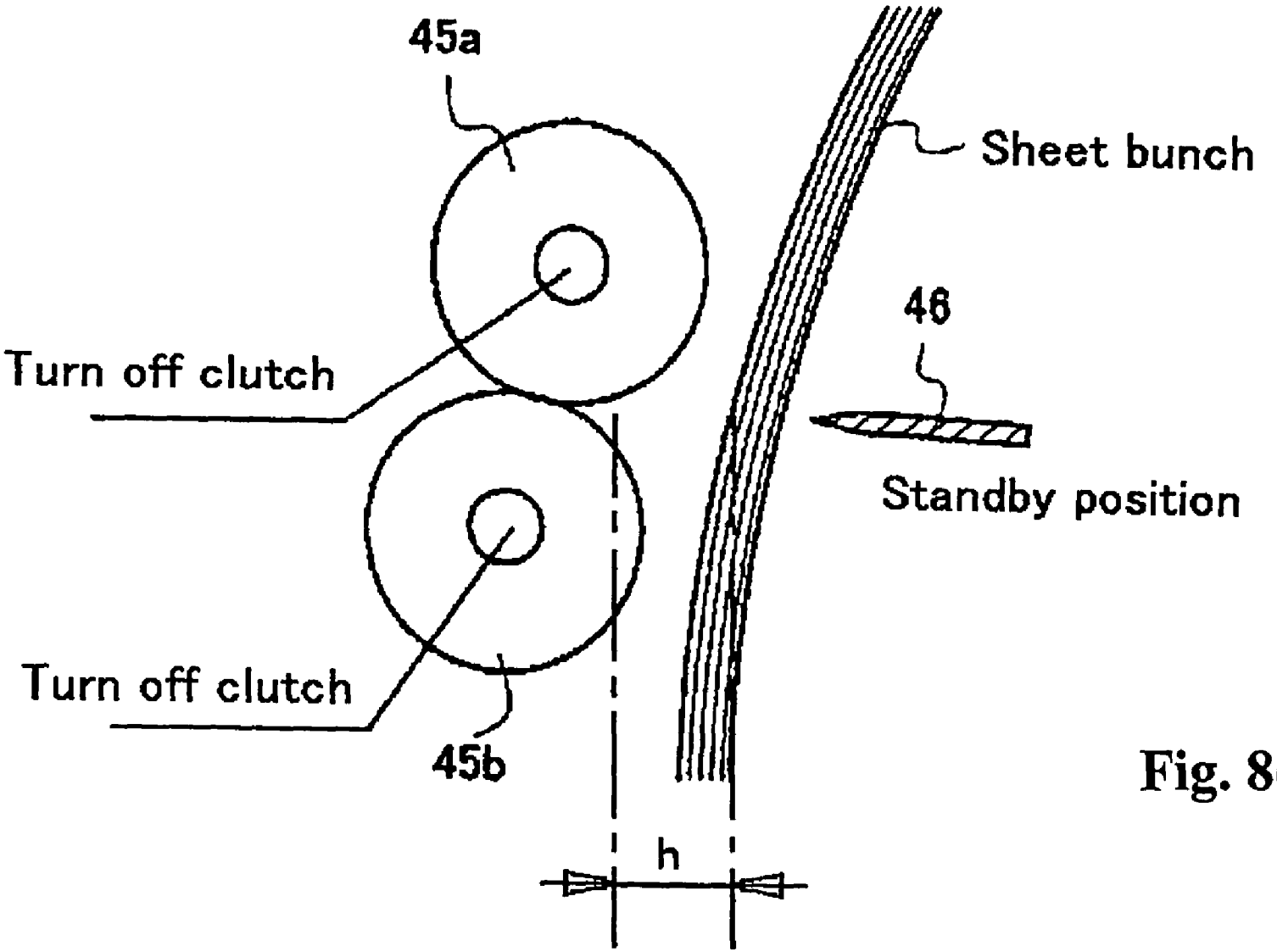
FIG. 8(*a*) is a state diagram showing a sheet bunch placed and set at a fold position during a sheet bunch folding operation performed by the apparatus in FIG. 2.
Figure 8B:
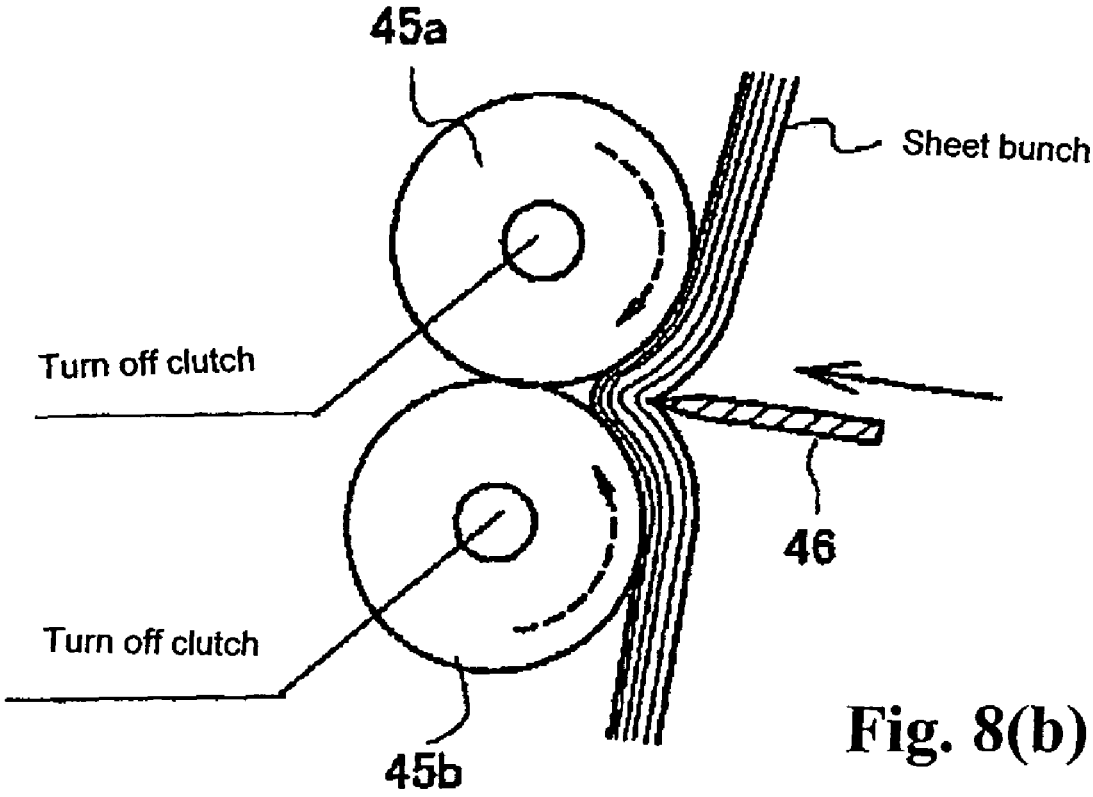
Figure 8C:
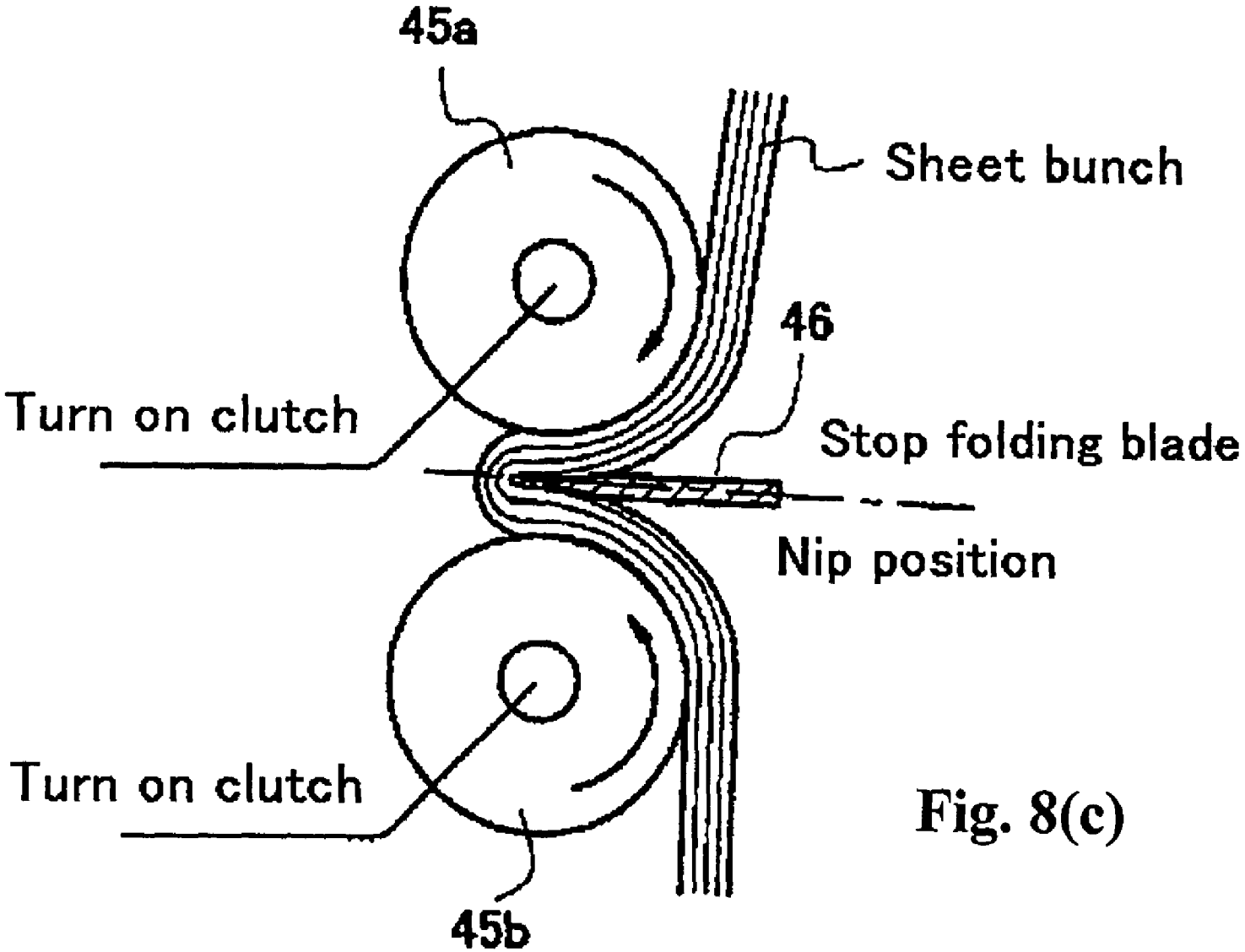
Figure 8D:
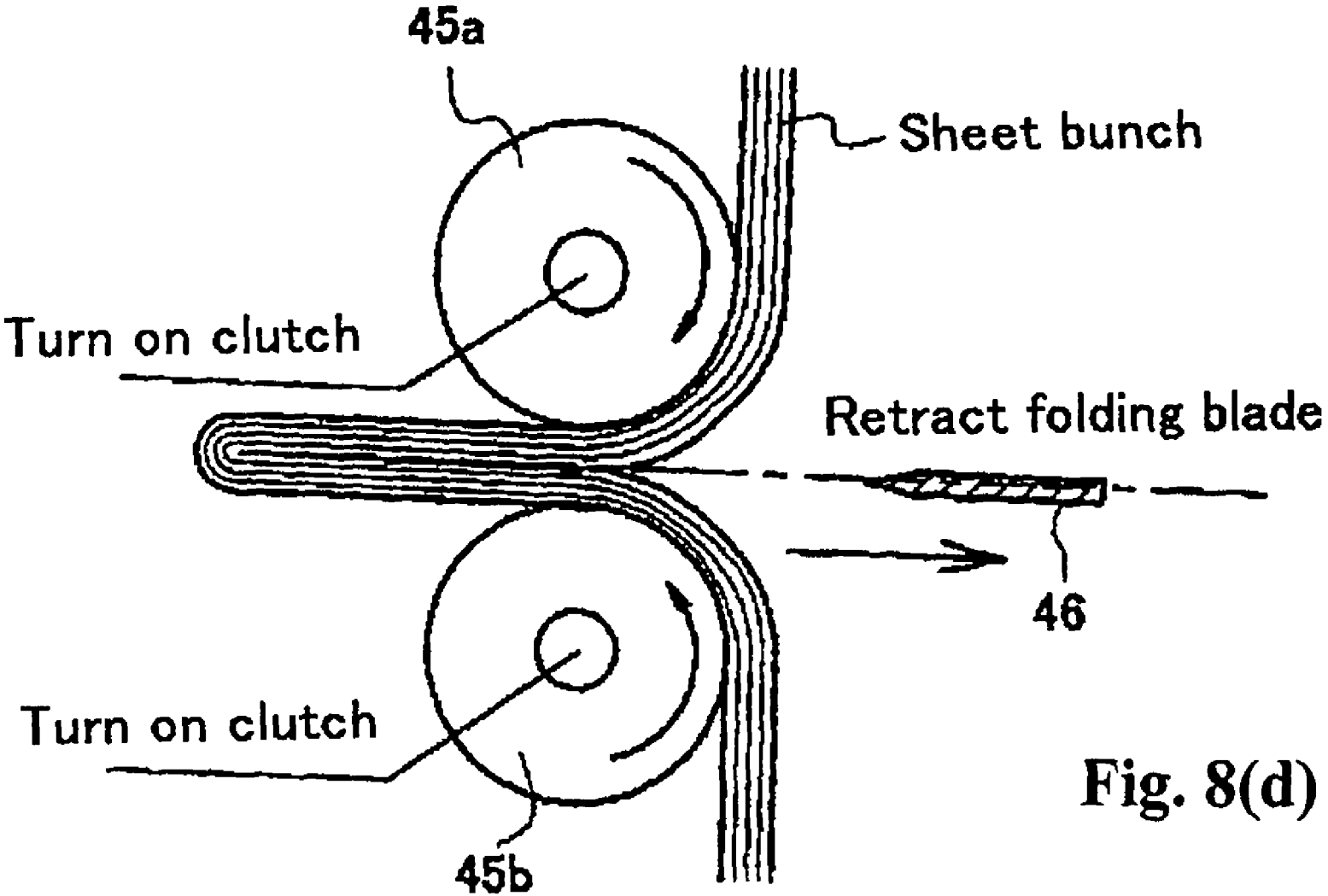

Each of the rolls 45*a* and 45*b* is coupled to the roll driving means RM. The illustrated roll driving means RM is composed of a roll drive motor M6 and a transmission mechanism (transmission means) 47V as shown in FIGS. 7(*a*) and 7(*c*). The illustrated transmission means 47V is composed of a transmission belt which reduces the rotation of the roll drive motor M6 so that the reduced rotation is transmitted to a transmission shaft 47X. A clutch means 45*c* is located between the transmission shaft 47X and the rotating shaft 45*ax* of the roll 45*a*. Similarly, clutch means 45*c* is located between the transmission shaft 47X and the rotating shaft 45*bx* of the roll 45*b*. The clutch means 45*c* is composed of an electromagnetic clutch, a one-way clutch (one-way clutch), a sliding friction clutch (spring clutch), or the like to make it possible to turn on and off the transmission of the driving rotation of the roll drive motor M6 to the roll 45*a* and the roll 45*b*.

The illustrated clutch means 45*c* is composed of a one-way clutch and located between the transmission shaft 47X and a transmission collar 47Z so as to transmit the rotation of the transmission shaft 47X to the transmission collar 47Z in only one direction. The roll 45*a* is coupled to the transmission collar 47Z via a gear, and the roll 45*b* is coupled to the transmission collar 47Z via a belt. The motor rotation in only one direction is transmitted to the rolls 45*a* and 45*b*, thus coupled to the roll drive motor M6 via the clutch means 45*c*. The rolls are configured so as to be freely rotatable in a sheet delivery direction.

The rolls 45*a* and 45*b* are positioned in the area to which the collecting guide 35 is curved or bent to project. Further, the rolls 45*a* and 45*b* are located at a distance h from the sheet bunch supported on the collecting guide 35 as shown in FIG. 8(*a*). That is, the rolls 45*a* and 45*b* are located at the distance h from the sheets (bunch) supported on the collecting guide 35 so as to prevent the roll surface from coming into contact with the sheets (bunch). The folding blade 46 with the knife edge is provided opposite the rolls 45*a* and 45*b* across the sheet bunch. The folding blade 46 is supported by the apparatus frame so as to be able to reciprocate between a standby position in FIG. 8(*a*) and a nip position in FIG. 8(*c*). A blade driving means BM (FIG. 7(*b*)) is coupled to the folding blade 46. The folding blade 46 is reciprocated, by a drive motor M7, between the standby position, where the folding blade is retracted from the sheet bunch supported on the collecting guide 35, and the nip position where the rolls of the folding roll means 45 are in pressure contact with each other. The folding blade 46 is formed of a material such as metal which has a relatively small coefficient of friction, and is shaped like a plate. The leading end of the folding blade 46 is shaped like a recessed and protruding surface as shown in FIG. 7(*b*). The blade leading end is shaped to enter the gaps 45*g* in the rolls 45*a* and 45*b* as described above.

In the illustrated apparatus, the relationship between the coefficient of friction ν1 between the rolls 45*a* and 45*b* and the sheets, the coefficient of friction ν2 between the sheets, and the coefficient of friction ν3 between the sheets and the folding blade 46 is set to be ν1>ν2>ν3. Consequently, when the sheet bunch shown in FIG. 8(*c*) is inserted between the rolls 45*a* and 45*b* by the folding blade 46, the pressure contact force acting on both rolls 45*a* and 45*b* also acts on the folding roll means 45, the sheet bunch, and the folding blade 46. In this case, since the coefficients of friction are set to have the above-described relationship, the sheet bunch is smoothly fed in the delivery direction (leftward in the figure).

Now, the configuration of the blade driving means BM of the folding blade 46 will be described. As shown in FIG. 7(*b*), the folding blade 46 is supported on the apparatus frame so as to be movable along the guide rail 46*g* in a sheet folding direction. The folding blade 46 is supported so as to be able to reciprocate between the standby position, where the folding blade 46 is retracted from the sheets supported on the collecting guide 35, and the nip position on the folding roll means 45. The blade driving means BM, which reciprocates the folding blade 46, includes a blade drive motor M7 and transmission means 46V for transmitting the rotation of the blade drive motor M7, in the figure, a transmission belt, to transmit the rotation to a transmission rotating shaft 46X. A transmission pinion 46P is provided on the transmission rotating shaft 46X and meshes with a rack gear 46L integrally mounted on the folding blade 46. Thus, rotating the blade drive motor M7 forward or backward reciprocates the folding blade 46 between the standby position and the nip position along the guide rail 46*g*. The folding blade 46 is composed of a plate-like member having the knife edge in the sheet width direction. The leading end of the folding blade 46 is shaped so as to have recesses and protrusions as shown in the figure.

Now, with reference to FIGS. 8(*a*) to 8(*d*), description will be given of how the folding roll means 45 and folding blade 46 are configured as described above to fold the sheets. First, the sheet bunch supported on the collecting guide 35 is locked by the leading end regulating member 38, shown in FIG. 4, as shown in FIG. 8(*a*). The sheet bunch stapled at a fold position is positioned at the fold position Y. Upon receiving a set end signal, driving control means (a sheet folding operation control section 64*d* shown in FIG. 9, also applies to the description below) turns off the clutch means 45*c*, shown in FIG. 7(*c*). In the illustrated on-way clutch configuration, the roll drive motor M6 is stopped or rotated at a speed lower than the moving speed of the folding blade 46. This is to allow the folding rolls 45*a* and 45*b* to be rotated in conjunction with the sheet bunch inserted into the nip position by the folding blade 46 as described below.

The driving control means 64*d*, shown in FIG. 9, thus moves the folding blade 46 from the standby position to the nip position at a predetermined speed. For this moving speed VB, the rotating peripheral speed VR of the folding roll means 45 is set at zero or so that VB>VR. Thus, the sheet bunch is bent at the fold position and inserted between the rolls by the folding blade 46 as shown in FIG. 8(*b*). At this time, the rolls 45*a* and 45*b* are rotated in conjunction with the sheets moved by the folding blade 46. The driving control means 64*d* stops the blade drive motor M7 to cause the folding blade 46 to rest at the position shown in FIG. 8(*c*) until the sheet bunch is expected to reach the predetermined nip position. Simultaneously, the driving control means 64*d* turns on the clutch means 45*c* to drivingly rotate the folding rolls 45*a* and 45*b*. Thereafter, the sheet bunch is fed in the delivery direction (leftward in the figure). Subsequently, in parallel with the delivery of the sheet bunch by the folding roll means 45, the driving control means 64*d* moves and returns the folding blade 46 lying at the nip position, to the standby position as shown in FIG. 8(*d*).

When the thus folded sheet bunch is caught between the rolls 45*a* and 45*b*, the sheet contacting the roll surface is prevented from being drawn in between the rotating rolls 45*a* and 45*b*. That is, the folding roll means 45 rotates in conjunction with the inserted (pushed-in) sheets, preventing only the sheet contacting the rolls from being caught in between the rolls before the remaining sheets are caught. Furthermore, the folding roll means 45 rotates in conjunction with the inserted sheets, preventing the roll surface from rubbing against the sheet contacting the roll surface thereby preventing image rubbing.

A control arrangement for the image forming system described above will be described with reference to the block diagram in FIG. 9. The image forming system shown in FIG. 1 comprises a control section (hereinafter referred to as a "body control section) 50 of the image forming apparatus A, and a control section (hereinafter referred to as a "post-processing control section") 60 of the post-processing apparatus B. The body control section 50 comprises an image forming control section 51, a sheet feeding control section 52, and an input section 53. The "image forming mode" or the "post-processing mode" is set via a control panel 18 provided in the input section 53. As described above, the following image forming conditions are set for the image forming mode: print-out copy count, sheet size, color or black-and-white printing, enlarged or reduced printing, and double- or single-side printing. The body control section 50 controls the image forming control section and the sheet feeding control section in accordance with the set image forming conditions so that images are formed on predetermined sheets, which are then sequentially carried out through the body sheet discharging port 3.

Simultaneously with the settings for the image forming mode, the post-processing mode is set by input via the control panel 18. The post-processing mode is set to, for example, the "printout mode", a "stapling finish mode", or a "sheet bunch folding finish mode". The body control section 50 transfers information on a post-processing finish mode, a sheet count, and a document copy count, and stapling mode information (whether the sheets are to be stapled at one position or a plurality of positions) to a post-processing control section 60. Every time image formation is finished, the body control section transfers the job end signal to the post-processing control section 60.

The post-processing control section 60 comprises a control CPU 61 that operates the post-processing apparatus B in accordance with the specified finish mode, a ROM 62 in which operation programs are stored, and a RAM 63 in which control data is stored. The control CPU 61 comprises a sheet conveyance control section 64*a* that allows the sheet fed to the carry-in port 23 to be conveyed, a sheet collecting operation control section 64*b* that performs a sheet collecting operation, a sheet stapling operation control section 64*c* that executes a sheet stapling process, and a sheet folding operation control section 64*d* that performs a sheet bunch folding operation.

The sheet conveyance control section 64*a* is coupled to a control circuit for the drive motor M1 for the conveying roller 24 and sheet discharging roller 25 on the sheet carry-in path P1. The sheet conveyance control section 64*a* is configured to receive a sensing signal from the sheet sensor S1, located on the path P1. The sheet collecting operation control section 64*b* is connected to a driving circuit for the forward reverse motor M2 for forward reverse roller 30, which allows the sheets to be collected on the first collecting section (collecting tray), and for the sheet discharging motor M3 for the trailing end regulating member. Moreover, the sheet stapling operation control section 64*c* is connected to a driving circuit for drive motors MS1 and MS2 built in the end surface stapling means 33 of the first collecting section 29 and in the saddle stitching staple means 40 of the second collecting section (collecting guide) 35, respectively.

The sheet folding operation control section 64*d* is connected to a driving circuit for the roll drive motor R6, which drivingly rotates the rolls 45*a* and 45*b*, and to a driving circuit for the clutch means 45*c*. The control section 64*d* is connected to a control circuit for the shift means MS for controllably moving the conveying rollers 36 and 37 on the second switchback conveying path SP2 and the leading end regulating means 38 of the collecting guide 35. The control section 64*d* thus receives sensing signals from sheet sensors arranged on the paths. The control section 64*d* is further connected to a driving circuit for the blade drive motor M7, which operates the folding blade 46.

The control section 64*d* configured as described above allows the post-processing apparatus to perform the following process operations.

Further, in the printout mode, the image forming apparatus A forms images on a series of documents starting with, for example, the first page. The image forming apparatus A sequentially carries out the sheets through the body sheet discharging port 3 in a face down posture. The post-processing apparatus B retracts the buffer guide 26 of the sheet carry-in path P1 upward in FIG. 3 to move the path switching piece 27 as shown by a solid line in FIG. 3. The sheet fed to the sheet carry-in path P1 is thus guided to the sheet discharging roller 25. The sheet leading end is then detected at the sheet discharging port 25*a*, and the corresponding signal is issued. At the time when the sheet leading end is expected, on the basis of the signal, to reach the forward reverse roller 30 on the collecting tray 29, the sheet conveyance control section 64*a* lowers the forward reverse roller 30 from the upper standby position onto the tray. The sheet conveyance control section 64*a* further rotates the forward reverse roller 30 clockwise in FIG. 4. Then, the sheet having reached the collecting tray 29 is carried out by the forward reverse roller 30 and housed on the first sheet discharging port 21. The succeeding sheets are thus sequentially carried out and collected and housed on the tray.

Thus, in the printout mode, the sheets with images formed thereon by the image forming apparatus are accommodated on the first sheet discharging tray 21 via the sheet carry-in path P1 in the post-processing apparatus B. For example, the sheets are sequentially laid on top of one another in a face down posture starting with the first page and ending with the nth page. In this mode, the sheets are not guided to the first switchback conveying path SP1 or the second switchback conveying path SP2, shown in FIG. 5.

In the stapling finish mode, as shown in FIG. 5, the image forming apparatus A sequentially forms images on a series of documents starting with the first page and ending with the nth page and carries out the resultant sheets through the sheet discharging port 3 in a face down posture, as in the case of the printout mode. The post-processing apparatus B retracts the buffer guide 26 of the sheet carry-in path P1 upward in FIG. 3 to move the path switching piece 27 as shown by the solid line in FIG. 3, as in the case of the printout mode. A sheet fed to the sheet carry-in path P1 is thus guided to the sheet discharging roller 25. The sheet leading end is then detected at the sheet discharging port 25*a*, and the corresponding signal is issued. At the time when the sheet leading end is expected, on the basis of the signal, to reach the forward reverse roller 30 on the collecting tray 29, the sheet conveyance control section 64*a* lowers the forward reverse roller 30 from the upper standby position onto the tray. The sheet conveyance control section 64*a* then rotates the forward reverse roller 30 clockwise in FIG. 3. Then, after the time when the sheet trailing end is expected to reach the collecting tray 29, the sheet conveyance control section 64*a* rotationally drives the forward reverse roller 30 counterclockwise in FIG. 3. The sheet having passed through the sheet discharging port 25*a* is switched back and conveyed along the first switch back conveying path SP1 onto the collecting tray 29. This sheet conveyance is repeated to collect the series of sheets on the collecting tray 29 into a bunch in a face down state.

Further, every time a sheet is accumulated on the collecting tray 29, the control CPU 61 operates the side aligning plate 34*b* to align the sheet with the side aligning plate 34*b* in the width direction. Then, in response to the job end signal from the image forming apparatus A, the control CPU 61 operates the end surface staple means 33 to staple the sheet bunch collected on the tray 29, at the trailing edge thereof. After the stapling operation, the control CPU 61 moves the trailing end regulating means 32, also serving as bunch carry-out means, from the position shown by the solid line in FIG. 3 to the position shown by a chain line in FIG. 3. The stapled sheet bunch is then carried out and housed on the first sheet discharging tray 21. The series of sheets with images formed thereon by the image forming apparatus A are stapled and housed on the first sheet discharging tray 21.

To continuously execute the stapling finish process, the control CPU 61 temporarily holds the succeeding sheet on the second switchback conveying path SP2. This sheet buffering operation will be described with reference to FIG. 10. As previously described, the conveying roller 36 is located at the carry-in port of the second switchback conveying path SP2 and is configured so as to be forward reversible. The control CPU 61, shown in FIG. 9, collects the sheets from the first switchback conveying path SP1 on the collecting tray 29. After the image forming job is finished, the control CPU 61 allows the end surface staple means 33 to execute the stapling process on the sheet bunch collected on the collecting tray. After the stapling process, the control CPU 61 moves the trailing end regulating member 32 to carry out the sheet bunch on the collecting tray 29 to the first sheet discharging tray 21.

Further, if the succeeding sheet is carried in by the image forming apparatus A while the stapling operation and/or the sheet bunch carry-out operation is being performed on the sheet bunch on the collecting tray 29, the CPU 61 uses the sheet sensor S1 to sense the succeeding sheet. At the time when the sheet trailing end is expected to pass through the path switching piece 27 on the sheet carry-in path P1, the control CPU 61 stops the sheet discharging roller 25. At the same time, the control CPU 61 moves the path switching piece 27 to the position shown in FIG. 10. The control CPU 61 subsequently reversely rotates the sheet discharging roller 25. The sheet on the sheet carry-in path P1 is then guided to the second switchback conveying path SP2, where the sheet is nipped by the conveying roller 36. At the time when the sheet trailing end is expected to reach the conveying roller 36, the control CPU 61 stops the conveying roller 36. The sheet on the sheet carry-in path P1 is then stopped and retained on the second switchback conveying path SP2.

Figure 10:
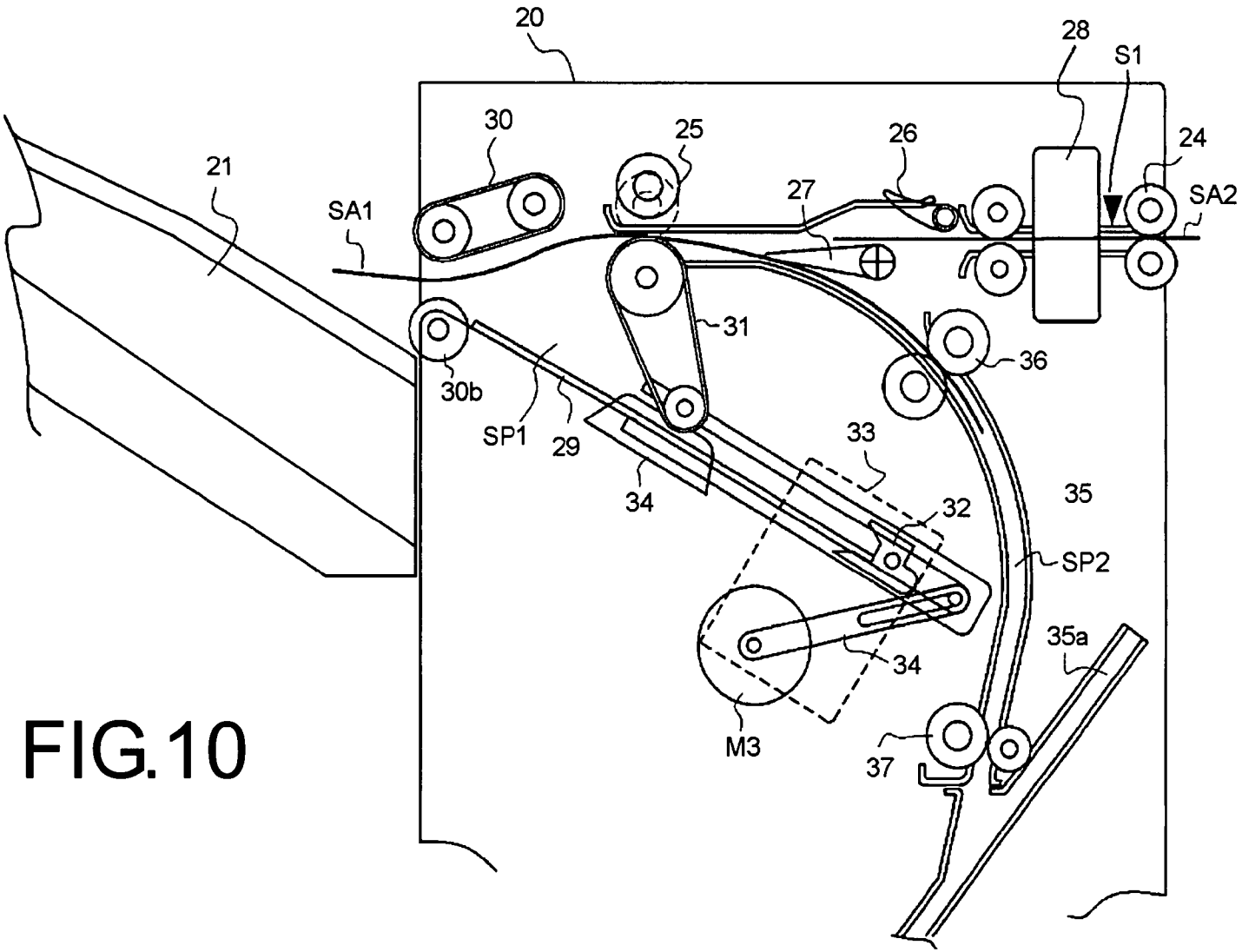
FIG. 10 is a diagram illustrating a situation in which a sheet traveling to a collecting tray is temporarily held on a second switchback carry-in path.

While the sheet bunch on the collecting tray 29 is discharged to the first sheet discharging tray 21, the control CPU 61 rotates the conveying roller 36 clockwise as shown in FIG. 10. Simultaneously, the control CPU 61 rotationally drives the sheet discharging roller 21 in the sheet discharging direction. Then, the sheet held on the second switchback conveying path SP2 is guided to the first switchback conveying path SP1 and connected on the collecting tray 29. The control CPU 61 guides the sheet SA2 succeeding the standby sheet SA from the carry-in port 23 to the sheet discharging roller 25 and stacks the sheet SA2 on the collecting tray 29 as described above. In this case, as shown in FIG. 10, the sheet discharging roller 25 is composed of a pair of rollers that can freely come into pressure contact with each other and leave each other. To lay the succeeding sheet from the carry-in port 23 on top of the sheet standing by on the sheet discharging roller 25, the sheet discharging rollers 25 are preferably separated from each other by actuating means such an electromagnetic solenoid. This operation allows the post-processing apparatus B to continuously execute the stapling process without the need to stop the image forming apparatus.

The embodiment of the present invention is thus characterized as described below. The substantially linear sheet carry-in path P1 has the first switchback conveying path SP1 on the downstream side and the second switchback conveying path SP2 on the upstream side. The first processing section (the above-described collecting tray) 29 is located on the first switchback conveying path SP1, and the second processing section (the above-described collecting guide) 35 is located on the second switchback conveying path SP2. Thus, the succeeding sheet fed to the sheet carry-in path P1 while the post-processing operation such as stapling is being performed by the downstream first processing section 29 is temporarily held on the upstream second switchback conveying path SP2. After the processing operation of the first processing section 29 is finished, the succeeding sheet held on the second switchback conveying path SP2 is transferred to the first switchback conveying path SP1. The succeeding sheet fed to the sheet carry-in path P1 while the second processing section 35 of the second switchback conveying path SP2 is performing the post-processing operation is temporarily held on the sheet carry-in path P1.

Figure 12A:
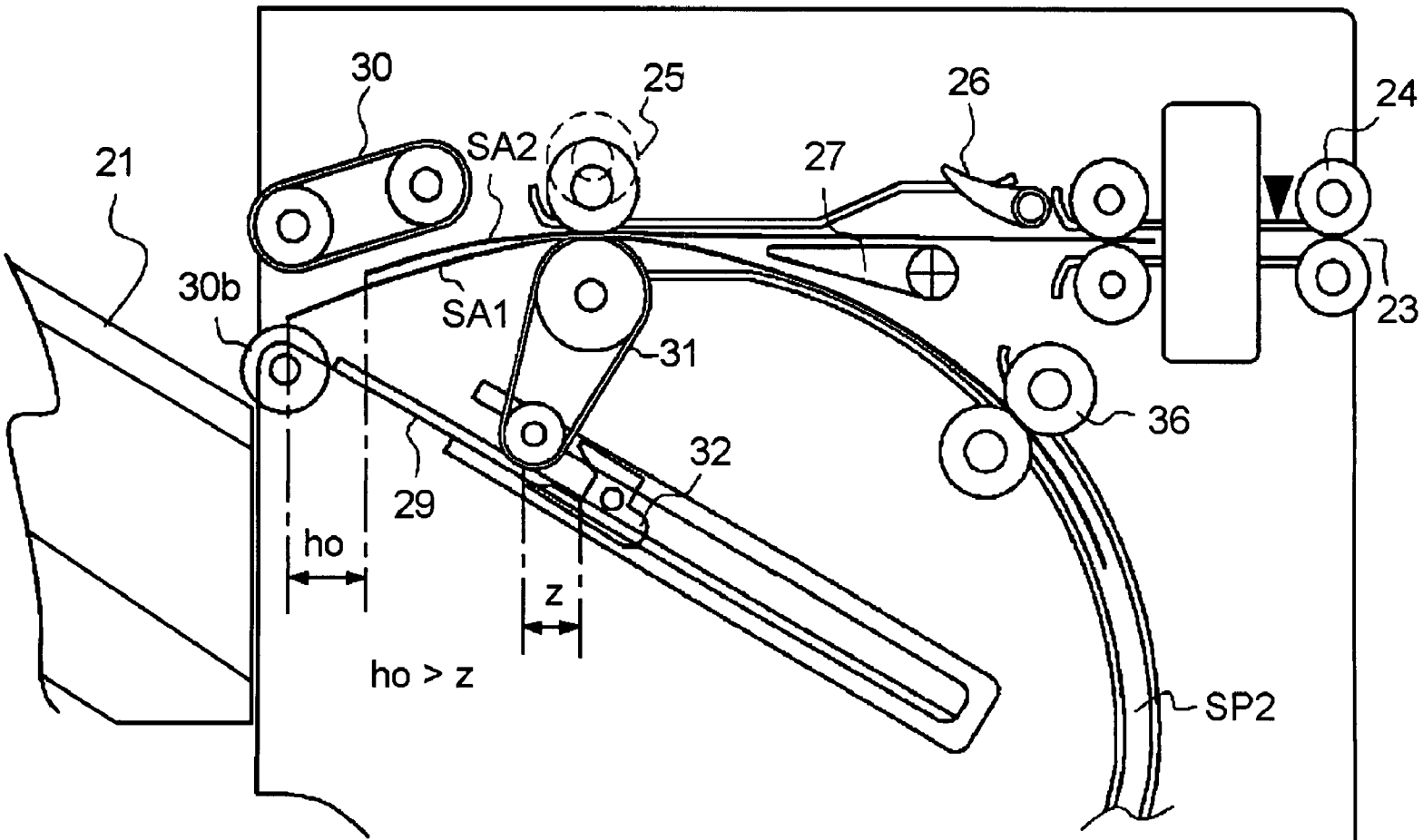
FIG. 12(*a*) is a diagram showing a standby state in which a succeeding sheet shown in FIG. 10 is standing by and in which a first sheet is at a standby position, while a second sheet has reached a carry-in port.
Figure 12B:
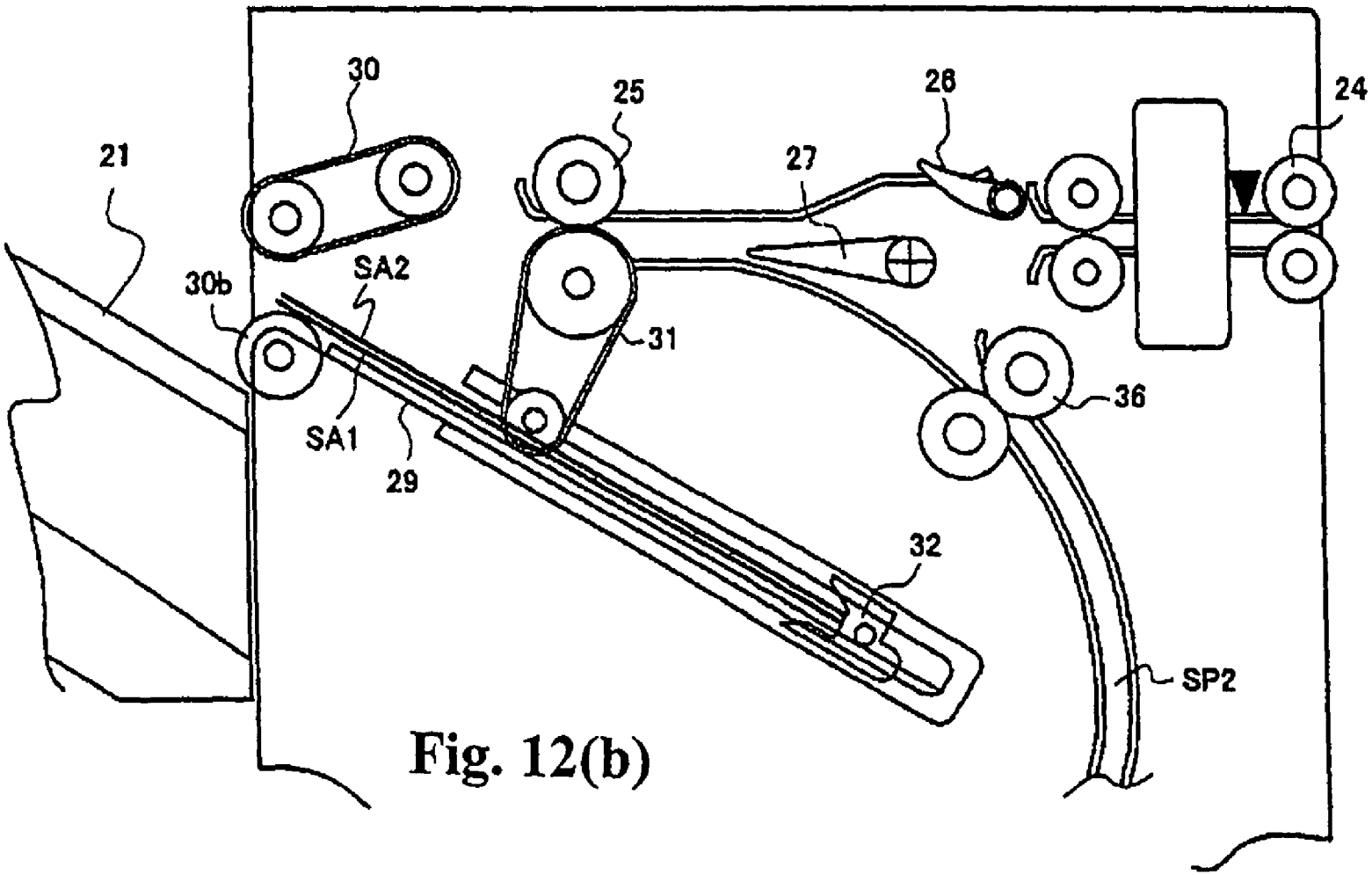
Figure 13A:
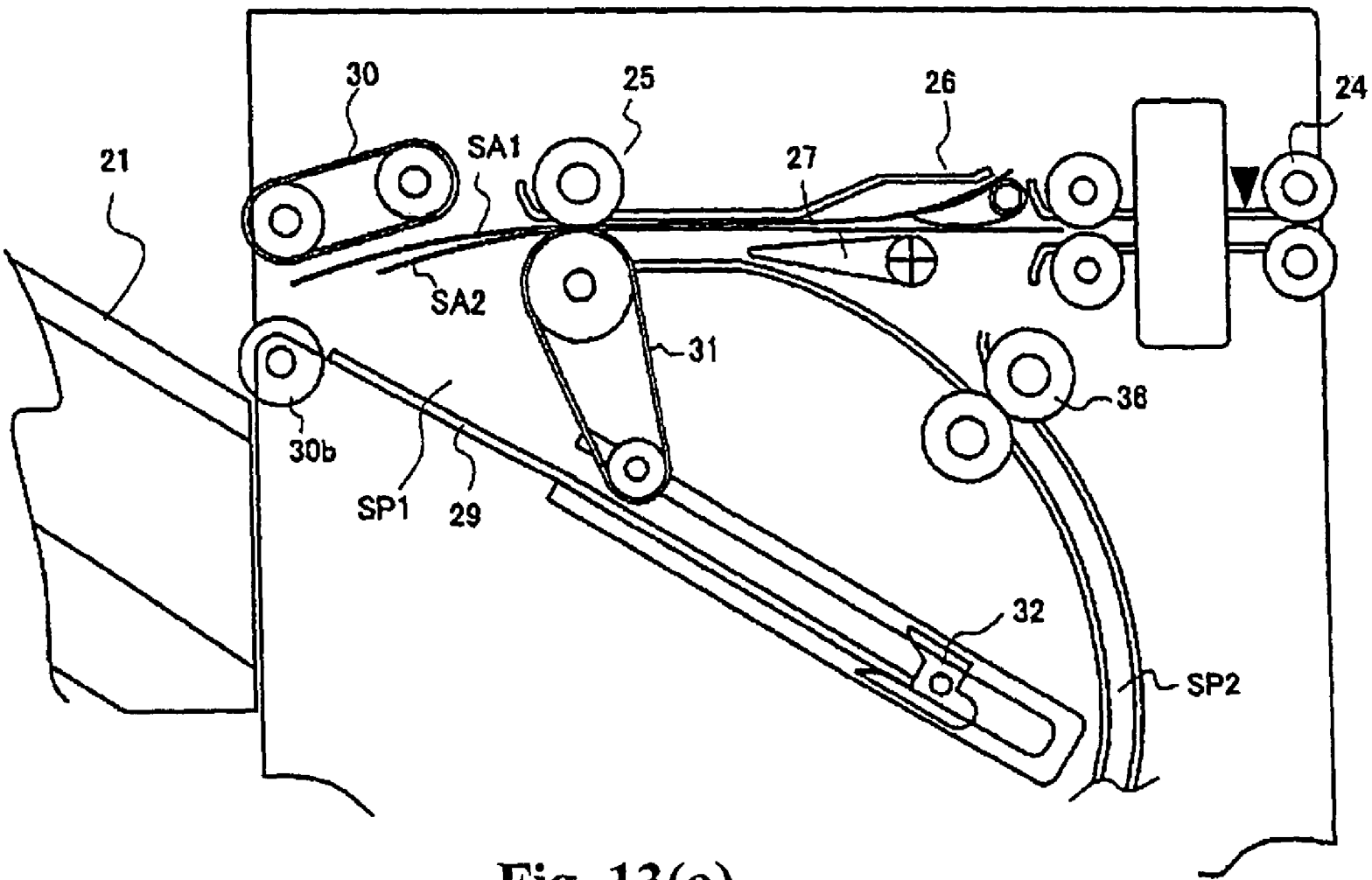
FIG. 13(*a*) is a diagram illustrating the standby state in which the succeeding sheet is standing by and in which the first sheet is at the standby position, while the second sheet has reached the carry-in port.
Figure 13B:
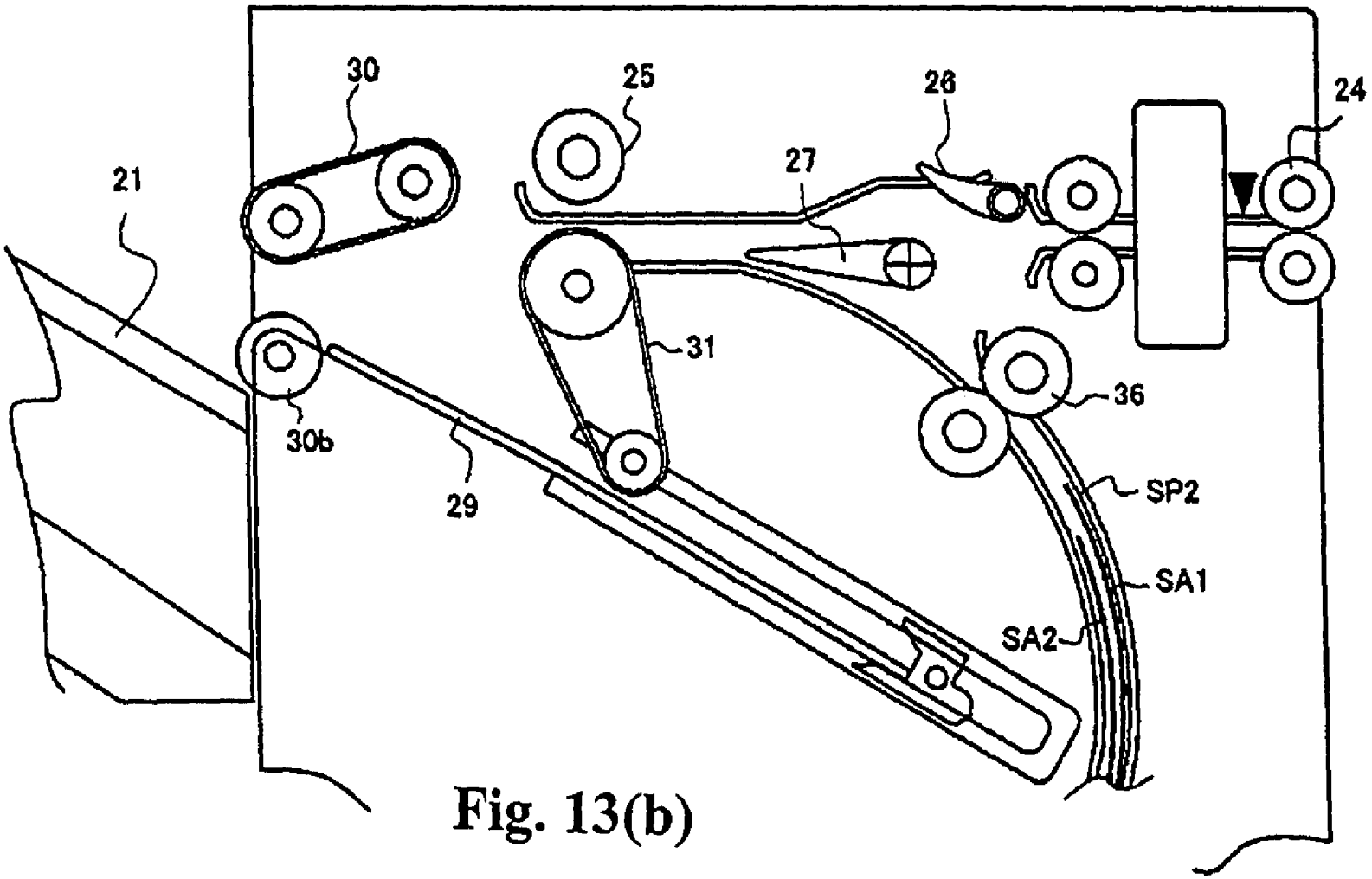

Further, conveyance control is performed as described below if the second succeeding sheet is carried into the sheet carry-in path P1 while the post-processing operation is being performed on the first switchback conveying path SP1. In this case, as shown in FIG. 10, the sheet discharging roller 25 is composed of a pair of rollers that can freely come into pressure contact with each other and leave each other. The paired rollers are configured to be separated from each other by actuating means (not shown) such as an electromagnetic solenoid. The conveyance control means 64*a* holds the first sheet (SA1 in FIG. 12(*a*)) held on the second switchback conveying path SP2 as described above. In this condition, when the second sheet (SA2 in FIG. 12(*a*)) is carried into the sheet carry-in path P1, the sheet sensor S1 detects the sheet leading end to issue the corresponding signal. The conveyance control means 64*a* then separates the sheet discharging rollers 25 from each other. The conveying roller 24 feeds the second sheet SA2 to the sheet discharging port 25*a*. The second sheet SA2 is then laid on top of the first sheet SA1 standing by on the second switchback conveying path SP2. This state is shown in FIG. 12(*a*). The first sheet SA1 and the second sheet SA2 overlap with the leading ends of the sheets offset from each other by an amount ho. That is, the succeeding first sheet SA1 and second sheet SA2 are offset from each other by the predetermined distance ho in the conveying direction. The conveyance control means 64*a* shifts and brings the sheet discharging rollers 25 into pressure contact with each other (as shown in FIG. 12(*a*)) and rotationally drives the rollers 25 in the sheet discharging direction. The two overlapping sheets are then transferred from the first switchback conveying path SP1 to the collecting tray 29.

Figure 11:
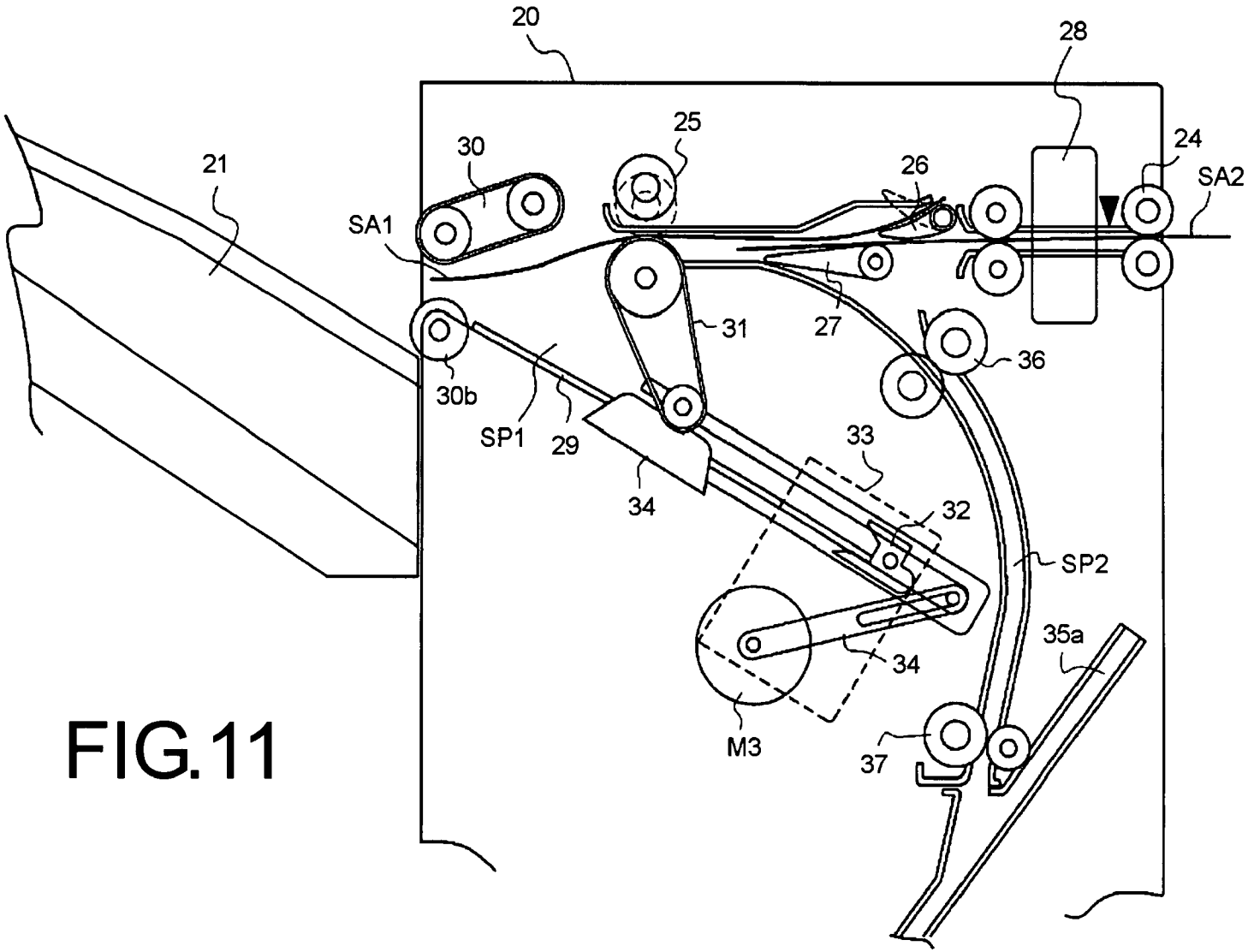
FIG. 11 is a diagram illustrating a situation in which the sheet traveling to a collecting guide is temporarily held on a sheet carry-in path.

An embodiment of the present invention also allows at least two succeeding sheets to stand by temporarily on the switchback conveying path SP2. For example, if a trouble such as a jam occurs during the post-processing of the preceding sheet bunch on the collecting tray 29 and at least two succeeding sheets reside in the upstream image forming apparatus A or the like, at least two succeeding sheets need to stand by on the second switchback conveying path SP2. In this case, as described above, the conveyance control means 64*a* lays the second sheet SA2 on top of the first sheet SA1 with the sheet discharging rollers 25 separated from each other as shown in FIG. 11. The sheet discharging rollers 25 are then brought into pressure contact with each other with the sheets offset from each other by the predetermined amount ho. Then, the conveyance control means 64*a* moves the path switching piece 27 to the position shown in FIG. 11 and rotationally drives the sheet discharging roller 25 in a reverse direction (counterclockwise in FIG. 11). The first and second sheets SA1 and SA2 are then held on the conveying roller 36 on the second switchback conveying path SP2 so as to overlap like scales. Then, after the post-processing operation of the first processing section 29 is completed, the conveyance control means 64*a* drivingly rotates the conveying roller 36 and the sheet discharging roller 25 in the sheet discharging direction (clockwise in FIG. 11) to transfer the plurality of succeeding sheets standing by on the second switchback conveying path SP2, to the first switchback conveying path SP1. The sheets are then loaded and housed on the collecting tray 29.

As described above, the first sheet SA1 standing by on the second switchback conveying path SP2 is offset from the second sheet SA2 fed through the sheet carry-in path P1, by the predetermined amount ho, or the plurality of sheets, the first and second sheets SA1 and SA2, are arranged on the second switchback conveying path SP2 offset from each other like scales by the predetermined amount ho. This is because to allow the sheets to abut against the trailing end regulating member 32, located on the collecting tray 29, for alignment, the aligning means (the above-described caterpillar belt) 31 allow the sheets to sequentially abut against the trailing end regulating member 32 for alignment starting with the lowermost sheet. Thus, as shown in FIG. 12, the offset amount ho for the succeeding sheet is set to be greater than a distance z between the trailing end regulating member 32 and the contact point at which the caterpillar belt (aligning means) 31 contacts the sheets (ho>z). This operation allows the post-processing apparatus B to continuously execute the stapling process without the need to stop the image forming apparatus A.

In the sheet bunch folding finish mode, the image forming apparatus A forms images on sheets, for example, in the order described with reference to FIG. 5. The post-processing apparatus B finally forms the sheets into a booklet. The post-processing apparatus B then retracts the buffer guide 26 of the sheet carry-in path P1 upward as shown in FIG. 3 to move the path switching piece 27 as depicted by the solid line in FIG. 3. The sheet fed to the sheet carry-in path P1 is thus guided to the sheet discharging roller 25. The sheet sensor S1 detects the sheet trailing end and issues the corresponding signal. Then, on the basis of the signal, the control CPU 61, shown in FIG. 9, stops the sheet discharging roller 25 at the timing when the sheet trailing end passes through the path switching piece 27. Simultaneously, the control CPU 61 moves the path switching piece 27 to a position shown by a dashed line in FIG. 3. The sheet discharging roller 25 then reversely rotates the sheet discharging roller 25 (counterclockwise in FIG. 3). Then, the sheet having entered the sheet carry-in path P1 has the conveying direction thereof reversed and is guided to the second switchback conveying path SP2 via the path switching piece 27. The sheet is then guided to the collecting guide 35 by the conveying rollers 36 and 37, arranged on the second switchback conveying path SP2.

At the timing when the sheet is carried into the collecting guide 35 through the second switchback conveying path SP2, the control CPU 61 moves the leading end regulating member 38 to the lowermost Sh1 position. The whole sheets are then supported by the collecting guide 35. In this condition, the control CPU 61 operates the sheet side edge aligning member 39 to align the sheets (the alignment need not be performed for the first sheet or for every arrival of the sheet).

The control CPU 61 then moves the leading end regulating member 38, shown in FIG. 4, to the position Sh3, at which the sheet trailing end enters the switchback approaching path 35*a*, described above. The sheet trailing end supported on the collecting guide 35 moves backward to the switchback approaching path 35*a*. In this condition, the succeeding sheet is fed to the collecting guide 35 through the second switchback conveying path SP2 and stacked on the preceding sheet. When the succeeding sheet is carried in, the leading end regulating member 38 is moved from the position Sh3 to the position Sh1.

As previously described, the sheet side edge aligning member 39 is operated to align the carried-in sheet with the sheet supported on the collecting guide. This operation is repeated to allow the sheets with images formed thereon by the image forming apparatus A to be set on the collecting guide 35 via the second switchback conveying path SP2. Upon receiving the job end signal, the control CPU 61 moves the leading end regulating member 38 to the position Sh2 to align the sheet center with the staple position X for setting.

The control CPU 61 then operates the saddle stitching staple means 40 to staple the sheets at one position or a plurality of positions in the center thereof. In response to a completion signal for this operation, the control CPU 61 moves the leading end regulating member 38 to the position Sh1 and aligns the sheet center with the fold position Y for setting. The control CPU 61 then executes the folding process on the sheet bunch in accordance with the sequence shown in FIGS. 8(*a*) to 8(*d*), and further carries out the resultant sheet bunch to the sheet discharging tray 22.

Further, to continuously execute the sheet bunch folding finish process described above, the control CPU 61, shown in FIG. 9, temporarily holds the succeeding sheet on the sheet carry-in path P1. This sheet buffering operation will be described with reference to FIG. 11. As previously described, the sheet carry-in path P1 has the buffer guide 26, composed of a locking member that locks the sheet trailing end in a sheet standby section (area) formed above the sheet carry-in path P1 as shown in FIG. 11.

To continuously execute the sheet bunch folding process described above, the control CPU 61 temporarily holds the succeeding sheet fed to the sheet carry-in path P1, on the buffer guide 26. As previously described, the sheets are collected on the collecting guide 35 through the second switchback conveying path SP2, shown in FIG. 4. After the image forming job is finished, the saddle stitching staple means 40 executes the stapling process on the sheet bunch collected on the guide. After the stapling process, the folding blade 46 and the folding roll means 45 are actuated to fold the sheet bunch on the collecting guide 35 into a booklet, which is then carried out to the second sheet discharging tray 22.

If the succeeding sheet is carried in by the image forming apparatus A while the stapling operation and/or the sheet bunch folding operation is being performed on the sheet bunch on the collecting guide 35, the control CPU 61 uses the sheet sensor S1 to sense the succeeding sheet. At the time when the sheet trailing end is expected to pass through the buffer guide 26 of the sheet carry-in path P1, the control CPU 61 stops the sheet discharging roller 25. Simultaneously, the control CPU 61 moves the buffer guide 26 to the position shown in FIG. 11. The control CPU 61 subsequently reversely rotates the sheet discharging roller 25. The trailing end of the sheet on the sheet carry-in path P1 is then guided to the buffer guide 26. At the time when the sheet trailing end is expected to reach the buffer guide 26, the control CPU 61 stops the sheet discharging roller 35. The sheet on the sheet carry-in path P1 is then stopped with the trailing end thereof locked by the buffer guide 26.

After the sheet bunch on the collecting guide 35 is discharged to the second sheet discharging tray 22, the succeeding sheet is carried in by the image forming apparatus A and laid on top of the residing (standby) sheet. At this timing, the control CPU 61 rotates the sheet discharging roller 25 clockwise in FIG. 11 and simultaneously moves the buffer guide 26 to a position shown by a dashed line in the figure. The sheets overlapping in the vertical direction are fed downstream by the sheet discharging roller 25. The sheet discharging roller 25 is then reversely rotated to guide the sheets to the second switchback conveying path SP2. The sheets overlapping in the vertical direction are then guided to the collecting guide 35 and aligned with each other in order and in the vertical direction. Sheets, succeeding the sheets overlapping in the vertical direction, are sequentially loaded and housed on the collecting guide 35 via the sheet carry-in path P1 and the second switchback conveying path SP2. This operation allows the post-processing apparatus B to continuously execute the sheet bunch folding process without the need to stop the image forming apparatus A. Preferably, for the sheet overlapping, as shown in FIG. 11, the sheet discharging roller 25 is composed of a pair of rollers that can freely come into pressure contact with each other and leave each other. To lay the succeeding sheet from the carry-in port 23 on top of the sheet standing by on the sheet discharging roller 25, the sheet discharging rollers 25 are preferably separated from each other by the actuating means such as an electromagnetic solenoid.

According to an embodiment of the present invention, as described above, the first and second switchback conveying paths SP1 and SP2 are arranged on the sheet carry-in path P1 so as to lie at a distance from each other in the vertical direction. The collecting tray 29 is located on the first switchback conveying path SP1 so that the stapling process can be executed on the collecting tray 29. The collecting guide 35 is located on the second switchback conveying path SP2 so that the bunch folding process can be executed on the sheets on the collecting guide 35. Thus, if the stapling finish operation and the bunch folding finish operation are to be consecutively performed, the succeeding post-processing can be executed without the need to wait for the preceding post-process to be finished. Furthermore, even if a trouble such as a jam occurs during the execution of the preceding post-processing, the sheet residing in the system for the succeeding post-processing can be conveyed to the position of the succeeding post-processing.

Further, the saddle stitching staple means 40 is located at the staple position X on the collecting guide 35. However, the sheet processing path may extend through the collecting guide, the staple position, and the fold position respectively, and the collecting guide means may be followed by the staple device, with the sheet folding means located downstream of the staple device. Moreover, the sheet bunch may be folded and then carried out onto the second sheet discharging tray 22 without being stapled by the staple means.

Alternatively, a third sheet discharging tray 21*b* may be provided as shown in FIG. 1 so that the sheet carried into the sheet carry-in path P1 can be carried out onto the third sheet discharging tray 21*b*. This configuration allows the sheet to be carried out to a position different from those of the first and second switchback paths, for example, to the exterior of the apparatus.

In the above-described embodiment, the end surface staple means 33 for stapling the sheets at the edge and saddle stitching staple means 40 are arranged in the vertical direction in the space surrounded by the sheet carry-in path P1, the first switchback conveying path SP1, and the second switchback conveying path SP2. Therefore, the apparatus is compact.

Figure 14A:
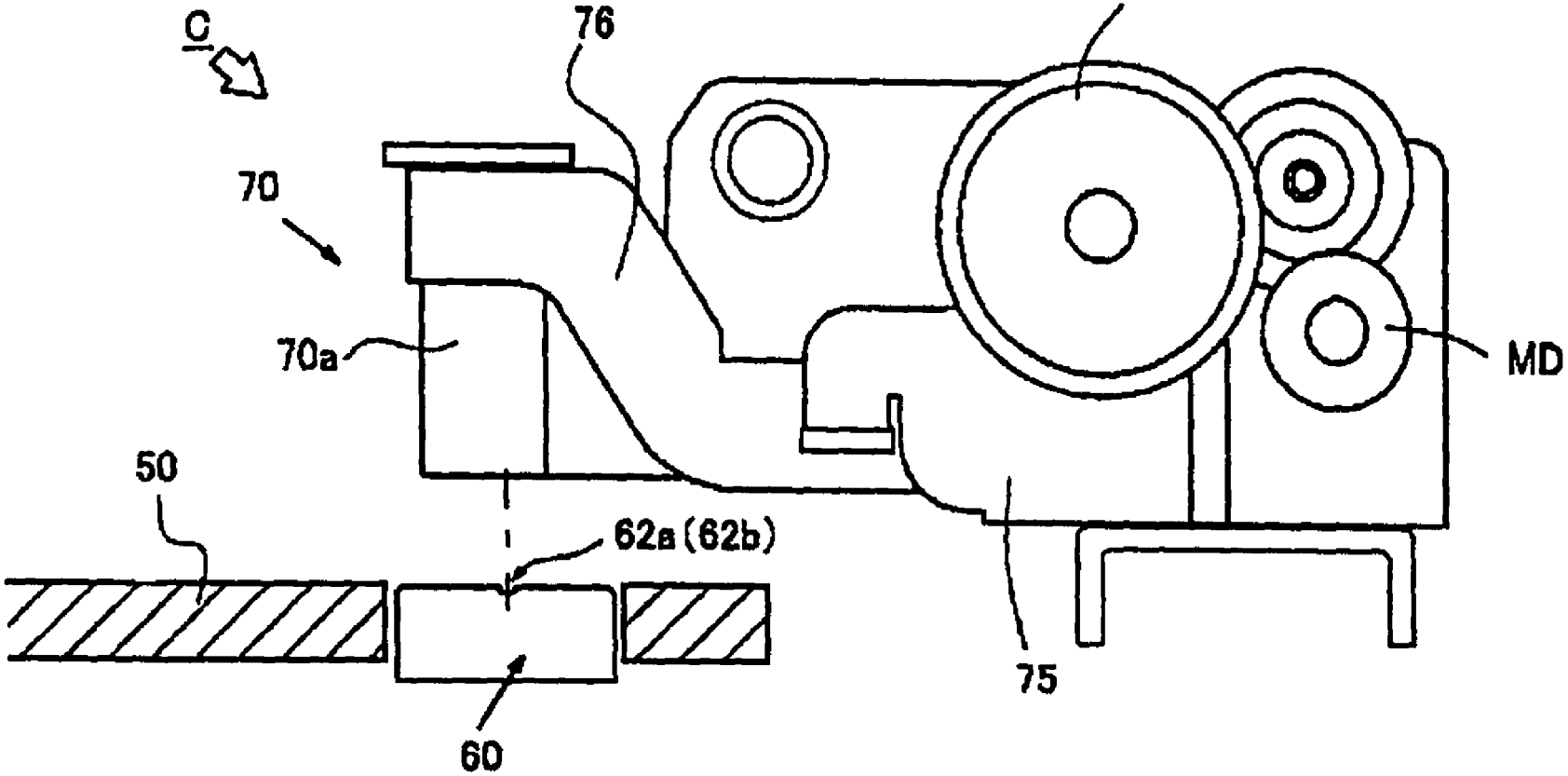
FIG. 14(*a*) is a side view schematically showing the configuration of saddle stitching staple means of the apparatus as a first embodiment for the system in FIG. 1.
Figure 14B:
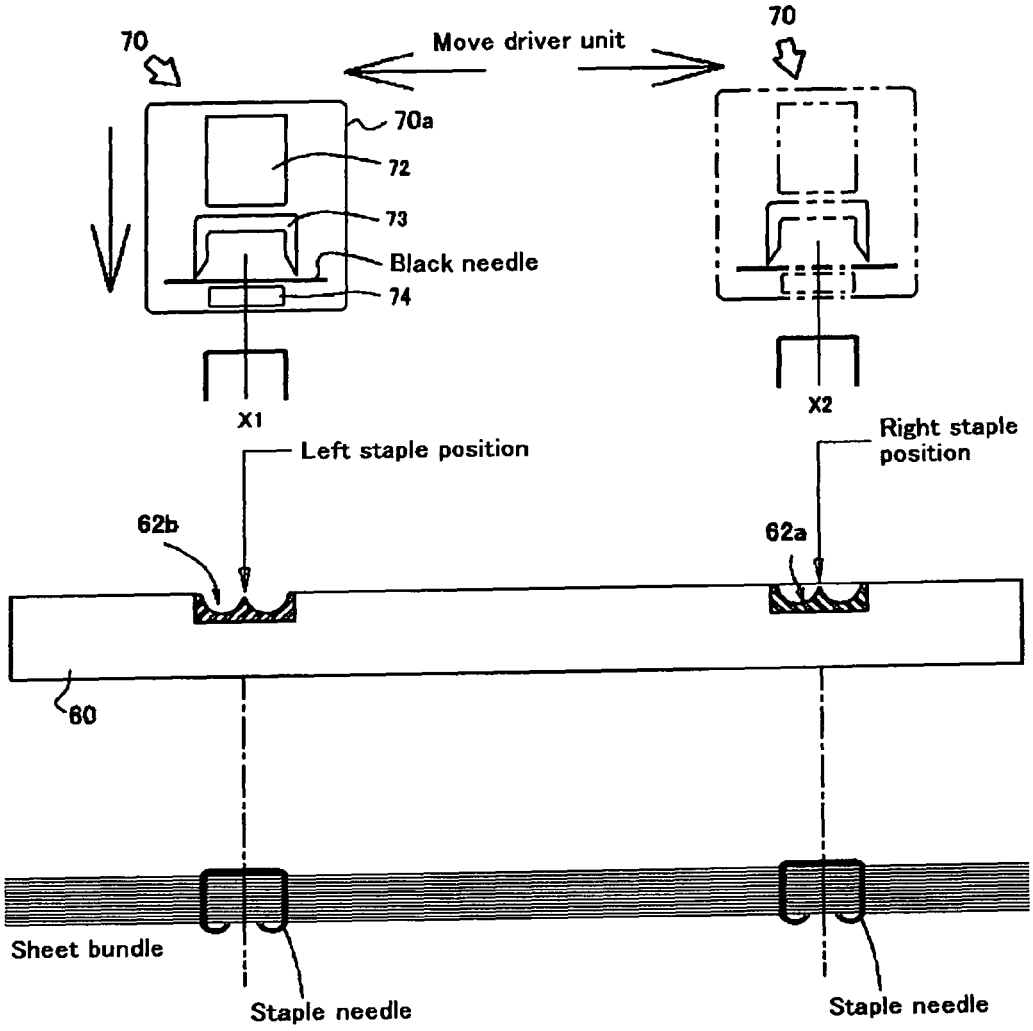

Further, the saddle stitching staple means 40 will be described below with reference to FIGS. 14 to 17. As shown in FIG. 14(*a*), the saddle stitching staple means 40 is composed of a sheet loading table 50, a driver unit 70, and a clinch unit 60. The sheet loading table 50 is composed of a tray member or a sheet guide member which holds the sheets in a bunch at the staple position X, also see FIG. 4. The driver unit 70 is a staple head that sticks a staple needle into the sheet bunch on the sheet loading table and is configured as described below. The clinch unit 60 is configured as described below in order to fold a tip of the staple needle stuck into the sheet bunch.

Two device configurations described below are known for the driver unit 70, and either of the configurations can be adopted for the embodiment of the present invention. In the first configuration, staple needles each folded like the letter U are bonded together like a band, and the band-like needle is installed on the head unit. The band-like needle is depressed (struck) into the sheet bunch. The driver unit 70 is thus composed of a needle housing section in which the needles folded like the letter U and connected together like a band are housed, a driver plate that depresses the staple needle delivered by the needle housing section, toward the sheet bunch, and a driving cam that depresses the driver plate. Such a device is widely known as a stationary stapler and will thus not be described in detail.

The configuration of the driver unit 70 is shown in FIGS. 14(*a*) and 14(*b*). The driver unit 70 has a driver member 72, a former member 73, and a dice member 74 built in a head section 70*a* of a frame thereof and arranged in this order in the vertical direction, as shown in FIG. 14(*b*). The driver member 72 and the former member 73 are supported in the head section 70*a* so as to slidably reciprocate in the vertical direction between the top dead center and the bottom dead center. The dice member 74 is fixed to the head section 70*a* as a shaping tool that folds the linear staple like the letter U. A staple cartridge 75 containing the staple needles is installed inside the frame so that the staple needles in the staple cartridge 75 are sequentially supplied to the dice member 74. The driver member 72 and the former member 73 are coupled to a drive lever 76 swingably attached to the frame and driven in the vertical direction between the top dead center and the bottom dead center. The frame has a stored-energy spring (not shown) that drives the drive lever 76 in the vertical direction, a drive cam 77 that stores energy in the spring, and a drive motor MD that drives the drive cam 77.

With this configuration, in the driver member 72 and former member 73, built in the head section 70*a*, rotation of the drive motor MD causes the drive cam 77 to depress the drive lever 76 from the upper top dead center to the lower bottom dead center via the stored-energy spring. The lowering operation of the drive lever 76 moves the driver member 72 and former member 73, coupled to the drive lever 76, from the top dead center to the bottom dead center. The driver member 72 is composed of a plate-like member so as to depress a rear part of the staple needle folded like the letter U. The former member 73 is composed of a U-shaped member as shown in FIG. 14(*b*) and folds the staple needle like the letter U between the former member 73 and the dice member 74. That is, the staple needle is fed from the staple cartridge to the dice member 74, and the linear staple needle is urged between the former member 73 and the dice member 74 so as to be shaped like the letter "U". The driver member 72 swiftly depresses the staple needle folded like the letter "U", toward the sheet bunch to stick the needle into the sheet bunch.

The clinch unit 60 is located opposite the driver unit 70 configured as described above, across the sheet bunch. The clinch unit 60 is swingably supported by the driver unit 70 via a shaft or configured as a structure separate from the driver unit 70. The clinch unit 60 folds the needle tip stuck into the sheet bunch by the driver unit 70. The clinch unit 60 is thus composed of an anvil member 61 having a folding groove in which the tip of the staple needle is folded. The illustrated clinch unit 60 is composed of the anvil unit 61 having the folding grooves 62*a* and 62*b*, arranged opposite the driver unit 70 across the sheet bunch on the sheet loading table. In particular, the illustrated apparatus is characterized in that the plurality of folding grooves, that is, the lateral paired folding grooves 62*a* and 62*b*, are formed in the anvil member 61 at respective positions in the width direction of the sheet bunch supported on the sheet loading table 50, so as to lie at a predetermined distance from each other. This configuration allows the sheet bunch supported on the sheet loading table 50 to be stapled at the two lateral positions with the clinch unit 60 fixed and without the need to move the clinch unit 60.

The clinch unit 60 may be a wing member (not shown) which folds the needle tip of the staple needle and which is swingably rotated in conjunction (synchronism) with the needle tip stuck into the sheet bunch by the driver unit 70. In this case, a pair of folding wings is swingably supported on the frame of the clinch unit 60 via a shaft at positions opposite to the respective ends of the U-shaped needle. The pair of folding wings is then swung in conjunction with the operation performed by the driver unit 70 to stick the staple needle into the sheet bunch. The swing of the pair of wings allows the needle tip of the staple needle to be folded flat along a back surface of the sheet bunch. That is, the folding grooves allow the needle tip to be folded like the letter U (spectacle clinch). The wing member allows the needle tip to be linearly folded (flat clinch). Either of the configurations can be adopted for the present invention.

The driver unit 70 and clinch unit 60, described above, need to be configured to be movable in the sheet width direction (the lateral direction of FIG. 14(*b*)) of the sheet bunch on the sheet loading table 50. The movement in the sheet width direction is required (1) when the apparatus is configured so that after the sheet bunch has been carried in and set on the sheet loading table 50, the units 70 and 60 are moved from a home position to the predetermined fold position to perform the folding operation or (2) to move the units 70 and 60 in the sheet width direction to staple the sheet bunch in at least two positions. To move the units 70 and 60 in the sheet width direction, two apparatus configurations are available; one of the apparatus configurations simultaneously and integrally moves the driver unit 70 and the clinch unit 60, and the other apparatus configuration fixes one of the units while moving the other.

Further, an embodiment of the present invention relates to the movement of the units 70 and 60. The driver unit and/or clinch unit moved in the sheet width direction is hereinafter referred to as the "moving unit U". In the illustrated apparatus, the moving unit U is composed of the driver unit 70'.

Figure 15:
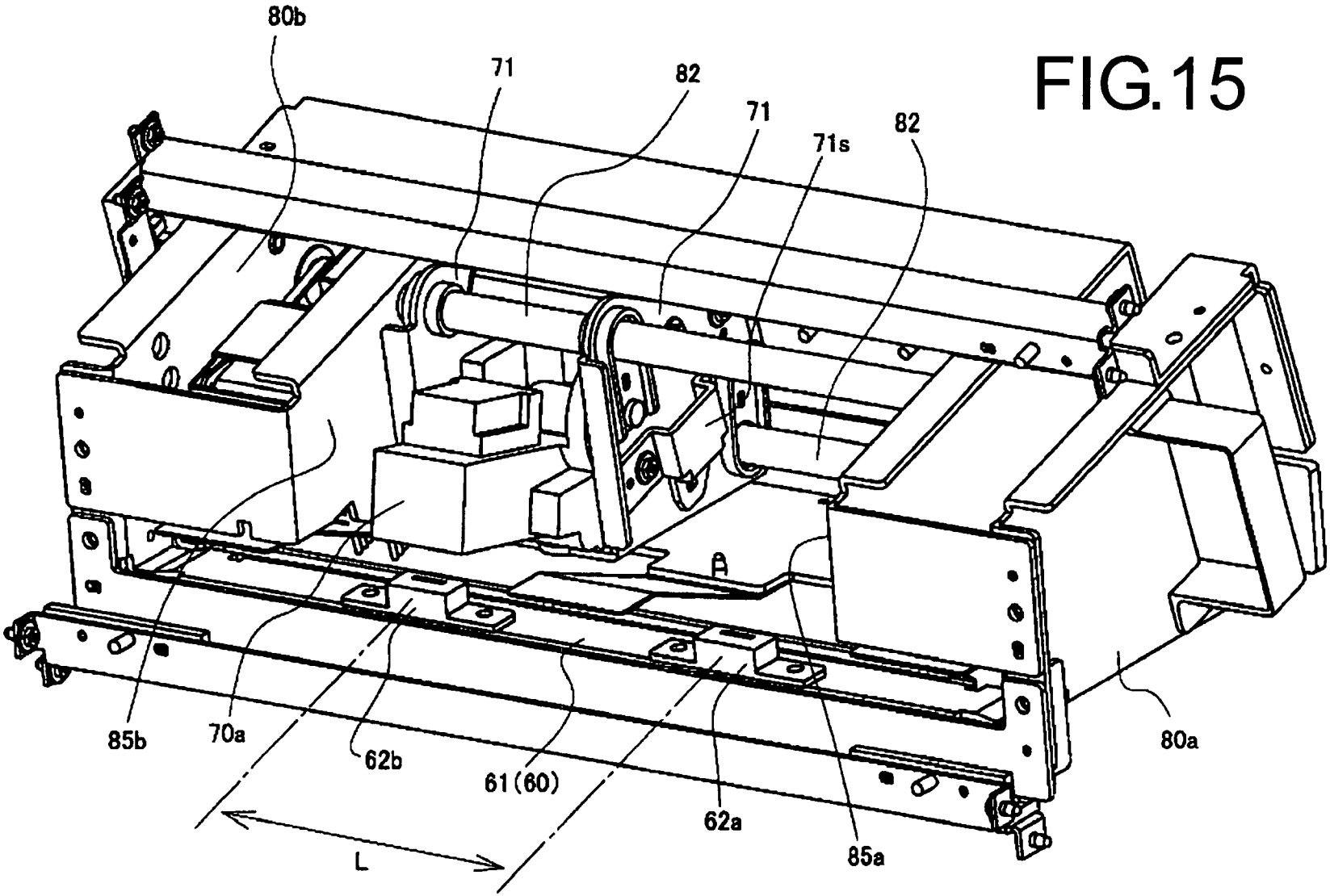
FIG. 15 is a perspective view illustrating the unit configuration of the saddle stitching staple means.

The moving unit U composed of the driver unit (this is also applied to the description below) is supported by apparatus frames (hereinafter also referred to as "apparatus side frames") 80*a* and 80*b* via guide means so as to be able to reciprocate along the guide means 82. As shown in FIG. 15, the apparatus frame 80 is composed of the apparatus side frames 80*a* and 80*b*, provided on the opposite sides of the sheet loading table 50'. The guide means 82 is the guide rails 82 shaped like a rod or a channel or having any other appropriate shape and arranged between the apparatus side frames. The moving unit U is supported on the guide rail 82 so as to be movable in the lateral direction along the sheet loading table 50'. In the illustrated apparatus, the two parallel guide rails are arranged on the apparatus side frames 80. The moving unit U is fittingly supported on the guide rails. Consequently, the moving unit U is supported so as to be movable in the sheet width direction of the sheet loading table 50' along the guide rails.

The moving unit U has the head section 70*a*', driver member 72', former member 73', driver lever 76', and drive cam 77' built in a unit frame 71 fittingly supported on the guide rails 82. A drive motor (not shown) is used to stick the staple needle into the sheet bunch on the sheet loading table 50'.

On the other hand, the illustrated clinch unit 60' is composed of the anvil member 61', located on a plan continuous with the sheet loading table 50' as previously described. The folding grooves 62'*a* and 62'*b* are formed in the anvil member 61'. The folding groove 62' includes the right folding groove 62'*a* and the left folding groove 62'*b*, located at a predetermined distance L from each other and allowing the sheet bunch to be stapled at two positions. The head section 70'*a* of the moving unit U moves in the lateral direction to the positions located opposite the right folding groove 62'*a* and the left folding groove 62'*b*.

Figure 16A:
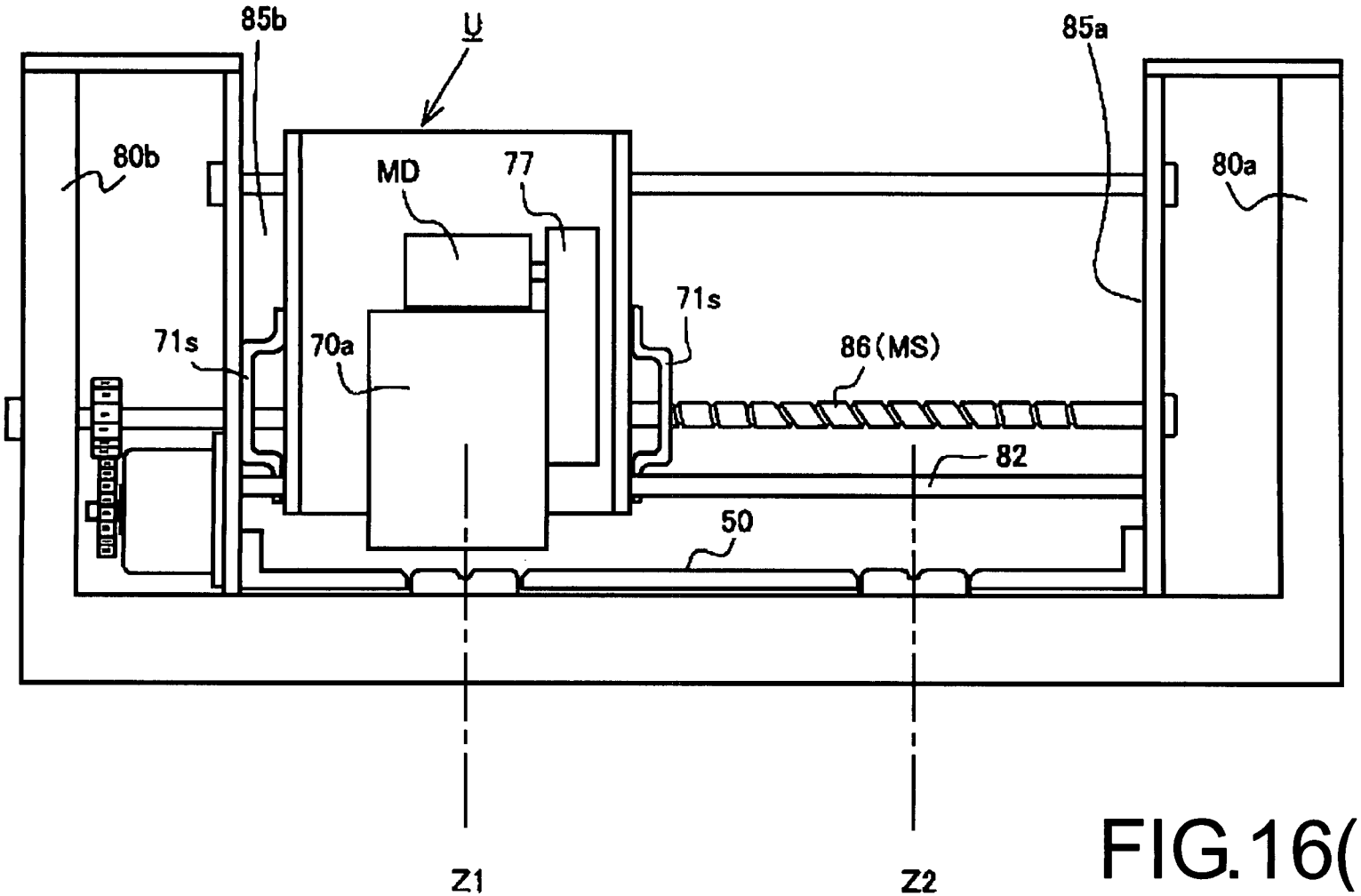
FIG. 16(*a*) is a diagram illustrating a shift mechanism for a moving unit of the saddle stitching staple means.
Figure 16B:
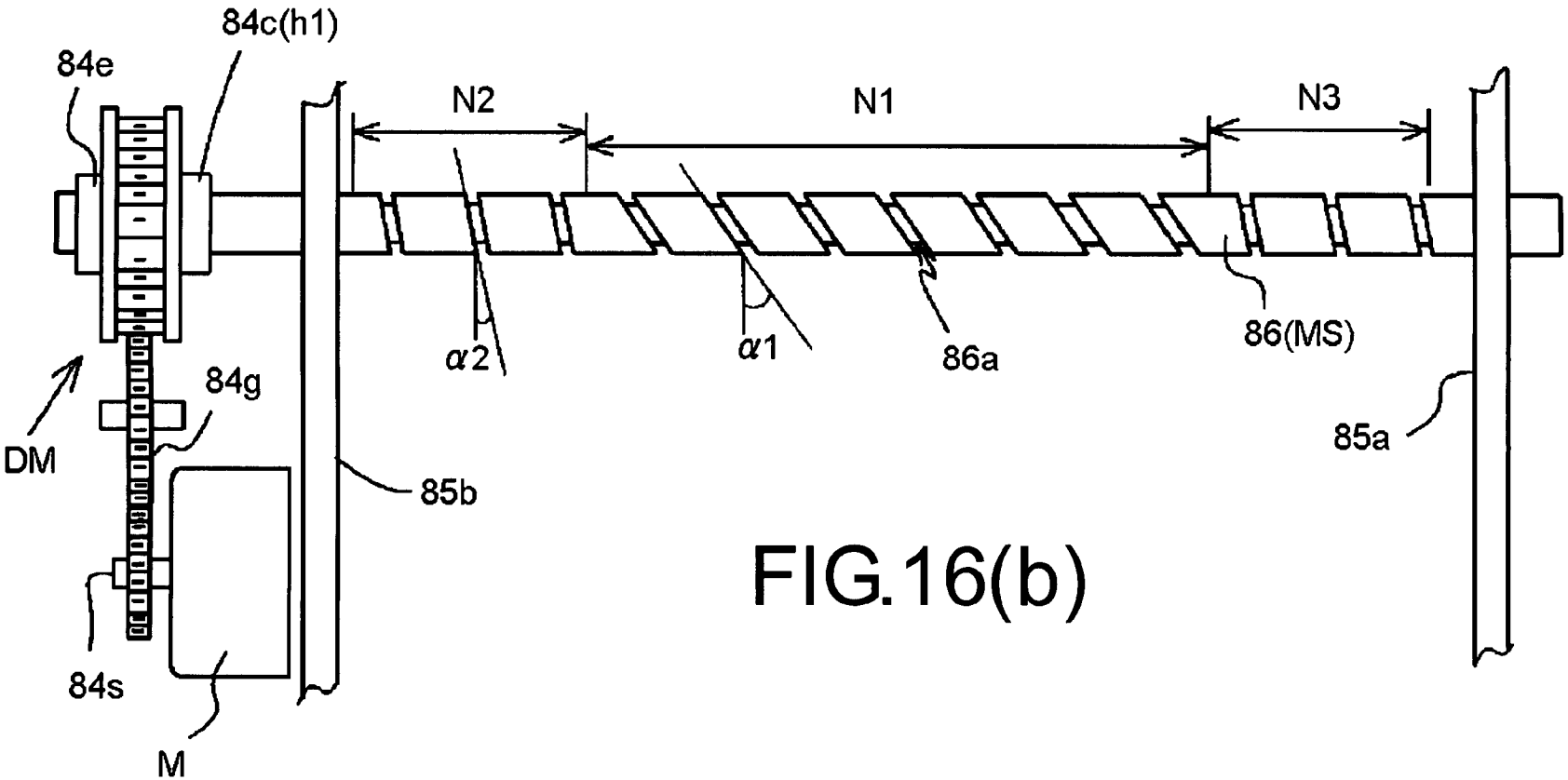

The moving unit U, movably supported on the guide rail 82 as described above, has driving means DM described below. The driving means is composed of the drive motor M, the shift means MS, and a position holding means H. The drive motor M is composed of a normal electromagnetic motor and attached to the side frame 80 of the apparatus frame 80 as shown in FIGS. 16(*a*) and 16(*b*). The drive motor M is coupled to the shift means MS for moving the position of the moving unit U along the guide rail 82. Any of various mechanisms can be adopted as the shift means MS. A typical mechanism will be described below. The shift means MS shown in FIGS. 16(*a*) and 16(*b*) is composed of a lead screw 86 located along and parallel to the guide rails 82. A screw groove 86*a* is formed in the outer periphery of the lead screw 86 so that the moving unit U is fitted in the groove. That is, the moving unit U has a projection 72*p* (not shown; see FIG. 17(*b*)) provided on the unit frame 71 thereof and fitted in the screw groove 86*a*. When the lead screw 86 is rotated forward or backward by the drive motor M, the position of the moving unit U moves in the lateral direction of FIGS. 16(*a*) and 16(*b*).

Now, the screw groove 86*a* in the lead screw 86 will be described. The screw groove 86*a*, engraved in the outer periphery of the lead screw 86, may have a uniform pitch angle, but in the figure, has a varying pitch angle. As shown in FIG. 16(*b*), the moving unit U moves fast at a pitch angle $\alpha 1$ and slowly at a pitch angle $\alpha 2$ ($\alpha 1 > \alpha 2$). As described below, a positioning area in which the moving unit U abuts against a stopper member 85 has the smaller pitch angle $\alpha 2$. Thus, when moving in the lateral direction along the guide rail 76, the moving unit U moves fast in an area denoted by N1 in FIG. 16(*b*) and slowly in areas denoted by N2 and N3 in FIG. 16(*b*).

Instead of being composed of the lead screw 86, the shift means MS may be configured as follows. Although not shown in the drawings, a traveling wire 86*w* (or a traveling belt; this also applies to the description below) is provided along and parallel to the guide rail 82, and the moving unit U is fixedly coupled to the wire. That is, the apparatus frame 80 has a lateral pair of pulleys around which a wire (or belt) is installed. The moving unit U is fixed to the wire, and the one of the right and left pulleys is coupled to the drive motor. The drive motor is rotated forward or backward to allow the wire or belt to travel along the guide rail. The moving unit U, coupled to the wire or belt, also moves in the lateral direction.

The moving unit U configured as described above comprises a positioning mechanism described below which moves the moving unit U to the staple position Z in the sheet width direction for positioning. The apparatus frame 80 has the stopper member 85 against which the moving unit U abuts at the predetermined staple position Z (Z1 and Z2) for positioning. In the illustrated apparatus, a right limit stopper member 85*a* is provided where the head section 70'*a* lies opposite the right folding groove 62'*a*. Likewise, a left limit stopper member 85*b* is provided where the head section 70'*a* lies opposite the left folding groove 62'*b*. The right limit stopper member 85*a* and the left limit stopper member 85*b* are fixed to, for example, the right and left side frames 80 of the apparatus frame, respectively. Alternatively, the right and left limit stopper members 85*a* and 85*b* may be fixedly arranged on the guide rail 82.

With the above-described configuration, the moving unit U abuts against the right limit stopper member 85*a* or the left limit stopper member 85*b* and is stopped at the staple positions Z1 and Z2 for motion regulation. However, in this condition, the moving unit U can move in the opposite direction, that is, leftward from the right limit position or rightward from the left limit position, at which the moving unit U is stopped by the stopper member for position regulation. The moving unit U has the position holding means H, described below. The position holding means H is configured so that the moving unit U abuts against the position holding means H and is biased toward the stopper member. That is, the position holding means H holds the position of the moving unit abutting against the abutting stopper member 85 using one of (1) sliding transmission means h1 (shown in FIG. 16(*b*)) located between the drive motor M and the moving unit U, (2) spring means h2 against which the moving unit U abuts and is biased toward the stopper member 85, or (3) a magnetic torque h3 (shown in FIG. 18) resulting from the magnetic imbalance between the rotor and stator of the drive motor M. Each of these forms will be described.

As shown in FIG. 16(*b*), the drive motor M and the shift means (lead screw 86) MS are drivingly coupled together by a rotating shaft 84*s*, a speed reducing gear 84*g*, and a sliding clutch 84*c*. The sliding clutch 84*c* is coupled to the lead screw 86. The sliding clutch 84*c* is composed of a torque limiter. That is, the rotation of the drive motor M is reduced by the rotating shaft 84*s* so that the reduced rotation is transmitted to the lead screw 86 via the torque limiter. Thus, moving unit U moved in the sheet width direction abuts against the right or left limit abutting stopper member 85, where the moving unit U is subjected to the motion regulation. Subsequent rotation of the drive motor M in the same direction allows the rotation of the rotating shaft 84*s* to be slidably transmitted by the torque limiter. Consequently, even if an external force moving the moving unit U (the force acting in a direction opposite to that of the force of the motion regulation performed by the stopper) acts on the moving unit U or the force acting in the direction opposite to that of the force of the motion regulation performed by the stopper is exerted by an impact during the stapling operation, the sliding transmission force of the torque limiter allows the moving unit U to be held at the stopper position.

In this case, control means for controlling the drive motor M performs control such that even after the moving unit U is moved to the predetermined staple position Z1 or Z2, the drive motor M is continuously rotated in the same direction to allow the torque limiter to exert the sliding transmission force.

Figure 17A:
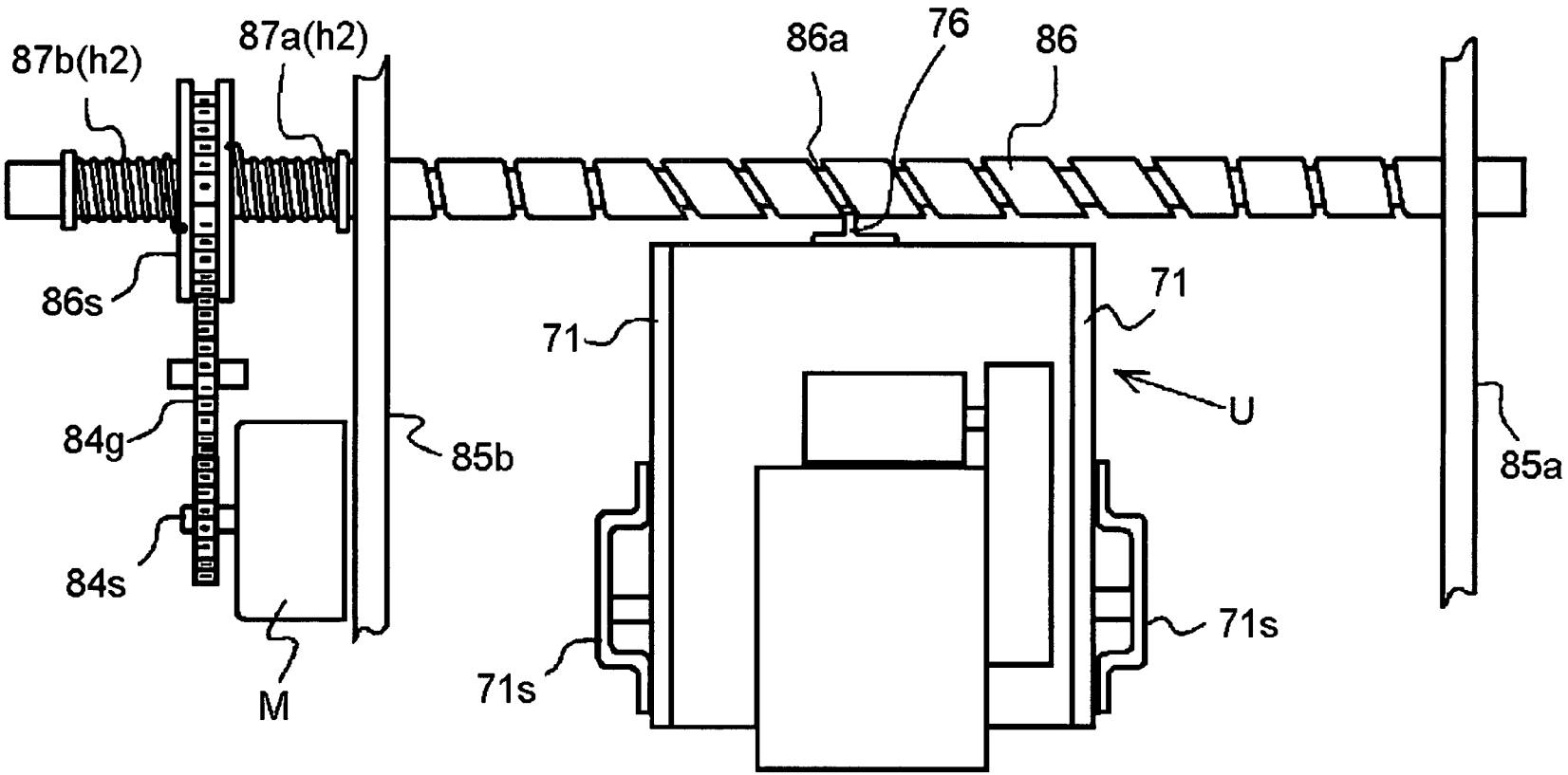
FIG. 17(*a*) is a diagram illustrating a driving mechanism using a bias spring (position holding means), as a different form of the shift mechanism for the moving unit of the saddle stitching staple means.
Figure 17B:
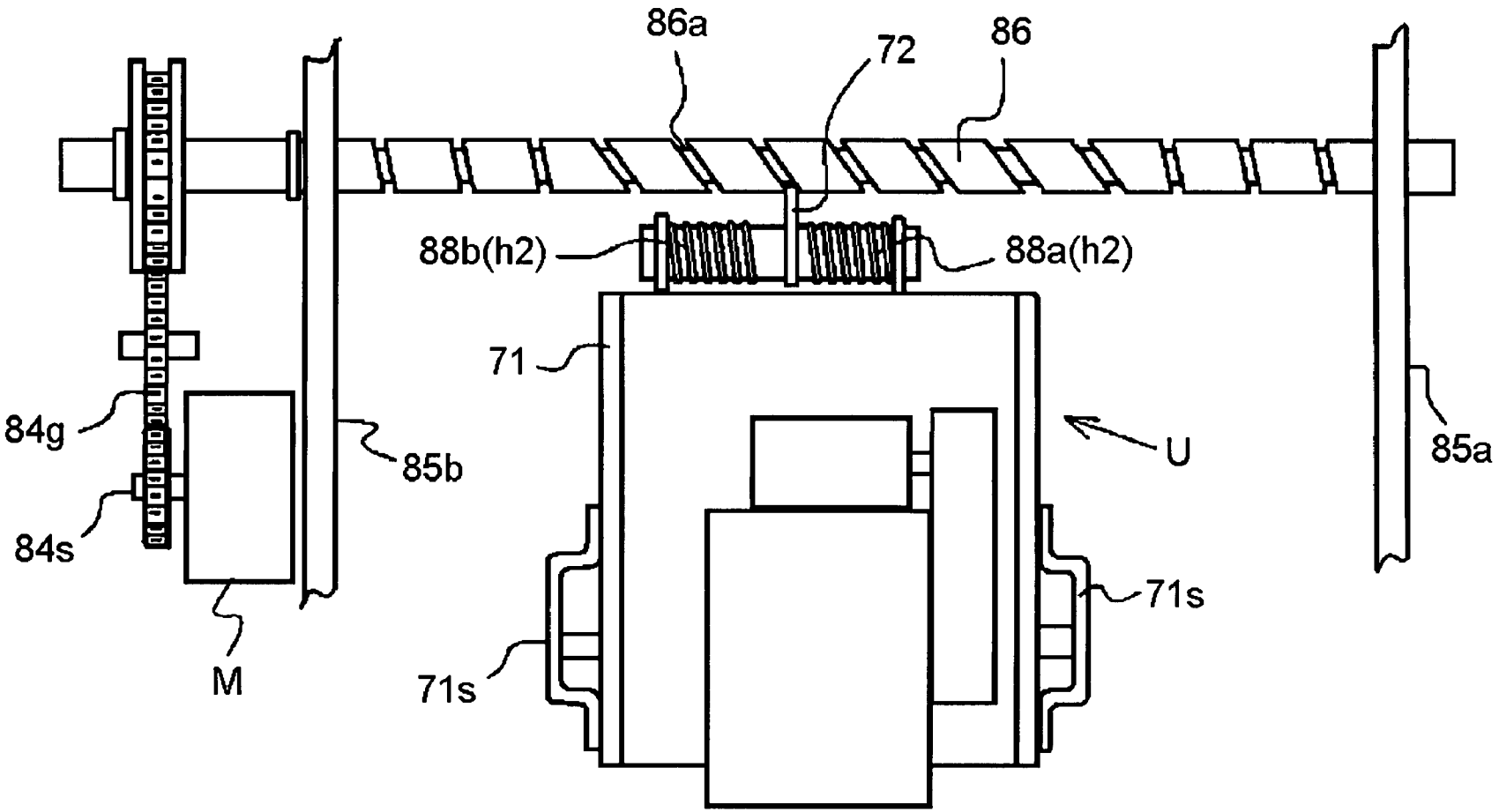

The position holding means H may be composed of the bias spring h2 in place of the sliding clutch mechanism. The bias spring h2 may be located between the drive motor M and the shift means MS (the form in FIG. 17(*a*)) or between the shift means MS and the moving unit U (the form in FIG. 17(*b*)). In FIG. 17(*a*), a coil spring 87 is provided between the rotating shaft 84*s* of the drive motor M and the lead screw 86. A right coil spring 87*a* and a left coil spring 87*b* are wound around a collar shaft 86*s* shown in FIG. 17(*a*) (the collar shaft is coupled to the driving rotating shaft 84*s* via the speed reducing gear 84*g*) so that a rotating force can be transmitted to the lead screw 86 via the coil springs. The rotation of the transmission shaft is such that rightward rotation is transmitted to the lead screw 86 via the first coil spring 87*a* and such that leftward rotation is transmitted to the lead screw 86 via the second coil spring 87*b*. This configuration allows the moving unit U to abut against the right or left limit stopper member 85 for motion regulation. Subsequently stopping the drive motor M allows a force corresponding to the overrun amount of the motor to be stored in the first coil spring 87*a* or the second coil spring 87*b*. Therefore, a rotating force biasing the moving unit U toward the stopper member 85 acts on the lead screw 86.

A bias spring 88 shown in FIG. 17(*b*) is located between the shift means MS and the moving unit U. That is, the unit frame 71 of the moving unit U has the projection 72*p* fitted in the screw groove 86*a* in the lead screw 86. The projection 72*p* is attached to the unit frame 71 so as to be movable at a predetermined stroke. Springs 88*a* and 88*b* are provided between the projection 72*p* and the moving unit U. As previously described, the moving unit U abuts against the right or left limit stopper member 85 for motion regulation, and then the drive motor M is stopped. Then, a force corresponding to the overrun amount of the motor is generated and stored in the spring 88*a* or 88*b*. Therefore, a biasing force biasing the moving unit U toward the stopper member 85 acts between the projection 72*p* and the moving unit U.

Figure 18:
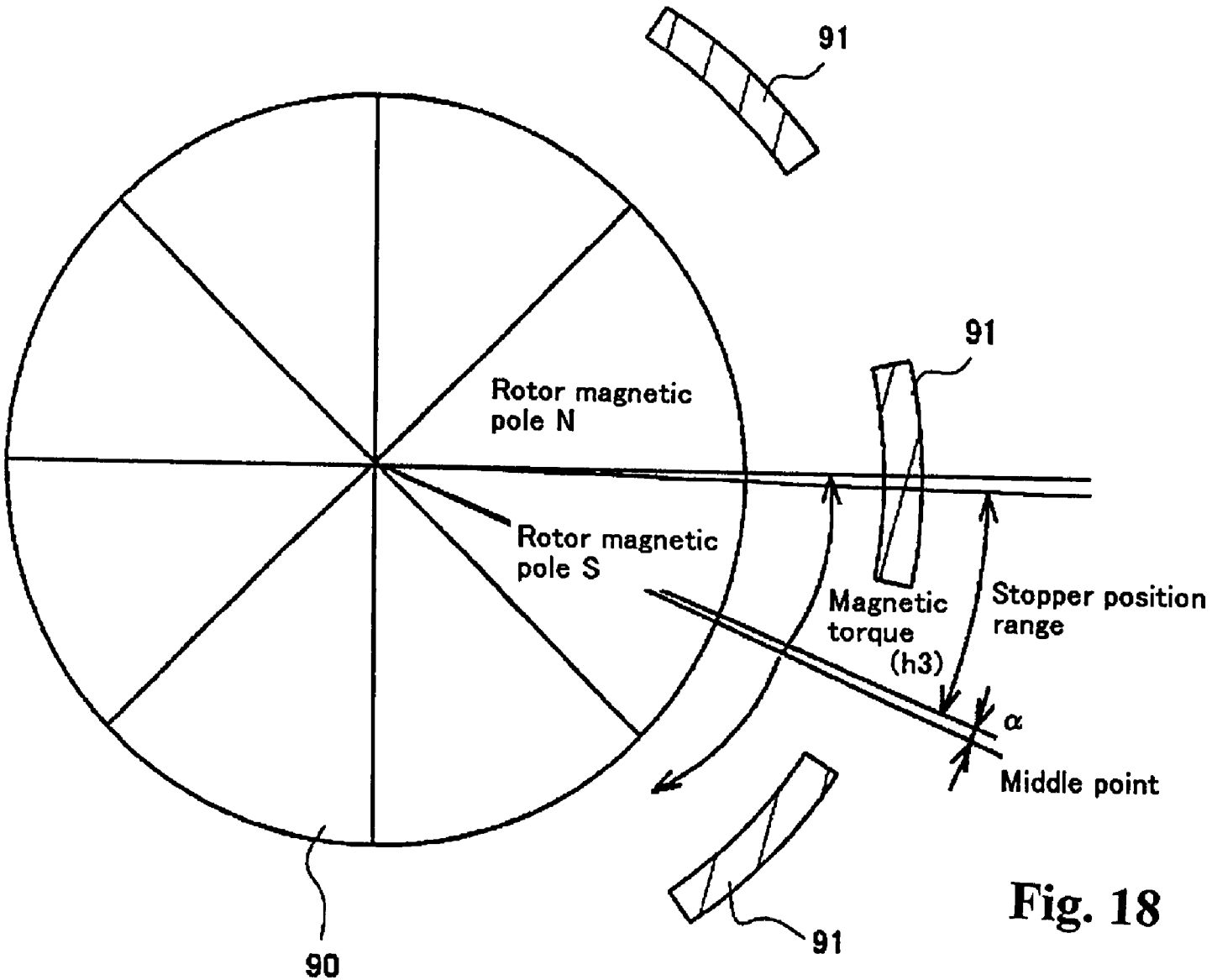
FIG. 18 is a diagram illustrating a driving mechanism using a magnetic torque as position holding means.

As described above, the position holding means H for biasing the moving unit U toward the stopper member 85 can be composed of a magnetic torque induced by the drive motor M. As shown in FIG. 18, between a magnet rotor 90 and stators 91 constituting the drive motor, a detent torque is generated which attracts the magnet rotor 90 toward a magnetic pole during stoppage when coils are not excited. Furthermore, with the magnet rotor 90 at rest (with the magnetic rotor 90 abutting against the stopper), the coils are energized to generate a holding torque. A magnetic torque such as the detent torque or the holding torque is used to bias the moving unit U toward the stopper member 85. In this case, the magnetic pole position of the drive motor and the regulation position of the stopper 85 are set for the positional relationship (shown by the range of the stopper location in FIG. 18) under which while the motor is stopped (the motor is not excited), a force moving the moving unit U toward the stopper member 85 acts on the magnet rotor 90.

Figure 19A:
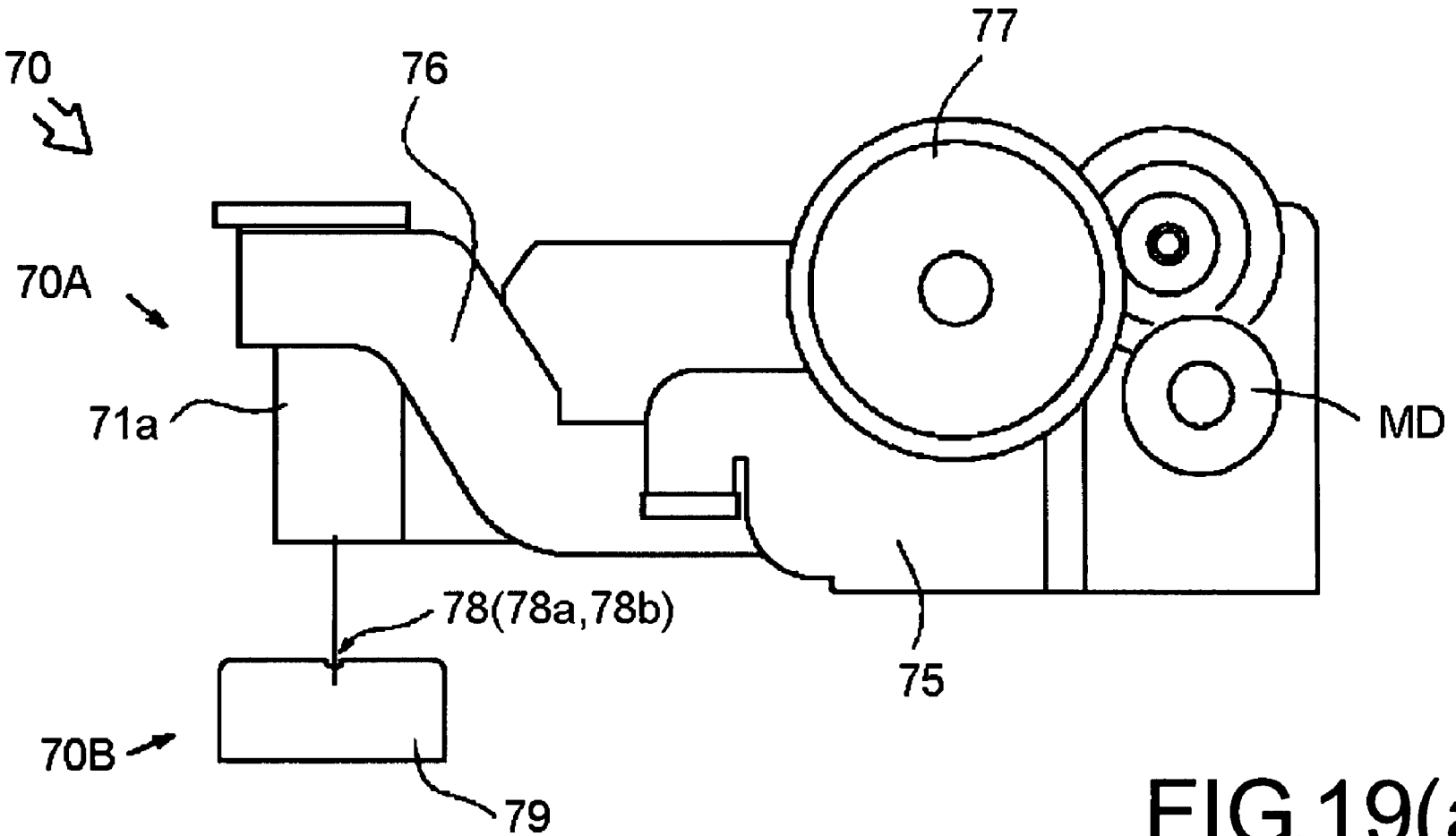
FIG. 19(*a*) is a schematic diagram illustrating the general configuration of saddle stitching staple means as a second embodiment.
Figure 19B:
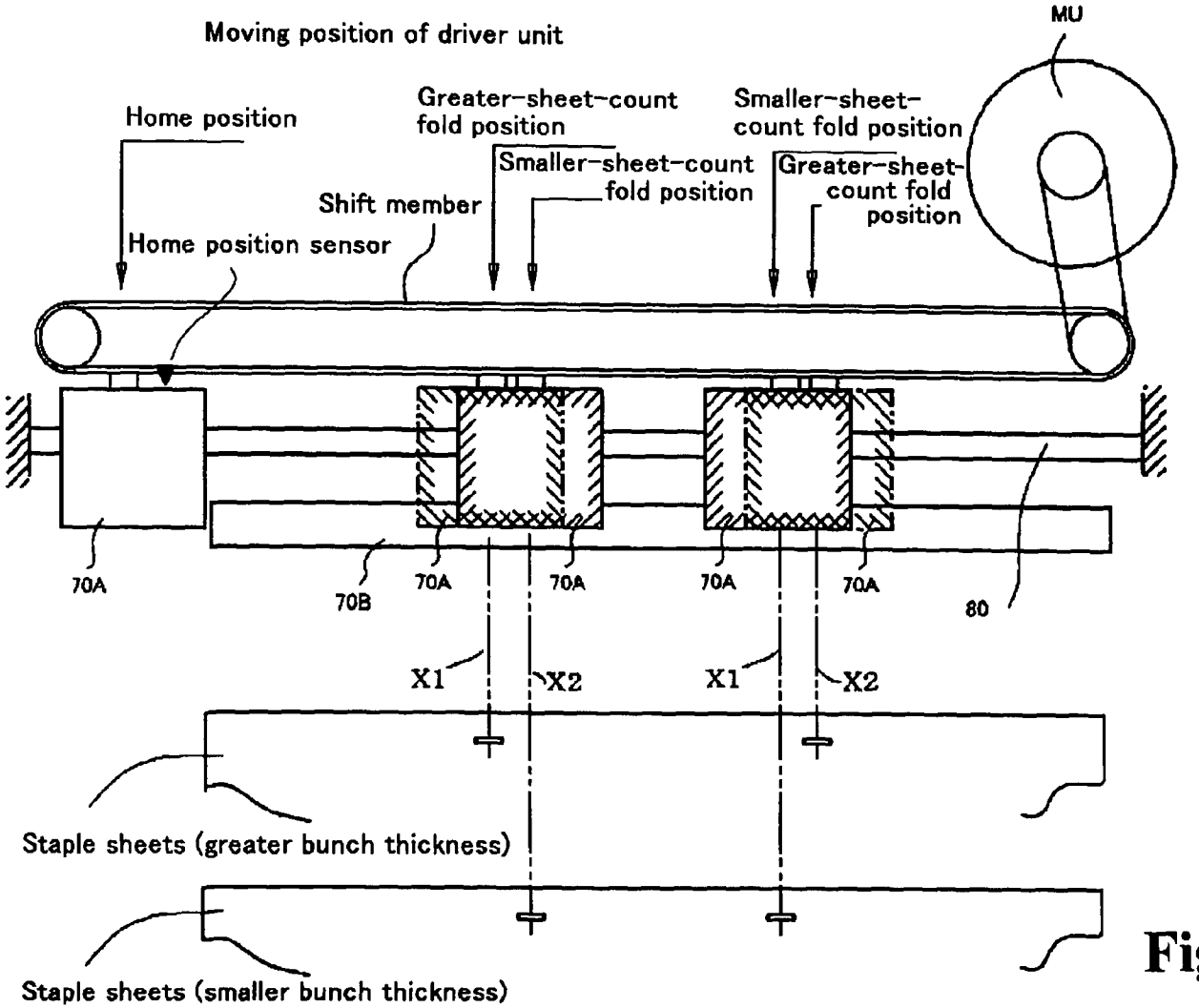
Figure 20:
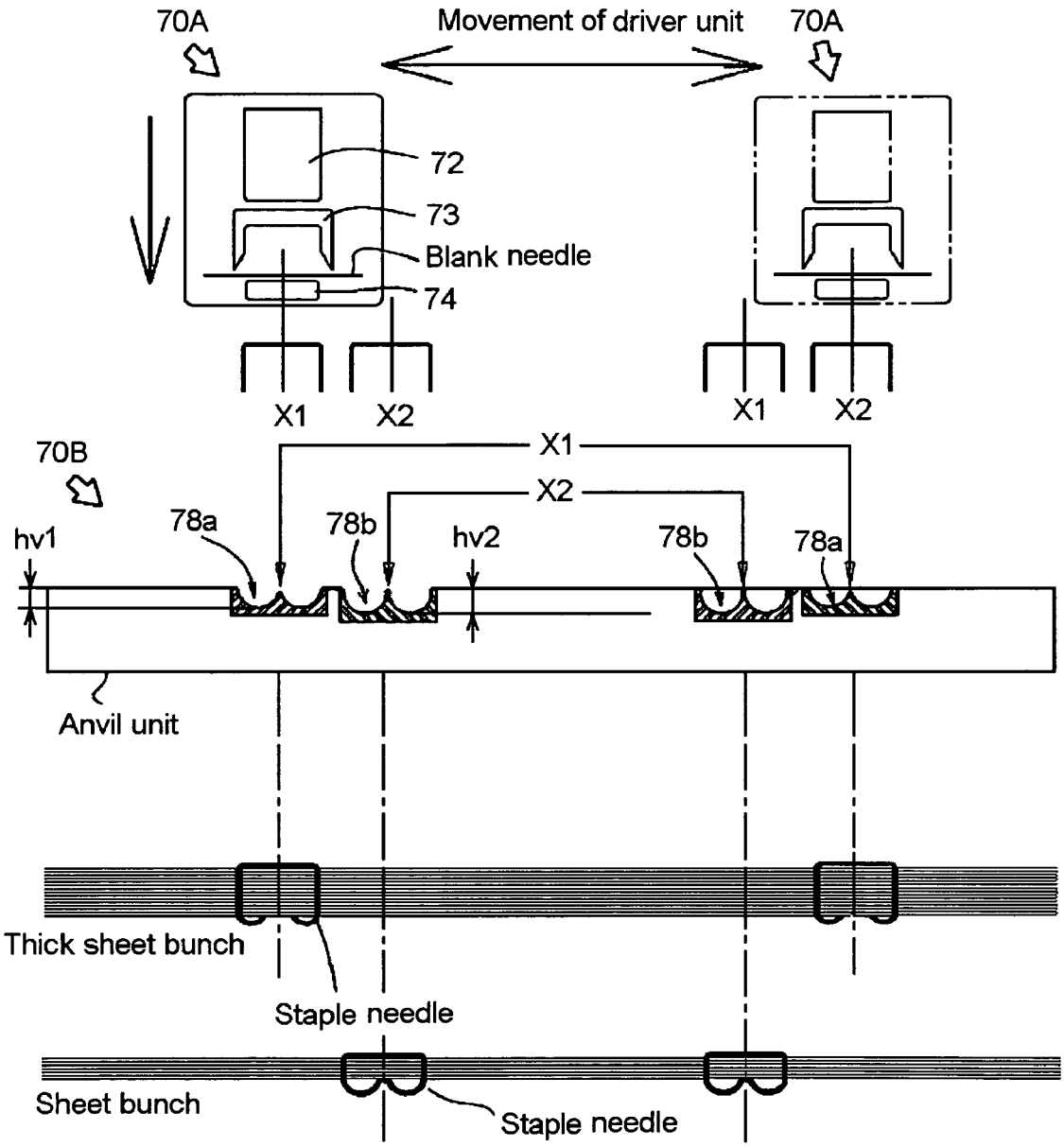
FIG. 20 is a diagram illustrating the sectional structure of an anvil unit of the saddle stitching staple means.

A second embodiment of the saddle stitching staple means 40 will be described with reference to FIGS. 19 and 20. FIG. 19(*a*) is a schematic diagram of a general configuration. FIG. 19(*b*) is a diagram illustrating a sheet stapling operation. FIG. 20 is a diagram illustrating the sectional structure of the anvil unit.

As shown in FIG. 19(*a*), the saddle stitching staple means 40 comprises staple means 40' and sheet bunch holding means (collecting guide 35). The staple means 40' is composed of the driver unit 40'A and the anvil unit 40'B as shown in a conceptual drawing in FIG. 19(*a*). The driver unit 40'A has the frame 41 having the head section 41*a* containing the driver member 42, the former member 43, and the dice member 44 as shown in FIG. 20. The driver member 42 and the former member 43 are supported in the head section 41*a* so as to slidably reciprocate in the vertical direction between the top dead center and the bottom dead center. The dice member 44 is fixed to the head section 41*a* as a shaping tool that folds the linear staple like the letter U. The staple cartridge 75 containing the staple needles is installed inside the frame 41 so that the staple needles in the staple cartridge 75 are sequentially supplied to the dice member 44. The driver member 42 and the former member 43 are coupled to the drive lever 106 swingably attached to the frame 41 and driven in the vertical direction between the top dead center and the bottom dead center. The frame 41 has a stored-energy spring (not shown) that drives the drive lever 106 in the vertical direction, the drive cam 107 that stores energy in the spring, and the drive motor MD that drives the drive cam 107.

With this configuration, in the driver member 42 and former member 43, built in the head section 41*a*, rotation of the drive motor MD causes the drive cam 107 to move the drive lever 106 from the upper top dead center to the bottom dead center via the stored-energy spring. The lowering operation of the drive lever 106 moves the driver member 42 and former member 43, coupled to the drive lever 106, from the top dead center to the bottom dead center. The driver member 42 is composed of a plate-like member so as to depress a rear part of the staple needle folded like the letter U. The former member 43 is composed of a U-shaped member as shown in FIG. 20 and folds the staple needle like the letter U between the former member 43 and the dice member 44. That is, the staple needle is fed from the staple cartridge to the dice member 44, and the linear staple needle is urged between the former member 43 and the dice member 44 so as to be shaped like the letter "U". The driver member 42 sticks the staple needle folded like the letter "U", into the sheet bunch.

The anvil unit 40'B, located opposite the driver unit 40'A configured as described above has a structure shown in FIG. 20. The anvil unit 40'B is composed of an anvil member 79 that is a structure separate from the driver unit 40'A and having the folding groove 78, in which the tip of the staple needle stuck into the sheet bunch is folded. The anvil member 79 is shaped like a stay extending along a staple line direction of the sheet bunch and comprises the plurality of folding grooves 78*a* and 78*b*. The folding grooves 78*a* and 78*b* have an illustrated shape (see FIG. 20) so as to fold the U-shaped needle into a loop (spectacle clinch) in such a manner that the opposite ends of the needle face each other. The present invention is characterized in that the anvil member 79 is shaped like a stay and has the plurality of folding grooves 78*a* and 78*b*.

When the tip of the staple needle is folded by a smaller amount (a shorter length), the folding groove 78 1is shaped as a recessed groove having a smaller folding depth (hv1) like the folding groove 78*a*, shown in FIG. 20. When the tip of the staple needle is folded by a greater amount (a longer length), the folding groove 78 is shaped as a recessed groove having a greater folding depth (hv2) like the folding groove 78*b*, shown in FIG. 20. Thus, the plurality of folding grooves 78*a* and 78*b*, having the different folding depths hv1 and hv2 (hv1<hv2), are arranged in the anvil member 79 at the different positions in the sheet width direction. When the sheet bunch is stapled at two positions as shown in the figure, the anvil member 79 has, for example, two grooves 78*a* each having the smaller folding depth and arranged at the respective positions lying at a predetermined distance from each other. The anvil means 79 further has two grooves 78*b* having the greater folding depth and arranged at the respective positions different from those of the grooves 78*a* and lying at a predetermined distance from each other. The folding groove 78 is thus located at the four positions in total.

Now, a third embodiment of the stapling device will be described in detail with reference to FIGS. 23 to 26.

Figure 23A:
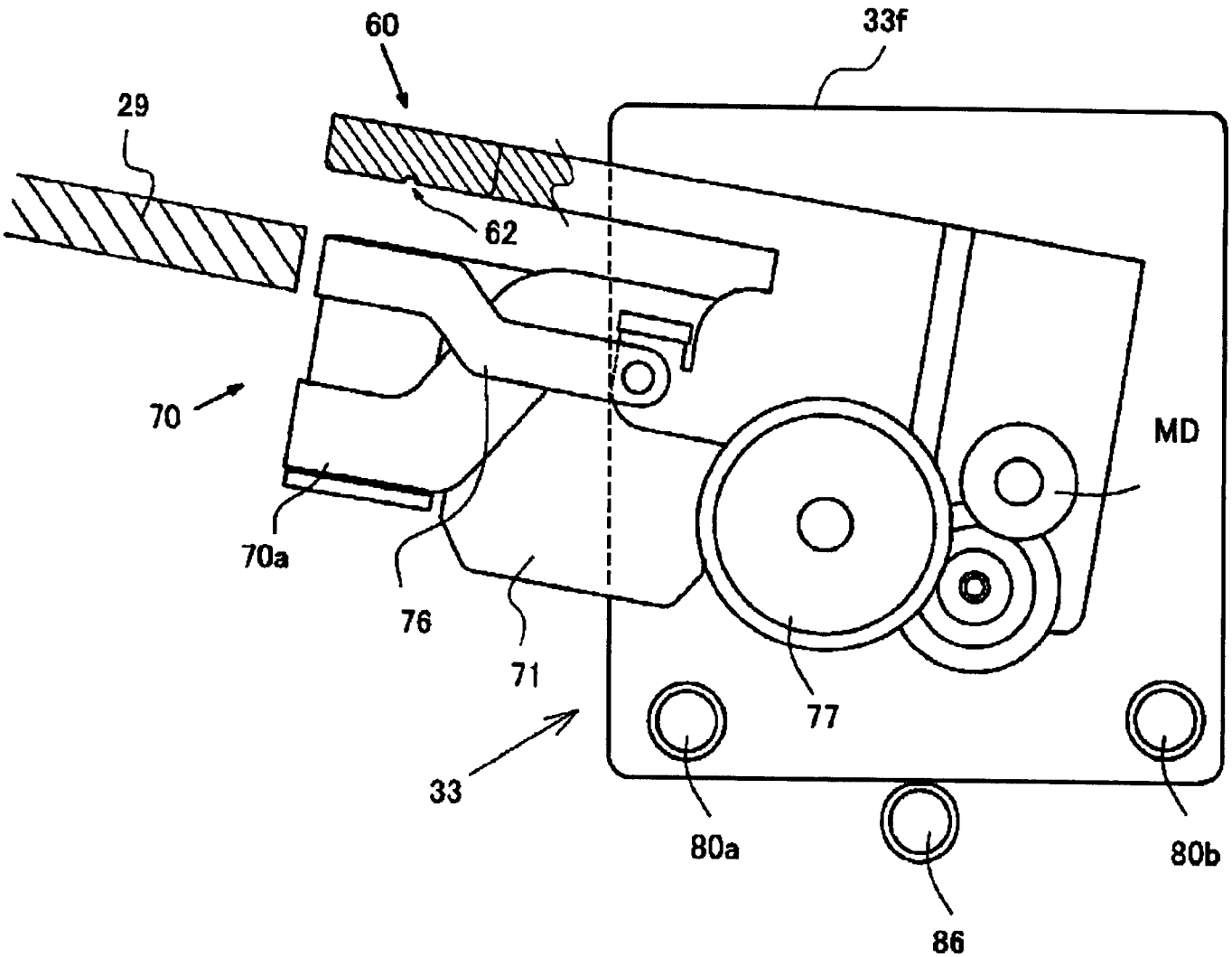
FIG. 23(*a*) is a diagram schematically illustrating the configuration of the end surface staple means in FIG. 2.
Figure 23B:
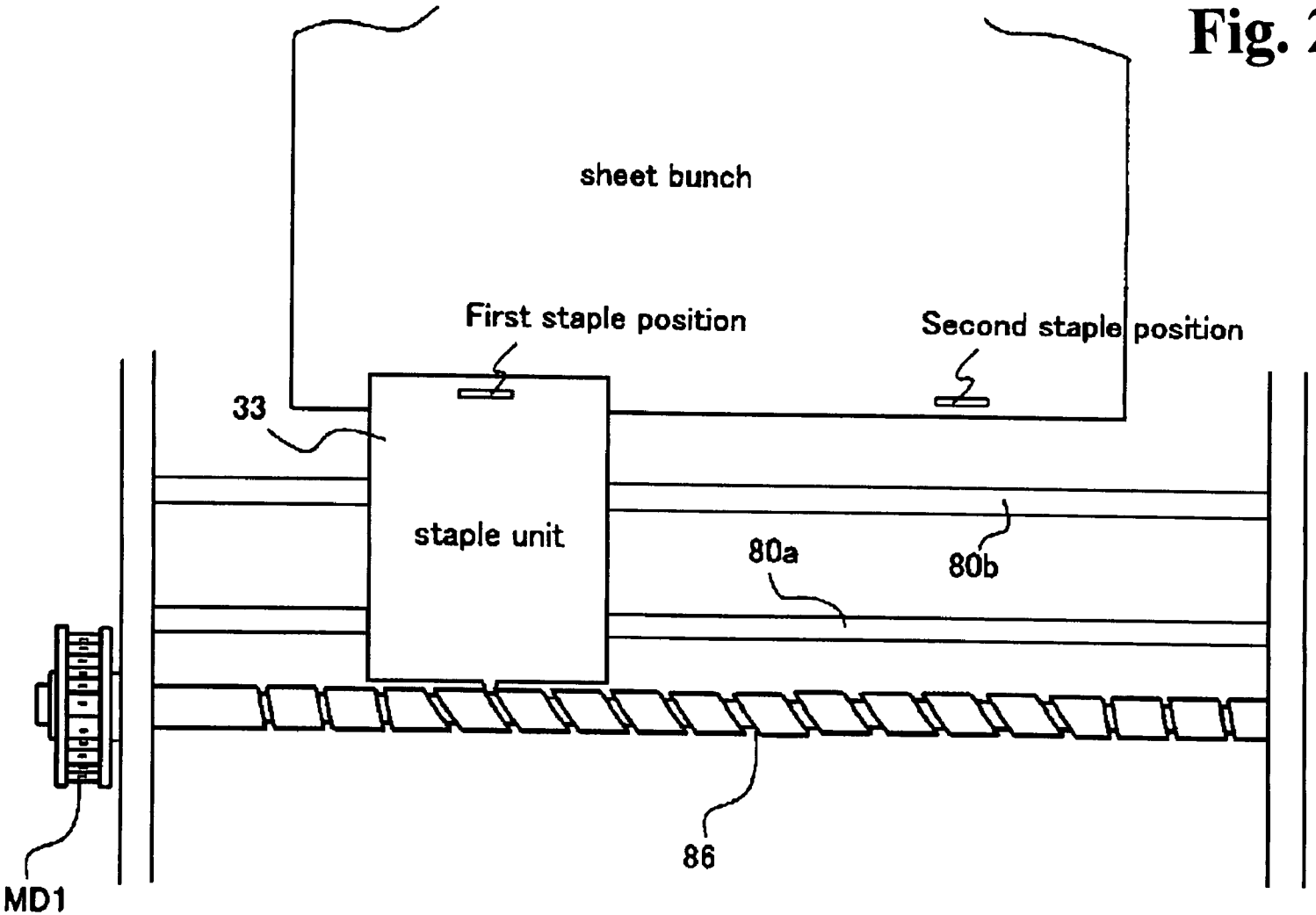
Figure 24A:
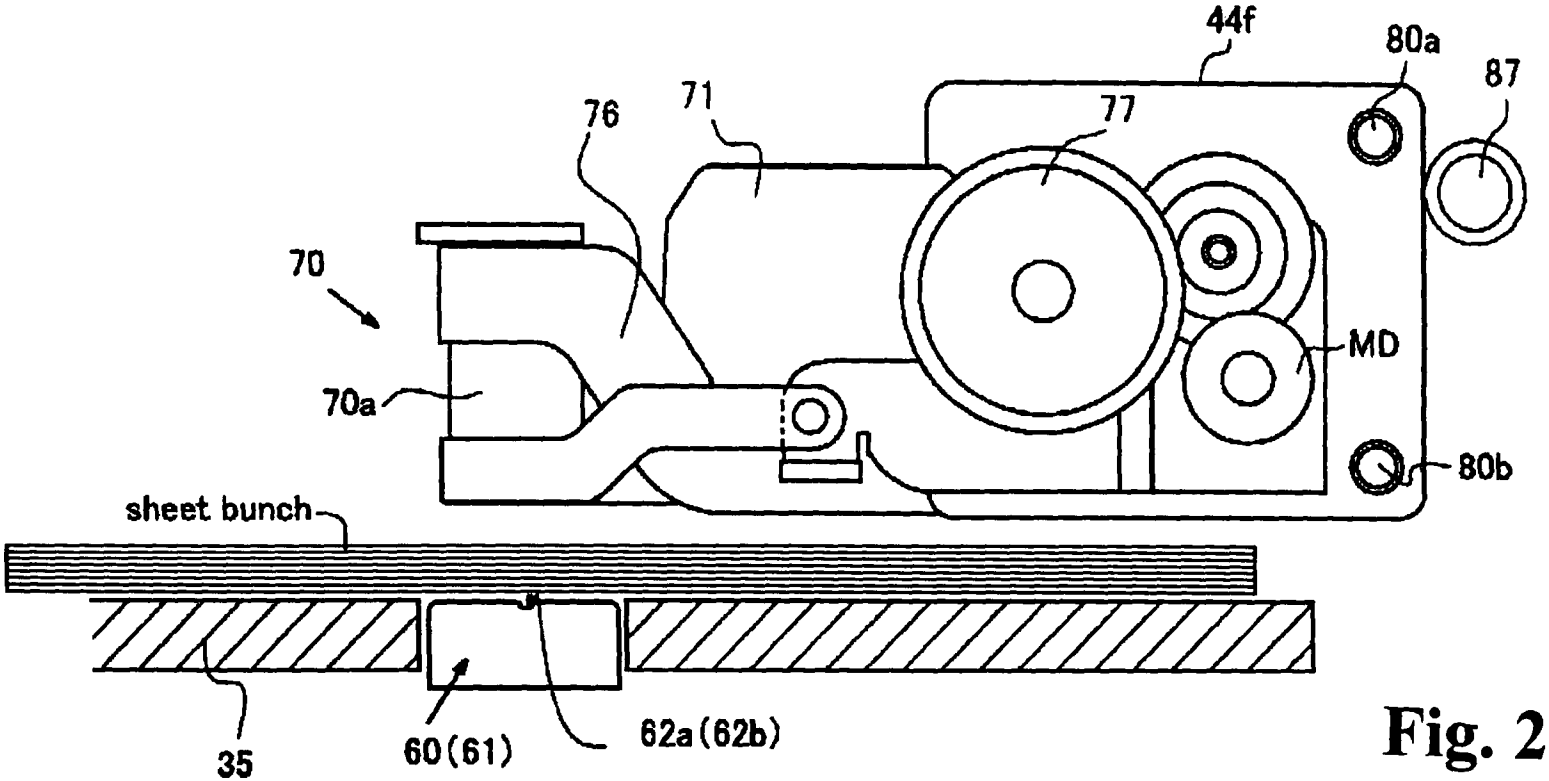
FIG. 24(*a*) is a diagram schematically illustrating the configuration of the saddle stitching staple means in FIG. 2.
Figure 24B:
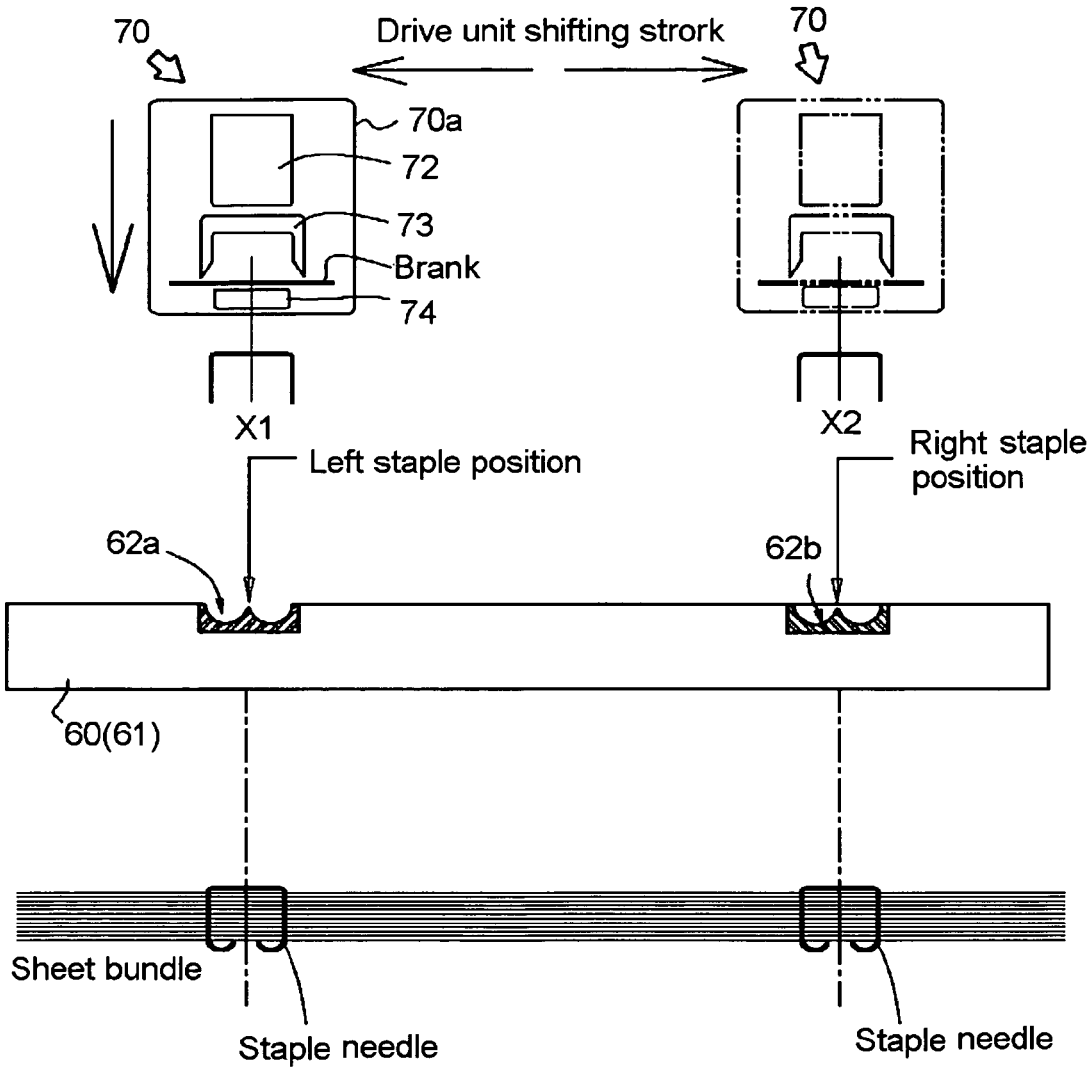

The end surface staple means 33 (hereinafter, will also be referred to as first processing unit) is composed of the driver unit 170 and the clinch unit 160 as shown in FIG. 23(*a*). The driver unit 170 is composed of the head section 170*a* that sticks the staple needle into the sheet bunch set at the staple position, the cartridge 75 in which the staple needles are accommodated, the drive cam 177, and the staple motor MD' that drives the drive cam 177. The clinch unit 160 is composed of the folding groove 162 in which the tip of the staple needle stuck into the sheet bunch is folded. The driver unit 170 and clinch unit 160 of the end surface stapling means 33 are integrally mounted on the unit frame. The head section 170*a* reciprocates via the drive cam 177 in the vertical direction of FIG. 23(*a*) and contains the former 173 and the bending block 174. The former 173 and the dice member 174 are the same as those of the saddle stitching staple means 40, described below. The structures of the former 173 and the bending block 174 are shown in FIG. 24(*b*).

The configuration of the saddle stitching staple means 40 will be described with reference to FIGS. 24(*a*) and 24(*b*). The saddle stitching staple means 40 is composed of the driver unit 70 and the clinch unit 60 similarly to the end surface staple means 33. The driver unit 70 is composed of the head section 70*a* that sticks the staple needle into the sheet bunch set at the staple position, the cartridge 75 in which the staple needles are accommodated, the drive cam 77, and the staple motor MD that drives the drive cam 77. The driver unit 70 contains the driver member 72, the former member 73, and the bending block 74 arranged in the head section 70*a* of the frame in this order in the vertical direction as shown in FIG. 24(*b*). The driver member 72 and the former member 73 are supported in the head section 70*a* so as to slidably reciprocate in the vertical direction between the top dead center and the bottom dead center. The bending bock 74 is fixed to the head section 70*a* as a shaping tool that folds the linear staple like the letter U.

The cartridge 75 containing the staple needles is installed inside the frame so that the staple needles in the cartridge 75 are sequentially supplied to the bending block 74. The driver member 72 and the former member 73 are coupled to the drive lever 76 swingably attached to the frame 71 and driven in the vertical direction between the top dead center and the bottom dead center. The frame has a stored-energy spring (not shown) that drives the drive lever 76 in the vertical direction, the drive cam 77 that stores energy in the spring, and the drive motor MD that drives the drive cam 77.

The clinch unit 260 is located opposite the driver unit 70 configured as described above, across the sheet bunch. The clinch unit 60 is swingably supported by the driver unit 70 via a shaft or configured as a structure separate from the driver unit 70. In the illustrated apparatus, the clinch unit 60 is composed of a unit separate from the driver unit 70. The clinch unit 60 folds the needle tip stuck into the sheet bunch by the driver unit 70. The clinch unit 60 is thus composed of the anvil member 61 having the folding groove in which the tip of the staple needle is folded. The illustrated clinch unit 60 is composed of the anvil unit 61 having the folding grooves 62*a* and 62*b*, arranged opposite the driver unit 70 across the sheet bunch on the sheet loading table. In particular, the illustrated apparatus is characterized in that the plurality of folding grooves, that is, the lateral paired folding grooves 62*a* and 62*b*, are formed in the anvil member 61 at respective positions in the width direction of the sheet bunch supported on the collecting guide 35, so as to lie at a predetermined distance from each other. This configuration allows the sheet bunch supported on the collecting guide 35 to be stapled at the two lateral positions with the clinch unit 60 fixed and without the need to move the clinch unit 60.

The clinch unit 60 may be a wing member (not shown) which folds the needle tip of the staple needle and which is swingably rotated in conjunction (synchronism) with the needle tip stuck into the sheet bunch by the driver unit 70. In this case, a pair of folding wings is swingably supported on the frame of the clinch unit 60 via a shaft at positions opposite to the respective ends of the U-shaped needle. The pair of folding wings is then swung in conjunction with the operation performed by the driver unit 70 to stick the staple needle into the sheet bunch. The swing of the pair of wings allows the needle tip of the staple needle to be folded flat along a back surface of the sheet bunch. That is, the folding grooves allow the needle tip to be folded like the letter U (spectacle clinch). The wing member allows the needle tip to be linearly folded (flat clinch) . Either of the configurations can be adopted for the present invention.

With this configuration, in the driver member 72 and former member 73, built in the head section 70*a*, rotation of the staple motor MD causes the drive cam 77 to depress the drive lever 76 from the upper top dead center to the lower bottom dead center via the stored-energy spring. The lowering operation of the drive lever 76 moves the driver member 72 and former member 73, coupled to the drive lever 76, from the top dead center to the bottom dead center. The driver member 72 is composed of a plate-like member so as to depress a rear part of the staple needle folded like the letter U. The former member 73 is composed of a U-shaped member as shown in FIG. 24(*b*) and folds the staple needle like the letter U between the former member 73 and the bending block 74. That is, the staple needle is fed from the cartridge 75 to the bending block 74, and the linear staple needle is urged between the former member 73 and the bending block 74 so as to be shaped like the letter "U". The driver member 72 swiftly depresses the staple needle folded like the letter "U", toward the sheet bunch to stick the needle into the sheet bunch.

The driver units, 70, and the clinch units, 60, constituting each of the end surface staple means 33 and the saddle stitching staple means 40 need to be configured to be movable in the sheet width direction (the lateral direction of FIG. 24(*b*)) of the sheet bunch on the tray means. The movement in the sheet width direction is required (1) when the apparatus is configured so that after the sheet bunch is carried in and set on the tray means, the above-described processing units are moved from the home position to the predetermined staple position to perform the stapling operation or (2) to move the processing units in the sheet width direction to staple the sheet bunch at at least two different positions. To move the processing units in the sheet width direction, two apparatus configurations are available; one of the apparatus configurations (end surface stapling means 33) simultaneously and integrally moves the driver unit 70 and the clinch unit 60, and the other apparatus configuration (saddle stitching staple means 40) fixes one of the units while moving the other.

Figure 22:
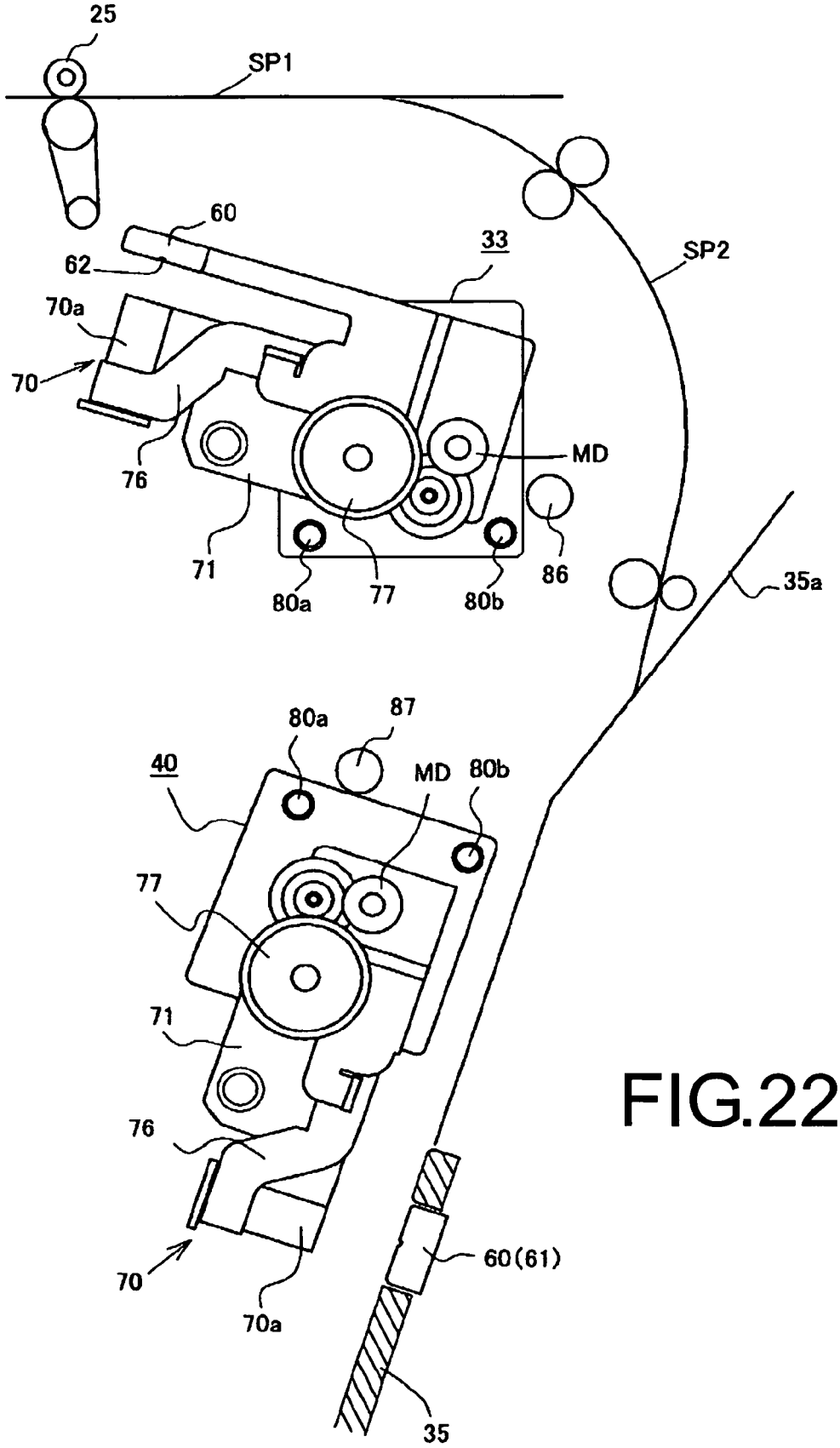
FIG. 22 is a diagram showing the layout of end surface staple means and saddle stitching staple means of the apparatus in FIG. 2.
Figure 25A:
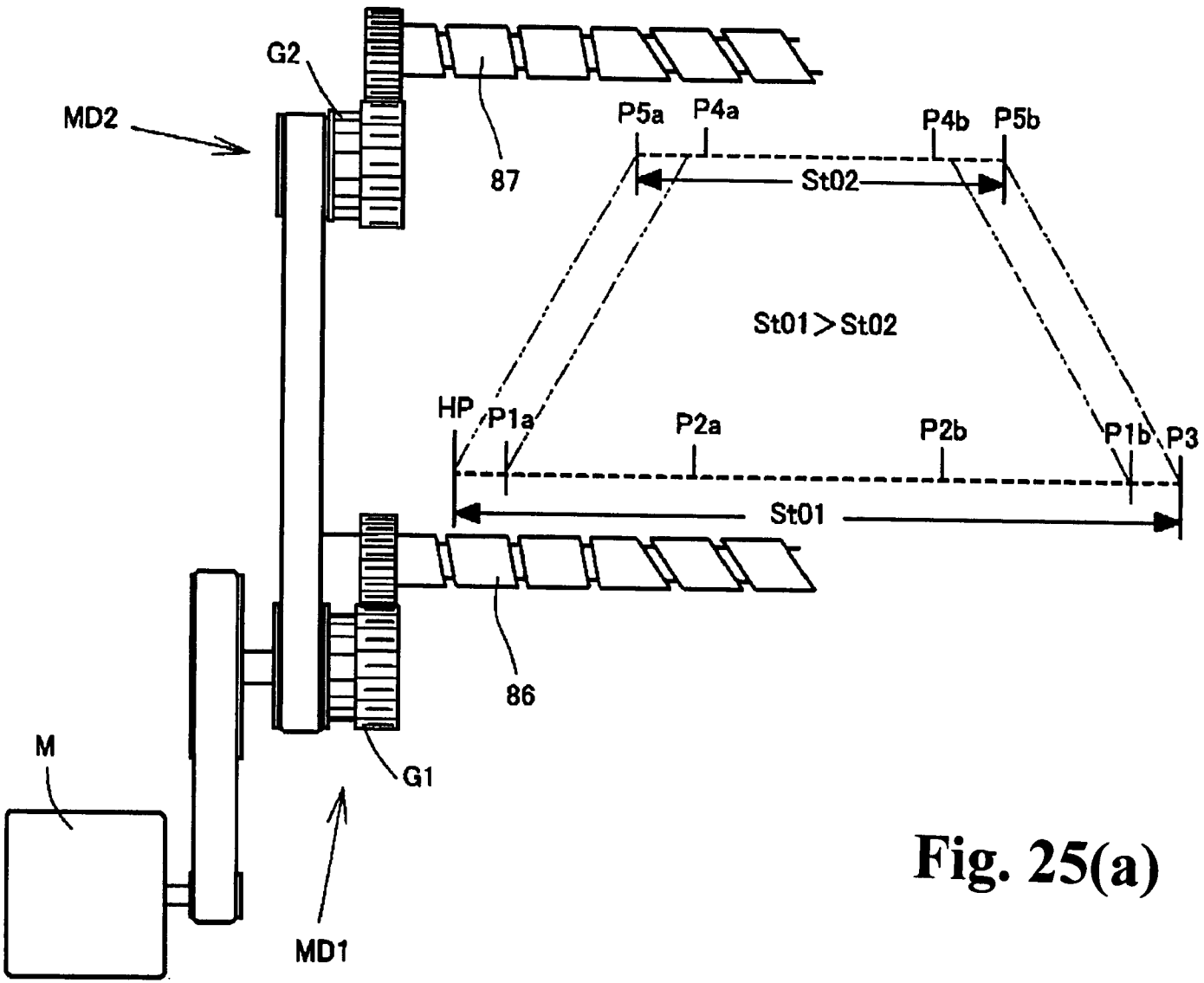
FIG. 25(*a*) is a diagram illustrating a transmission mechanism for the end surface staple means in FIG. 23(*b*) and the saddle stitching staple means in FIG. 24(*b*)
Figure 25B:
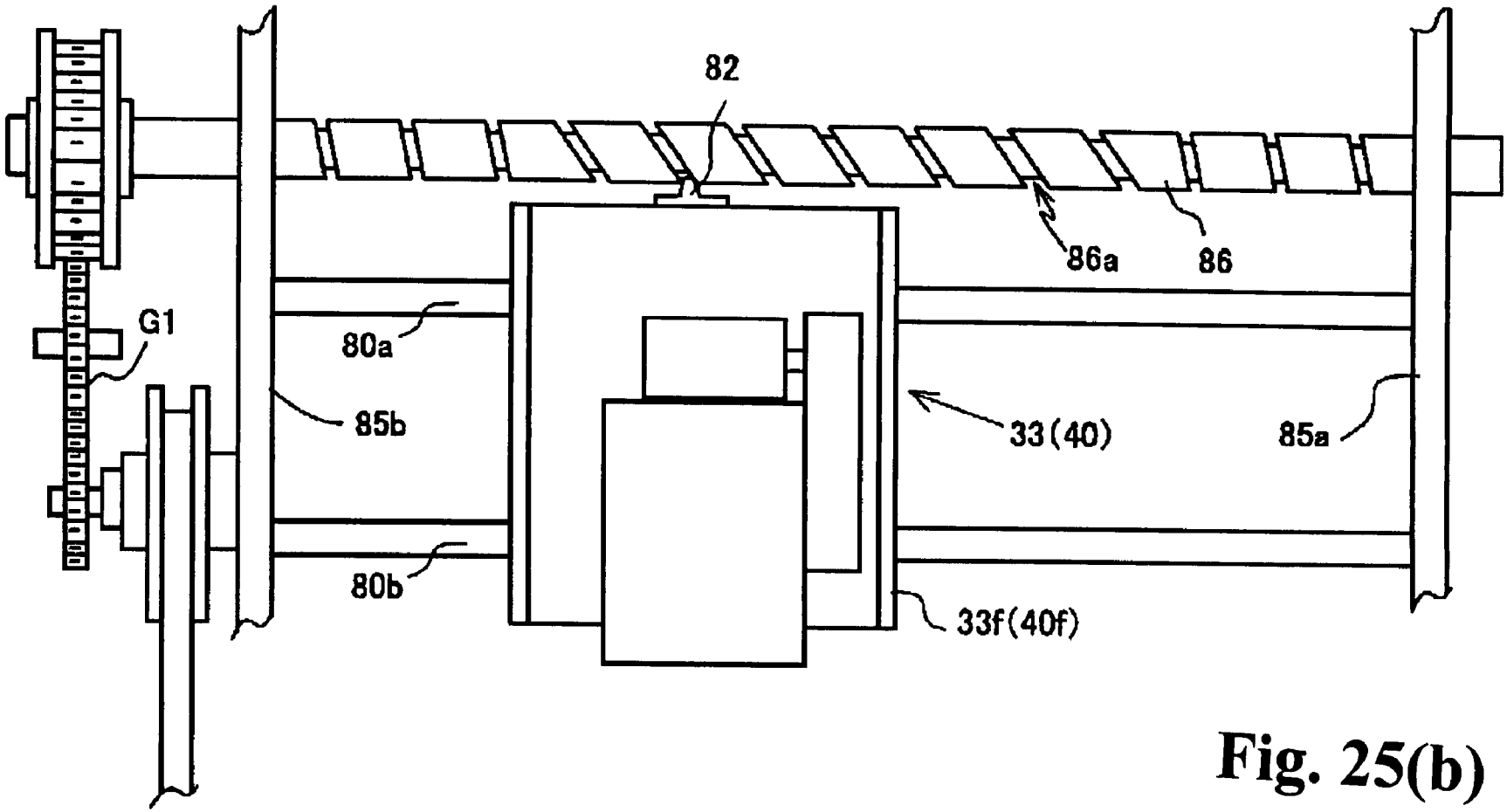

As shown in FIG. 22, the end surface staple means 33 and saddle stitching staple means 40, which are arranged adjacent to each other in the vertical direction, are slidably supported on the guide rails 80*a* and 80*b* (guide means; this also applies to the description below) arranged on the apparatus frames 85*a* and 85*b*, respectively (see FIG. 25(*b*)) . In this case, the end surface staple means 33 has a unit frame 33*f* supported on the guide rails 80*a* and 80*b* (first guide means) and comprising the driver unit 70 and the clinch unit 60. The saddle stitching staple means 40 has a unit frame 40*f* supported on the guide rails 80*a* and 80*b* (second guide means) and comprising the driver unit 70. Thus, the processing units 33 and 40 are supported so as to be movable in the sheet width direction of the sheets on the tray means along the two guide rails 80*a* and 80*b*, arranged parallel to each other.

The end surface staple means 33 and the saddle stitching staple means 40 are installed so as to be movable in the sheet width direction as described above, and each comprise driving means. The end surface staple means 33 has the lead screw 86 located parallel to the guide rails 80*a* and 80*b*. The saddle stitching staple means 40 has a lead screw 87 located parallel to the guide rails 80*a* and 80*b*. An engaging projection 82 formed on the unit frame 33*f* or 40*f* of each of the processing units engages the screw groove 86*a*. The lead screw 86 in the end surface staple means 33 and the lead screw 87 in the saddle stitching staple means 40 are coupled to the drive motor M. This transmission mechanism will be described with reference to FIG. 25(*a*) First unit driving means MD1 moving the end surface staple means 33 to the predetermined post-processing position (staple position) is composed of the lead screw 86, and first transmission means G1 and the drive motor M which rotationally drive the lead screw 86. Likewise, second unit driving means MD2 moving the saddle stitching staple means 40 to the predetermined post-processing position is composed of the lead screw 87, and second transmission means G2 and the drive motor M which rotationally drive the lead screw 87.

An embodiment of the present invention is thus characterized in that the first unit driving means MD1 and the second unit driving means MD2 are constructed using the single driving means (drive motor) M; the first unit driving means MD1 moves the end surface staple means 33 in the sheet width direction, and the second unit driving means MD2 moves the saddle stitching staple means 40 in the sheet width direction. Thus, the end surface staple means 33 can be moved in the sheet width direction by rotating the drive motor M by a predetermined amount from a home position thereof. Furthermore, the controllable rotation of the drive motor M enables the saddle stitching staple means 40 to be moved in the sheet width direction.

The positions of the end surface staple means 33 and the saddle stitching staple means 40 are controlled using the single driving means (drive motor) M as described above. In this case, these processing units may have different moving strokes St. For example, as shown in FIG. 25(*a*), the end surface staple means 33 reciprocates at a stroke St01 among a position P1*a* where the sheets are stapled at a left corner thereof, a position P1*b* where the sheets are stapled at a right corner thereof, positions P2*a* and P2*b* where the sheets are stapled at the center thereof, a home position HP, and a position P3 where the staple needle is replaced. The saddle stitching staple means 40 reciprocates at a moving stroke St02 among positions P4*a* and P4*b* where the sheets are stapled at the center thereof, a left end position P5*a*, and a right end position P5*b*. In this case, St01>St02.

The single driving means (drive motor) Mis controllably rotated to place the end surface staple means 33 at the appropriate position (HP, P1*a*, P2*a*, P2*b*, P1*b*, or P3) and to place the saddle stitching staple means 40 at the appropriate position (P5*a*, P4*a*, P4*b*, or P5*b*). The transmission gear G1 constituting the above-described first transmission means thus has a reduction gear ratio different from that of the transmission gear G2 constituting the above-described second transmission means. That is, the reduction gear ratios of the transmission gears G1 and G2 are set so that a predetermined rotation of the driving means (drive motor) M moves the end surface staple means 33 over a stroke St01, while moving the saddle stitching staple means 40 over a stroke St02. This configuration allows the two processing units 33 and 40 with different strokes to be controlled by the single drive motor M without using any special clutch.

In the above description, to move the first and second processing units 33 and 40 with different strokes to the respective processing positions using the single driving motor M, the first transmission means G1 and the second transmission means G2 have the different transmission ratios corresponding to the respective strokes. Alternatively, sliding transmission means may be provided in one of the first and second transmission means G1 and G2 to allow the first and second processing units 33 and 40 to reciprocate over the respective strokes. This will be described with reference to FIG. 26.

Figure 26:
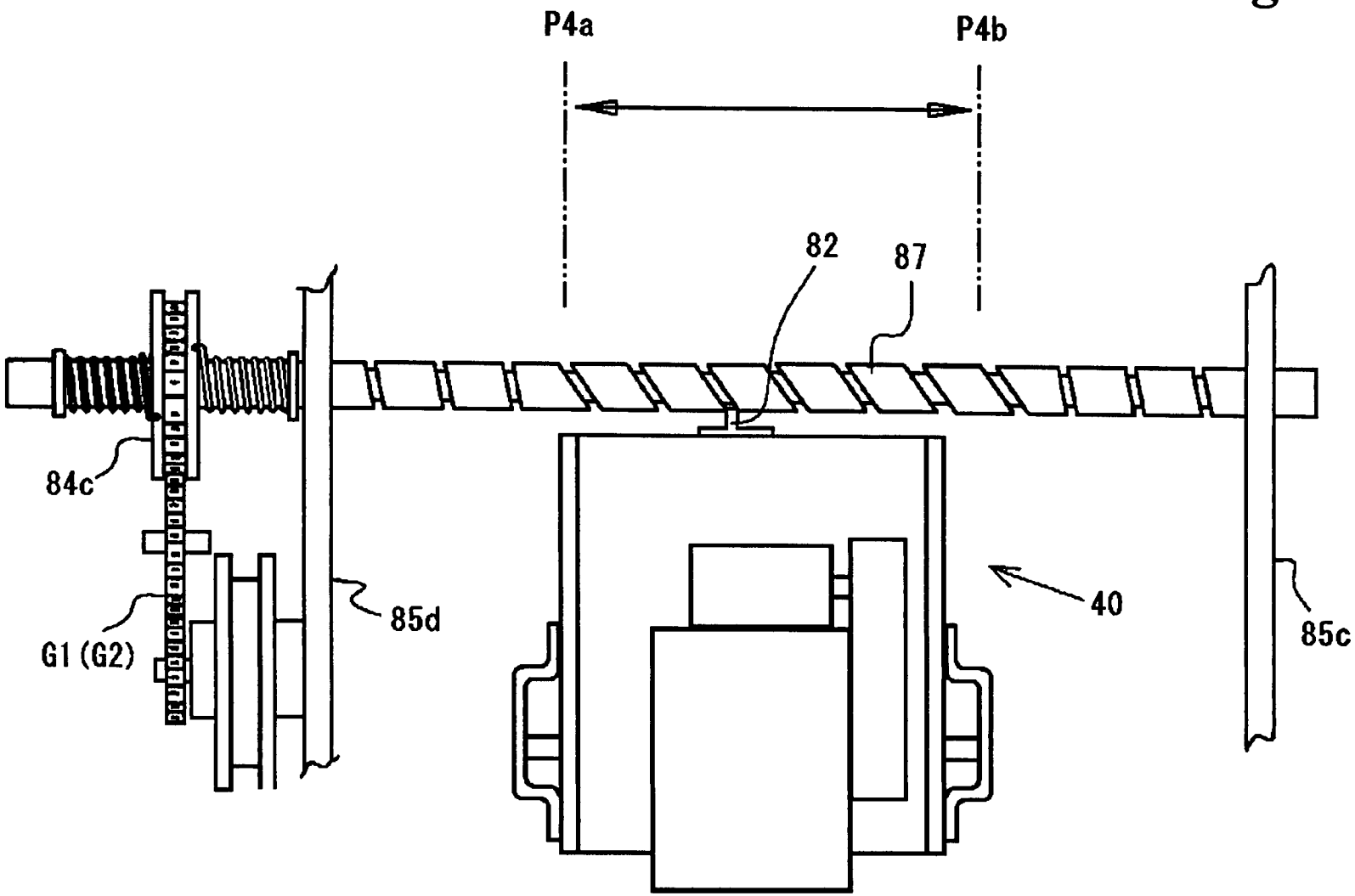
FIG. 26 is a diagram illustrating the unit moving mechanism in FIG. 6 which is different from that in FIG. 7.

In FIG. 26, the sliding clutch 84*c* is provided between the drive motor M (not shown) and the lead screw 87 in the saddle stitching staple means 40. The clutch 84*c* is composed of a torque limiter. That is, the rotation of the drive motor M is reduced via the rotating shaft so that the reduced rotation is transmitted to the lead screw 87 via the torque limiter. Stoppers (frame side frames) 85*c* and 85*d* are provided to allow the saddle stitching staple means 40 to reciprocate between the processing positions P4*a* and P4*b*, shown in FIG. 26.

When moved in the sheet width direction, the saddle stitching staple means 40 abuts against the right or left limit abutting stopper members 85*c* or 85*d* and is subjected to position regulation at this position. The end surface staple means 33 is subsequently moved. Consequently, even though the drive motor M is continuously rotated in the same direction, the rotation of the rotating shaft is slidably transmitted by the torque limiter to hold the saddle stitching staple means 40 at the predetermined processing position P4*a* or P4*b*.

As described above, according to the present invention, the first switchback conveying path is provided downstream of the sheet carry-in path, and the second switchback conveying path is provided upstream of the first switchback conveying path. The first collecting means, provided on the first switchback conveying path, sets and collects the sheets and then executes the stapling process, and the sheet collecting means, provided on the second switchback conveying path, executes the sheet folding process on the sheets. The present invention thus exerts the following effects.

The sheet guided to the first and second switchback conveying path through the sheet carry-in path is conveyed along the relatively linear path. Thus, a thick sheet or a sheet with a small coefficient of friction can be reliably and stably conveyed. This prevents a conveyance mark such as image rubbing from being left on the sheet.

The sheet from the image forming apparatus to be subjected to the stapling finish is guided to the first collecting means through the first switchback conveying path. The sheets to be subjected to the folding finish are guided to the second sheet collecting means through the second switchback conveying path. Thus, even when the preceding sheet is being processed, the succeeding sheet to be subjected to the different finish process can be carried into the apparatus. This enables continuous sheet processing to be efficiently achieved at a high speed. In particular, even if for example, a trouble such as a jam occurs during the processing of the preceding sheet, the succeeding sheet can be carried into the apparatus without being stopped. This allows jam processing to be executed at the optimum timing.

Moreover, the first switchback conveying path for the stapling finish is located downstream of the sheet carry-in path, and the second switchback conveying path for the sheet folding finish is located upstream of the sheet carry-in path. This allows the second switchback conveying path, on which the sheet folding mechanism or the saddle stitching staple means is located, to be placed in the central part of the apparatus. A compact, small-sized apparatus can thus be provided.

The present application claims the priorities of Japanese Patent Application No. 2007-022041, Japanese Patent Application No. 2007-022038, Japanese Patent Application No. 2007-022040, Japanese Patent Application No. 2007-144038, Japanese Patent Application No. 2007-221653, and Japanese Patent Application No. 2007-221654 which are incorporated herein by reference.

What is claimed is:

1. A post-processing apparatus for transferring sheets and post-processing on the sheets, the apparatus comprising:

a sheet carry-in path arranged substantially horizontally for transferring the sheets fed from a carry-in port sequentially to a sheet discharging port;

a first switchback conveying path branching downwardly from the sheet carry-in path from a position adjacent to the sheet discharging port so as to reverse a sheet conveying direction;

a first post-processing section disposed at the first switchback conveying path to execute post-processing on the sheets in the first switchback conveying path;

a second switchback conveying path branching downwardly from the sheet carry-in path between the carry-in port and the sheet discharging port upstream of the first switchback conveying path so as to reverse the sheet conveying direction transferred to the sheet carry-in path to transfer the sheets to a position under the first switchback conveying path;

a second post-processing section located at the second switchback conveying path to execute post-processing on the sheets in the second switchback conveying path, a forward reversible sheet conveying roller located on the second switchback conveying path for temporarily holding, on the switchback conveying path, the sheet traveling to the first sheet collecting device positioned downstream of the sheet carry-in path, a sheet discharging roller located at the sheet discharging port of the sheet carry-in path;

a sheet conveying roller located at a path inlet of the second switchback conveying path; and a conveyance control device for controlling the sheet discharging roller and the sheet conveying roller, wherein the conveyance control device controls the sheet discharging roller and the sheet conveying roller so that a succeeding sheet fed to the carry-in port stands by temporarily on the second switchback conveying path while the first post-processing section is performing a post-processing operation, and so that after the post-processing operation of the first post-processing section is finished, the succeeding sheet standing by on the second switchback conveying path is transferred to the first post-processing section, and wherein the first post-processing section comprises:

a first sheet collecting device on which the sheets from the first switchback conveying path are set and collected into a bunch; and an end surface staple device for stapling the sheets collected on the first sheet collecting device, at an edge thereof, and the second post-processing section comprises:

a second sheet collecting device on which the sheets from the second switchback conveying path are set and collected into a bunch; and one of folding roll device for folding together the sheets collected on the second sheet collecting device and a saddle stitching staple device for stapling the sheets at a center thereof.

2. The post-processing apparatus according to claim 1, wherein the second switchback, conveying path is located in a substantially vertical direction.

3. The post-processing apparatus according to claim 1, further comprising a sheet discharging tray located at the sheet discharge port on the sheet carry-in path so that the sheets are loaded and supported on the sheet discharging tray, the sheet discharging tray supporting leading ends of the sheets guided through the first switchback conveying path and the second switchback conveying path.

4. The post-processing apparatus according to claim 1, further comprising a sheet discharging tray connected to the first sheet collecting device, said sheet discharging tray receiving and housing the sheets or sheet bunch, and supporting a sheet-conveying-direction leading end of the sheet from the sheet carry-in path so that a sheet-conveying-direction trailing end of the sheet is supported by the first sheet collecting device.

5. The post-processing apparatus according to claim 1, wherein the conveyance control device intermittently rotationally drives the sheet conveying roller to offset the overlapping sheets forward and backward in a conveying direction by a predetermined amount, to thereby allow a plurality of sheets on the second switchback conveying path so that the sheets overlap one another.

6. The post-processing apparatus according to claim 1, wherein the first post-processing section includes a sheet collecting device so that the sheets from the sheet discharging port are loaded and housed on the sheet collecting device, the sheet collecting device including a sheet end regulating device against which the sheet end abuts for regulation and an aligning conveying device for transferring the sheet to the regulating device, and the conveyance control device setting an offset amount by which a plurality of sheets is offset from each other on the first switchback conveying path, longer than a distance between the sheet end regulating device and the aligning conveying device.

7. The post-processing apparatus according to claim 1, wherein the sheet discharging roller and the sheet conveying roller are configured so that a distance between the sheet discharging roller and the sheet conveying roller is shorter than at least a conveying-direction length of a maximum size sheet, the discharging roller includes a pair of rollers that is able to freely pressure contact with and separate from each other, and the conveyance control device separates the sheet discharging rollers from each other to lay a standby sheet standing by on the second switchback conveying path, with a succeeding sheet fed to the carry-in port and then uses the sheet discharging rollers to transfer the sheets to the first post-processing section.

8. The post-processing apparatus according to claim 1, further comprising a sheet locking member located on the sheet carry-in path upstream of the second switchback conveying path for temporarily holding the sheet traveling to the second switchback conveying path.

9. The post-processing apparatus according to claim 1, wherein the sheet carry-in path is configured so that the sheet from the carry-in port is guided to the first or second switchback conveying path and to an exterior of the apparatus.

10. An image forming system comprising:

an image forming apparatus sequentially forming images on sheets; and the post-processing apparatus, executing post-processing according to claim 1.

11. A post-processing apparatus for transferring sheets and post-processing on the sheets, the apparatus comprising:

a sheet carry-in path located in a substantially horizontal direction for transferring the sheets fed to a carry-in port sequentially to a sheet discharging port;

a first switchback conveying path branching from the sheet carry-in path so as to reverse a sheet conveying direction;

a first post-processing section connected to the first switchback conveying path to execute post-processing on the sheets;

a second switchback conveying path branching from between the carry-in port and the sheet discharging port of the sheet carry-in path upstream of the first switchback conveying path so as to reverse the sheet conveying direction to transfer the sheets to a position different from that of the sheet carry-in path; and a second post-processing section located downstream of the second switchback conveying path to execute the post-processing on the sheets;

wherein the first post-processing section comprises:

a first sheet collecting device on which the sheets from the first switchback conveying path are set and collected into a bunch; and an end surface staple device for stapling the sheets collected on the first sheet collecting device, at an edge thereof, and the second post-processing section comprises:

a second sheet collecting device on which the sheets from the second switchback conveying path are set and collected into a bunch; and one of a folding roll device for folding together the sheets collected on the second sheet collecting device and a saddle stitching staple device for stapling the sheets at a center thereof, wherein the end surface staple device and the saddle stitching staple device are arranged in a vertical direction in a space surrounded by the sheet carry-in path and the first and second switchback conveying paths and include a single drive motor for operating both staple devices.

12. The post-processing apparatus according to claim 11, wherein the saddle stitching staple device has a moving stroke shorter than that of the end surface staple means.

13. The post-processing apparatus according to claim 11, further comprising a first guide device and a second guide device for supporting the end surface staple device and the saddle stitching staple device so that positions of the end surface staple device and the saddle stitching staple device are movable along edges of the collected sheets, the first guide device or the second guide device having a position sensor to detect positions of the first processing unit and the second processing unit.

14. A post-processing apparatus for transferring sheets and post-processing on the sheets, the apparatus comprising:

a sheet carry-in path located in a substantially horizontal direction for transferring the sheets fed to a carry-in port sequentially to a sheet discharging port;

a first switchback conveying path branching from the sheet carry-in path so as to reverse a sheet conveying direction;

a first post-processing section connected to the first switchback conveying path to execute post-processing on the sheets;

a second switchback conveying path branching from between the carry-in port and the sheet discharging port of the sheet carry-in path upstream of the first switchback conveying path so as to reverse the sheet conveying direction to transfer the sheets to a position different from that of the sheet carry-in path; and a second post-processing section located downstream of the second switchback conveying path to execute post-processing on the sheets;

wherein the first post-processing section comprises:

a first sheet collecting device on which the sheets from the first switchback conveying path are set and collected into a bunch; and an end surface staple device for stapling the sheets collected on the first sheet collecting device, at an edge thereof, and the second post-processing section comprises:

a second sheet collecting device on which the sheets from the second switchback conveying path are set and collected into a bunch; and one of a folding roll device for folding together the sheets collected on the second sheet collecting device and a saddle stitching staple device for stapling the sheets at a center thereof, and wherein the saddle stitching staple device comprises:

a sheet bunch holding device for holding series of sheets set into a bunch in a predetermined posture;

a staple device for stapling the sheet bunch held by the sheet bunch holding device, the staple device comprising a head unit having a driver member sticking a staple needle into the sheet bunch held by the sheet bunch holding device, and an anvil unit separate from the head unit and having a plurality of folding grooves in which tips of the staple needle stuck into the sheet bunch are folded, said plurality of folding grooves being arranged at different positions in the width direction and having different tip folding depths, the head unit being configured so that a position of the head unit is movable in a predetermined width direction of the sheet bunch held on the sheet bunch holding device; and a staple control device for controlling a staple operation of the staple device, the staple control device moving the head unit to a position located opposite the folding groove with a folding shape selected in accordance with a sheet bunch thickness and a sheet material, to staple the sheet bunch at one position or a plurality of positions.

* * * * *